US009719302B2

(12) United States Patent
Linyaev et al.

(10) Patent No.: US 9,719,302 B2
(45) Date of Patent: Aug. 1, 2017

(54) HIGH POWER LASER PERFORATING AND LASER FRACTURING TOOLS AND METHODS OF USE

(71) Applicant: Foro Energy Inc., Littleton, CO (US)

(72) Inventors: Eugene J. Linyaev, Magnolia, TX (US); Mark S. Zediker, Castle Rock, CO (US); Daryl L. Grubb, Houston, TX (US); Sam N. Schroit, Littleton, CO (US); Ronald A. De Witt, Katy, TX (US); Sharath K Kolachalam, Highlands Ranch, CO (US); Paul D. Deutch, Houston, TX (US); Brian O. Faircloth, Evergreen, CO (US)

(73) Assignee: Foro Energy, Inc., Houston, TX (US)

( * ) Notice: Subject to any disclaimer, the term of this patent is extended or adjusted under 35 U.S.C. 154(b) by 411 days.

(21) Appl. No.: 13/782,869

(22) Filed: Mar. 1, 2013

(65) Prior Publication Data

US 2013/0228372 A1 Sep. 5, 2013
US 2017/0183913 A9 Jun. 29, 2017

Related U.S. Application Data

(63) Continuation-in-part of application No. 13/222,931, filed on Aug. 31, 2011, and a continuation-in-part of
(Continued)

(51) Int. Cl.
*E21B 7/15* (2006.01)
*E21B 49/00* (2006.01)
(Continued)

(52) U.S. Cl.
CPC ..... *E21B 7/15* (2013.01); *E21B 43/26* (2013.01); *E21B 43/162* (2013.01); *E21B 49/00* (2013.01)

(58) Field of Classification Search
CPC . E21B 49/00; E21B 7/15; E21B 43/26; E21B 43/162
(Continued)

(56) References Cited

U.S. PATENT DOCUMENTS 914,636 A 3/1909 Case
2,548,463 A 4/1951 Blood
(Continued)

FOREIGN PATENT DOCUMENTS

EP 0 295 045 A2 12/1988
EP 0 515 983 A1 12/1992
(Continued)

OTHER PUBLICATIONS

International Search Report and Written Opinion of the International Searching Authority, PCT/US14/29375, mailed Nov. 25, 2014.
(Continued)

*Primary Examiner* — Kenneth L Thompson
(74) *Attorney, Agent, or Firm* — Glen P. Belvis; Steptoe & Johnson, LLP.

(57) ABSTRACT

There are provided high power laser perforating tools and methods of delivering laser energy patterns that enhance the flow of energy sources, such as hydrocarbons, from a formation into a production tubing or collection system. These tools and methods precisely deliver predetermined laser beam energy patterns, to provide for custom geometries in a formation. The patterns and geometries are tailored and customized to the particular geological and structural features of a formation and reservoir.

12 Claims, 29 Drawing Sheets

Related U.S. Application Data application No. 12/320,581, filed on Jan. 29, 2009, now abandoned, and a continuation-in-part of application No. 12/543,986, filed on Aug. 19, 2009, now Pat. No. 8,826,973.

(60) Provisional application No. 60/605,429, filed on Mar. 1, 2012, provisional application No. 61/727,096, filed on Nov. 15, 2012, provisional application No. 61/378,910, filed on Aug. 31, 2010, provisional application No. 61/090,384, filed on Aug. 20, 2008.

(51) Int. Cl.
*E21B 43/26* (2006.01)
*E21B 43/16* (2006.01)

(58) Field of Classification Search
USPC ..... 166/308.1, 177.5, 248; 175/11, 16
See application file for complete search history.

(56) References Cited

U.S. PATENT DOCUMENTS 2,742,555 A 4/1956 Murray
3,122,212 A 2/1964 Karlovitz
3,383,491 A 5/1968 Muncheryan
3,461,964 A 8/1969 Venghiattis
3,493,060 A 2/1970 Van Dyk
3,503,804 A 3/1970 Schneider et al.
3,539,221 A 11/1970 Gladstone
3,544,165 A 12/1970 Snedden
3,556,600 A 1/1971 Shoupp et al.
3,574,357 A 4/1971 Alexandru et al.
3,586,413 A 6/1971 Adams
3,652,447 A 3/1972 Yant
3,693,718 A 9/1972 Stout
3,699,649 A 10/1972 McWilliams
3,802,203 A 4/1974 Ichise et al.
3,820,605 A 6/1974 Barber et al.
3,821,510 A 6/1974 Muncheryan
3,823,788 A 7/1974 Garrison et al.
3,871,485 A 3/1975 Keenan, Jr.
3,882,945 A 5/1975 Keenan, Jr.
3,938,599 A 2/1976 Horn
3,960,448 A 6/1976 Schmidt et al.
3,977,478 A 8/1976 Shuck
3,992,095 A 11/1976 Jacoby et al.
3,998,281 A 12/1976 Salisbury et al.
4,019,331 A 4/1977 Rom et al.
4,025,091 A 5/1977 Zeile, Jr.
4,026,356 A 5/1977 Shuck
4,047,580 A 9/1977 Yahiro et al.
4,057,118 A 11/1977 Ford
4,061,190 A 12/1977 Bloomfield
4,066,138 A 1/1978 Salisbury et al.
4,090,572 A 5/1978 Welch
4,113,036 A * 9/1978 Stout ..... 175/11
4,125,757 A 11/1978 Ross
4,151,393 A 4/1979 Fenneman et al.
4,162,400 A 7/1979 Pitts, Jr.
4,189,705 A 2/1980 Pitts, Jr.
4,194,536 A 3/1980 Stine et al.
4,199,034 A 4/1980 Salisbury et al.
4,227,582 A 10/1980 Price
4,228,856 A 10/1980 Reale
4,243,298 A 1/1981 Kao et al.
4,249,925 A 2/1981 Kawashima et al.
4,252,015 A 2/1981 Harbon et al.
4,256,146 A 3/1981 Genini et al.
4,266,609 A 5/1981 Rom et al.
4,280,535 A 7/1981 Willis
4,281,891 A 8/1981 Shinohara et al.
4,282,940 A 8/1981 Salisbury et al.
4,332,401 A 6/1982 Stephenson et al.
4,336,415 A 6/1982 Walling
4,340,245 A 7/1982 Stalder
4,367,917 A 1/1983 Gray
4,370,886 A 2/1983 Smith, Jr. et al.
4,374,530 A 2/1983 Walling
4,375,164 A 3/1983 Dodge et al.
4,389,645 A 6/1983 Wharton
4,415,184 A 11/1983 Stephenson et al.
4,417,603 A 11/1983 Argy
4,423,980 A 1/1984 Warnock
4,436,177 A 3/1984 Elliston
4,444,420 A 4/1984 McStravick et al.
4,453,570 A 6/1984 Hutchison
4,459,731 A 7/1984 Hutchison
4,477,106 A 10/1984 Hutchison
4,504,112 A 3/1985 Gould et al.
4,522,464 A 6/1985 Thompson et al.
4,531,552 A 7/1985 Kim
4,565,351 A 1/1986 Conti et al.
4,662,437 A 5/1987 Renfro
4,694,865 A 9/1987 Tauschmann
4,725,116 A 2/1988 Spencer et al.
4,741,405 A 5/1988 Moeny et al.
4,770,493 A 9/1988 Ara et al.
4,774,393 A 9/1988 Tarumoto
4,774,420 A 9/1988 Sutton
4,793,383 A 12/1988 Gyory et al.
4,830,113 A 5/1989 Geyer
4,860,654 A 8/1989 Chawla et al.
4,860,655 A 8/1989 Chawla
4,872,520 A 10/1989 Nelson
4,924,870 A 5/1990 Wlodarczyk et al.
4,952,771 A 8/1990 Wrobel
4,989,236 A 1/1991 Myllymäki
4,997,250 A 3/1991 Ortiz, Jr.
5,003,144 A 3/1991 Lindroth et al.
5,004,166 A 4/1991 Sellar
5,033,545 A 7/1991 Sudol
5,049,738 A 9/1991 Gergely et al.
5,084,617 A 1/1992 Gergely
5,086,842 A 2/1992 Cholet
5,107,936 A 4/1992 Foppe
5,121,872 A 6/1992 Legget
5,125,061 A 6/1992 Marlier et al.
5,125,063 A 6/1992 Panuska et al.
5,128,882 A 7/1992 Cooper et al.
5,140,664 A 8/1992 Bosisio et al.
5,163,321 A 11/1992 Perales
5,168,940 A 12/1992 Foppe
5,172,112 A 12/1992 Jennings
5,212,755 A 5/1993 Holmberg
5,269,377 A 12/1993 Martin
5,285,204 A 2/1994 Sas-Jaworsky
5,308,951 A 5/1994 Mori
5,348,097 A 9/1994 Giannesini et al.
5,351,533 A 10/1994 Macadam et al.
5,353,875 A 10/1994 Schultz et al.
5,355,967 A 10/1994 Mueller et al.
5,356,081 A 10/1994 Sellar
5,396,805 A 3/1995 Surjaatmadja
5,411,081 A 5/1995 Moore et al.
5,411,085 A 5/1995 Moore et al.
5,411,105 A 5/1995 Gray
5,413,045 A 5/1995 Miszewski
5,413,170 A 5/1995 Moore
5,418,350 A 5/1995 Freneaux et al.
5,419,188 A 5/1995 Rademaker et al.
5,423,383 A 6/1995 Pringle
5,425,420 A 6/1995 Pringle
5,435,351 A 7/1995 Head
5,435,395 A 7/1995 Connell
5,463,711 A 10/1995 Chu
5,465,793 A 11/1995 Pringle
5,469,878 A 11/1995 Pringle
5,479,860 A 1/1996 Ellis
5,483,988 A 1/1996 Pringle
5,488,992 A 2/1996 Pringle
5,500,768 A 3/1996 Doggett et al.
5,503,014 A 4/1996 Griffith
5,503,370 A 4/1996 Newman et al.

(56) References Cited

U.S. PATENT DOCUMENTS 5,505,259 A 4/1996 Wittrisch et al.
5,515,926 A 5/1996 Boychuk
5,526,887 A 6/1996 Vestavik
5,561,516 A 10/1996 Noble et al.
5,566,764 A 10/1996 Elliston
5,573,225 A 11/1996 Boyle et al.
5,577,560 A 11/1996 Coronado et al.
5,586,609 A 12/1996 Schuh
5,599,004 A 2/1997 Newman et al.
5,615,052 A 3/1997 Doggett
5,638,904 A 6/1997 Misselbrook et al.
5,655,745 A 8/1997 Morrill
5,694,408 A 12/1997 Bott et al.
5,707,939 A 1/1998 Patel
5,757,484 A 5/1998 Miles et al.
5,759,859 A 6/1998 Sausa
5,771,984 A 6/1998 Potter et al.
5,773,791 A 6/1998 Kuykendal
5,794,703 A 8/1998 Newman et al.
5,813,465 A 9/1998 Terrell et al.
5,828,003 A 10/1998 Thomeer et al.
5,832,006 A 11/1998 Rice et al.
5,833,003 A 11/1998 Longbottom et al.
5,847,825 A 12/1998 Alexander
5,862,273 A 1/1999 Pelletier
5,862,862 A 1/1999 Terrell
5,896,482 A 4/1999 Blee et al.
5,896,938 A 4/1999 Moeny et al.
5,902,499 A 5/1999 Richerzhagen
5,909,306 A 6/1999 Goldberg et al.
5,913,337 A 6/1999 Williams et al.
5,924,489 A 7/1999 Hatcher
5,929,986 A 7/1999 Slater et al.
5,933,945 A 8/1999 Thomeer et al.
5,938,954 A 8/1999 Onuma et al.
5,973,783 A 10/1999 Goldner et al.
5,986,756 A 11/1999 Slater et al.
RE36,525 E 1/2000 Pringle
6,015,015 A 1/2000 Luft et al.
6,038,363 A 3/2000 Slater et al.
6,059,037 A 5/2000 Longbottom et al.
6,060,662 A 5/2000 Rafie et al.
6,065,540 A 5/2000 Thomeer et al.
RE36,723 E 6/2000 Moore et al.
6,076,602 A 6/2000 Gano et al.
6,092,601 A 7/2000 Gano et al.
6,104,022 A 8/2000 Young et al.
RE36,880 E 9/2000 Pringle
6,116,344 A 9/2000 Longbottom et al.
6,135,206 A 10/2000 Gano et al.
6,147,754 A 11/2000 Theriault et al.
6,157,893 A 12/2000 Berger et al.
6,166,546 A 12/2000 Scheihing et al.
6,180,913 B1 1/2001 Kolmeder et al.
6,215,734 B1 4/2001 Moeny et al.
6,227,200 B1 5/2001 Crump et al.
6,250,391 B1 6/2001 Proudfoot
6,273,193 B1 8/2001 Hermann et al.
6,275,645 B1 8/2001 Vereecken et al.
6,281,489 B1 8/2001 Tubel et al.
6,301,423 B1 10/2001 Olson
6,309,195 B1 10/2001 Bottos et al.
6,321,839 B1 11/2001 Vereecken et al.
6,352,114 B1 3/2002 Toalson et al.
6,355,928 B1 3/2002 Skinner et al.
6,356,683 B1 3/2002 Hu et al.
6,377,591 B1 4/2002 Hollister et al.
6,384,738 B1 5/2002 Carstensen et al.
6,386,300 B1 5/2002 Curlett et al.
6,401,825 B1 6/2002 Woodrow
6,426,479 B1 7/2002 Bischof
6,437,326 B1 8/2002 Yamate et al.
6,450,257 B1 9/2002 Douglas
6,494,259 B2 12/2002 Surjaatmadja
6,497,290 B1 12/2002 Misselbrook et al.
6,557,249 B1 5/2003 Pruett et al.
6,561,289 B2 5/2003 Portman et al.
6,564,046 B1 5/2003 Chateau
6,591,046 B2 7/2003 Stottlemyer
6,615,922 B2 9/2003 Deul et al.
6,626,249 B2 9/2003 Rosa
6,644,848 B1 11/2003 Clayton et al.
6,661,815 B1 12/2003 Kozlovsky et al.
6,710,720 B2 3/2004 Carstensen et al.
6,712,150 B1 3/2004 Crabtree et al.
6,725,924 B2 4/2004 Davidson et al.
6,747,743 B2 6/2004 Skinner et al.
6,755,262 B2 6/2004 Parker
6,808,023 B2 10/2004 Smith et al.
6,832,654 B2 12/2004 Ravensbergen et al.
6,847,034 B2 1/2005 Shah et al.
6,851,488 B2 2/2005 Batarseh
6,867,858 B2 3/2005 Owen et al.
6,870,128 B2 3/2005 Kobayashi et al.
6,874,361 B1 4/2005 Meltz et al.
6,880,646 B2 4/2005 Batarseh
6,885,784 B2 4/2005 Bohnert
6,888,097 B2 5/2005 Batarseh
6,888,127 B2 5/2005 Jones et al.
6,912,898 B2 7/2005 Jones et al.
6,913,079 B2 7/2005 Tubel
6,920,395 B2 7/2005 Brown
6,920,946 B2 7/2005 Oglesby
6,923,273 B2 8/2005 Terry et al.
6,957,576 B2 10/2005 Skinner et al.
6,967,322 B2 11/2005 Jones et al.
6,977,367 B2 12/2005 Tubel et al.
6,978,832 B2 12/2005 Gardner et al.
6,981,561 B2 1/2006 Krueger et al.
6,994,162 B2 2/2006 Robison
7,040,746 B2 5/2006 McCain et al.
7,055,604 B2 6/2006 Jee et al.
7,055,629 B2 6/2006 Oglesby
7,072,044 B2 7/2006 Kringlebotn et al.
7,072,588 B2 7/2006 Skinner
7,086,484 B2 8/2006 Smith, Jr.
7,087,865 B2 8/2006 Lerner
7,088,437 B2 8/2006 Blomster et al.
7,126,332 B2 10/2006 Blanz et al.
7,134,488 B2 11/2006 Tudor et al.
7,134,514 B2 11/2006 Riel et al.
7,140,435 B2 11/2006 Defretin et al.
7,147,064 B2 12/2006 Batarseh et al.
7,152,700 B2 12/2006 Church et al.
7,163,875 B2 1/2007 Richerzhagen
7,172,026 B2 2/2007 Misselbrook
7,172,038 B2 2/2007 Terry et al.
7,174,067 B2 2/2007 Murshid et al.
7,188,687 B2 3/2007 Rudd et al.
7,195,731 B2 3/2007 Jones
7,196,786 B2 3/2007 DiFoggio
7,199,869 B2 4/2007 MacDougall
7,201,222 B2 4/2007 Kanady et al.
7,210,343 B2 5/2007 Shammai et al.
7,212,283 B2 5/2007 Hother et al.
7,223,935 B2 5/2007 Wessner
7,249,633 B2 7/2007 Ravensbergen et al.
7,264,057 B2 9/2007 Rytlewski et al.
7,270,195 B2 9/2007 MacGregor et al.
7,273,108 B2 9/2007 Misselbrook
7,334,637 B2 2/2008 Smith, Jr.
7,337,660 B2 3/2008 Ibrahim et al.
7,362,422 B2 4/2008 DiFoggio et al.
7,365,285 B2 4/2008 Toida
7,372,230 B2 5/2008 McKay
7,394,064 B2 7/2008 Marsh
7,395,696 B2 7/2008 Bissonnette et al.
7,416,032 B2 8/2008 Moeny et al.
7,416,258 B2 8/2008 Reed et al.
7,424,190 B2 9/2008 Dowd et al.
7,471,831 B2 12/2008 Bearman et al.
7,487,834 B2 2/2009 Reed et al.
7,490,664 B2 2/2009 Skinner et al.
7,494,272 B2 2/2009 Thomas et al.

(56) References Cited

U.S. PATENT DOCUMENTS 7,503,404 B2 3/2009 McDaniel et al.
7,515,782 B2 4/2009 Zhang et al.
7,516,802 B2 4/2009 Smith, Jr.
7,518,722 B2 4/2009 Julian et al.
7,527,108 B2 5/2009 Moeny
7,530,406 B2 5/2009 Moeny et al.
7,559,378 B2 7/2009 Moeny
7,587,111 B2 9/2009 de Montmorillon et al.
7,600,564 B2 10/2009 Shampine et al.
7,603,011 B2 10/2009 Varkey et al.
7,617,873 B2 11/2009 Lovell et al.
7,624,743 B2 12/2009 Sarkar et al.
7,628,227 B2 12/2009 Marsh
7,646,794 B2 1/2010 Sakurai et al.
7,646,953 B2 1/2010 Dowd et al.
7,647,948 B2 1/2010 Quigley et al.
7,671,983 B2 3/2010 Shammai et al.
7,715,664 B1 5/2010 Shou et al.
7,720,323 B2 5/2010 Yamate et al.
7,769,260 B2 8/2010 Hansen et al.
7,802,384 B2 9/2010 Kobayashi et al.
7,834,777 B2 11/2010 Gold
7,839,904 B1 * 11/2010 Equall et al. ..... 372/10
7,843,633 B2 11/2010 Nakamae et al.
7,848,368 B2 12/2010 Gapontsev et al.
7,900,699 B2 3/2011 Ramos et al.
7,938,175 B2 5/2011 Skinner et al.
8,011,454 B2 9/2011 Castillo
8,025,371 B1 9/2011 Dean, Jr.
8,074,332 B2 12/2011 Keatch et al.
8,082,996 B2 12/2011 Kocis et al.
8,091,638 B2 1/2012 Dusterhoft et al.
8,109,345 B2 2/2012 Jeffryes
8,175,433 B2 5/2012 Caldwell et al.
8,464,794 B2 * 6/2013 Schultz et al. ..... 166/297
8,678,087 B2 * 3/2014 Schultz et al. ..... 166/297
2002/0007945 A1 1/2002 Neuroth et al.
2002/0039465 A1 4/2002 Skinner
2002/0185474 A1 12/2002 Dunsky et al.
2002/0189806 A1 12/2002 Davidson et al.
2003/0000741 A1 1/2003 Rosa
2003/0053783 A1 3/2003 Shirasaki
2003/0056990 A1 3/2003 Oglesby
2003/0085040 A1 5/2003 Hemphill et al.
2003/0094281 A1 5/2003 Tubel
2003/0132029 A1 7/2003 Parker
2003/0145991 A1 8/2003 Olsen
2003/0159283 A1 8/2003 White
2003/0160164 A1 8/2003 Jones et al.
2003/0226826 A1 12/2003 Kobayashi et al.
2004/0006429 A1 1/2004 Brown
2004/0016295 A1 1/2004 Skinner et al.
2004/0020643 A1 2/2004 Thomeer et al.
2004/0026382 A1 2/2004 Richerzhagen
2004/0033017 A1 2/2004 Kringlebotn et al.
2004/0074979 A1 4/2004 McGuire
2004/0093950 A1 5/2004 Bohnert
2004/0112642 A1 6/2004 Krueger et al.
2004/0119471 A1 6/2004 Blanz et al.
2004/0129418 A1 7/2004 Jee et al.
2004/0195003 A1 10/2004 Batarseh
2004/0206505 A1 10/2004 Batarseh
2004/0207731 A1 10/2004 Bearman et al.
2004/0211894 A1 10/2004 Hother et al.
2004/0218176 A1 11/2004 Shammal et al.
2004/0244970 A1 12/2004 Smith, Jr.
2004/0252748 A1 12/2004 Gleitman
2004/0256103 A1 12/2004 Batarseh
2005/0007583 A1 1/2005 DiFoggio
2005/0012244 A1 1/2005 Jones
2005/0024743 A1 2/2005 Camy-Peyret
2005/0034857 A1 2/2005 Defretin et al.
2005/0094129 A1 5/2005 MacDougall
2005/0099618 A1 5/2005 DiFoggio et al.
2005/0115741 A1 6/2005 Terry et al.
2005/0121235 A1 6/2005 Larsen et al.
2005/0189146 A1 9/2005 Oglesby
2005/0201652 A1 9/2005 Ellwood, Jr.
2005/0230107 A1 10/2005 McDaniel et al.
2005/0252286 A1 11/2005 Ibrahim et al.
2005/0263281 A1 12/2005 Lovell et al.
2005/0263497 A1 12/2005 Lehane et al.
2005/0268704 A1 12/2005 Bissonnette et al.
2005/0269132 A1 12/2005 Batarseh et al.
2005/0272512 A1 12/2005 Bissonnette et al.
2005/0272513 A1 12/2005 Bissonnette et al.
2005/0272514 A1 12/2005 Bissonnette et al.
2005/0282645 A1 12/2005 Bissonnette et al.
2006/0038997 A1 2/2006 Julian et al.
2006/0049345 A1 3/2006 Rao et al.
2006/0065815 A1 3/2006 Jurca
2006/0070770 A1 4/2006 Marsh
2006/0102343 A1 5/2006 Skinner et al.
2006/0102607 A1 5/2006 Adams et al.
2006/0118303 A1 6/2006 Schultz et al.
2006/0137875 A1 6/2006 Dusterhoft et al.
2006/0169677 A1 8/2006 Deshi
2006/0185843 A1 8/2006 Smith, Jr.
2006/0191684 A1 8/2006 Smith, Jr.
2006/0204188 A1 9/2006 Clarkson et al.
2006/0207799 A1 9/2006 Yu
2006/0231257 A1 10/2006 Reed et al.
2006/0237233 A1 10/2006 Reed et al.
2006/0257150 A1 11/2006 Tsuchiya et al.
2006/0260832 A1 11/2006 McKay
2006/0266522 A1 11/2006 Eoff et al.
2006/0283592 A1 12/2006 Sierra et al.
2006/0289724 A1 12/2006 Skinner et al.
2007/0034409 A1 2/2007 Dale et al.
2007/0081157 A1 4/2007 Csutak et al.
2007/0125163 A1 6/2007 Dria et al.
2007/0181301 A1 * 8/2007 O'Brien ..... 166/247
2007/0193990 A1 8/2007 Richerzhagen et al.
2007/0217736 A1 9/2007 Zhang et al.
2007/0227741 A1 10/2007 Lovell et al.
2007/0242265 A1 10/2007 Vessereau et al.
2007/0247701 A1 10/2007 Akasaka et al.
2007/0267220 A1 11/2007 Magiawala et al.
2007/0278195 A1 12/2007 Richerzhagen et al.
2007/0280615 A1 12/2007 de Montmorillon et al.
2008/0023202 A1 1/2008 Keatch et al.
2008/0053702 A1 3/2008 Smith
2008/0073077 A1 3/2008 Tunc et al.
2008/0093125 A1 4/2008 Potter et al.
2008/0112760 A1 5/2008 Curlett
2008/0124816 A1 5/2008 Bruland et al.
2008/0128123 A1 6/2008 Gold
2008/0138022 A1 6/2008 Tassone
2008/0165356 A1 7/2008 DiFoggio et al.
2008/0166132 A1 7/2008 Lynde
2008/0180787 A1 7/2008 DiGiovanni et al.
2008/0245568 A1 10/2008 Jeffryes
2008/0273852 A1 11/2008 Parker et al.
2008/0314883 A1 12/2008 Juodkazis et al.
2009/0020333 A1 1/2009 Marsh
2009/0031870 A1 2/2009 O'Connor
2009/0033176 A1 2/2009 Huang et al.
2009/0045177 A1 2/2009 Koseki et al.
2009/0049345 A1 2/2009 Mock et al.
2009/0050371 A1 2/2009 Moeny
2009/0078467 A1 3/2009 Castillo
2009/0105955 A1 4/2009 Castillo et al.
2009/0126235 A1 5/2009 Kobayashi et al.
2009/0133871 A1 5/2009 Skinner et al.
2009/0133929 A1 5/2009 Rodland
2009/0139768 A1 6/2009 Castillo
2009/0166042 A1 7/2009 Skinner
2009/0190887 A1 7/2009 Freeland et al.
2009/0194292 A1 8/2009 Oglesby
2009/0205675 A1 8/2009 Sarkar et al.
2009/0260834 A1 10/2009 Henson et al.
2009/0266552 A1 10/2009 Barra et al.
2009/0266562 A1 10/2009 Greenaway
2009/0272424 A1 11/2009 Ortabasi

(56) References Cited

U.S. PATENT DOCUMENTS

| | | | | |
|---|---|---|---|---|
| 2009/0272547 | A1 | 11/2009 | Dale et al. | |
| 2009/0279835 | A1 | 11/2009 | de Montmorillon et al. | |
| 2009/0294050 | A1 | 12/2009 | Traggis et al. | |
| 2009/0308852 | A1 | 12/2009 | Alpay et al. | |
| 2009/0324183 | A1 | 12/2009 | Bringuier et al. | |
| 2010/0000790 | A1 | 1/2010 | Moeny | |
| 2010/0001179 | A1 | 1/2010 | Kobayashi et al. | |
| 2010/0008631 | A1 | 1/2010 | Herbst | |
| 2010/0013663 | A1 | 1/2010 | Cavender et al. | |
| 2010/0018703 | A1 | 1/2010 | Lovell et al. | |
| 2010/0025032 | A1 | 2/2010 | Smith et al. | |
| 2010/0032207 | A1 | 2/2010 | Potter et al. | |
| 2010/0044102 | A1 | 2/2010 | Rinzler et al. | |
| 2010/0044103 | A1 | 2/2010 | Moxley et al. | |
| 2010/0044104 | A1 | 2/2010 | Zediker et al. | |
| 2010/0044105 | A1 | 2/2010 | Faircloth et al. | |
| 2010/0044106 | A1 | 2/2010 | Zediker et al. | |
| 2010/0071794 | A1 | 3/2010 | Homan | |
| 2010/0078414 | A1 | 4/2010 | Perry et al. | |
| 2010/0084132 | A1 | 4/2010 | Noya et al. | |
| 2010/0089571 | A1 | 4/2010 | Revellat et al. | |
| 2010/0089574 | A1 | 4/2010 | Wideman et al. | |
| 2010/0089576 | A1 | 4/2010 | Wideman et al. | |
| 2010/0089577 | A1 | 4/2010 | Wideman et al. | |
| 2010/0155059 | A1 | 6/2010 | Ullah | |
| 2010/0170672 | A1 | 7/2010 | Schwoebel et al. | |
| 2010/0170680 | A1 | 7/2010 | McGregor et al. | |
| 2010/0187010 | A1 | 7/2010 | Abbasi et al. | |
| 2010/0197116 | A1 | 8/2010 | Shah et al. | |
| 2010/0197119 | A1 | 8/2010 | Shah et al. | |
| 2010/0215326 | A1 | 8/2010 | Zediker et al. | |
| 2010/0218993 | A1 | 9/2010 | Wideman et al. | |
| 2010/0224408 | A1 | 9/2010 | Kocis et al. | |
| 2010/0226135 | A1 | 9/2010 | Chen | |
| 2010/0236785 | A1 | 9/2010 | Collis et al. | |
| 2010/0301027 | A1 | 12/2010 | Sercel | |
| 2010/0326659 | A1 | 12/2010 | Schultz et al. | |
| 2010/0326665 | A1 | 12/2010 | Redlinger et al. | |
| 2011/0030957 | A1 | 2/2011 | Constantz et al. | |
| 2011/0035154 | A1 | 2/2011 | Kendall et al. | |
| 2011/0048743 | A1 | 3/2011 | Stafford et al. | |
| 2011/0061869 | A1* | 3/2011 | Abass et al. | 166/308.1 |
| 2011/0079437 | A1 | 4/2011 | Hopkins et al. | |
| 2011/0127028 | A1 | 6/2011 | Strickland | |
| 2011/0139450 | A1 | 6/2011 | Vasques et al. | |
| 2011/0147013 | A1 | 6/2011 | Kilgore | |
| 2011/0162854 | A1 | 7/2011 | Bailey et al. | |
| 2011/0168443 | A1 | 7/2011 | Smolka | |
| 2011/0174537 | A1 | 7/2011 | Potter et al. | |
| 2011/0186298 | A1 | 8/2011 | Clark et al. | |
| 2011/0198075 | A1 | 8/2011 | Okada et al. | |
| 2011/0205652 | A1 | 8/2011 | Abbasi et al. | |
| 2011/0220409 | A1 | 9/2011 | Foppe | |
| 2011/0240314 | A1 | 10/2011 | Greenaway | |
| 2011/0266062 | A1 | 11/2011 | Shuman, V et al. | |
| 2011/0278070 | A1 | 11/2011 | Hopkins et al. | |
| 2011/0290563 | A1 | 12/2011 | Kocis et al. | |
| 2011/0303460 | A1 | 12/2011 | Von Rohr et al. | |
| 2012/0000646 | A1 | 1/2012 | Liotta et al. | |
| 2012/0012392 | A1 | 1/2012 | Kumar | |
| 2012/0012393 | A1 | 1/2012 | Kumar | |
| 2012/0020631 | A1 | 1/2012 | Rinzler et al. | |
| 2012/0048550 | A1 | 3/2012 | Dusterhoft et al. | |
| 2012/0048568 | A1 | 3/2012 | Li et al. | |
| 2012/0061091 | A1 | 3/2012 | Radi | |
| 2012/0067643 | A1 | 3/2012 | DeWitt et al. | |
| 2012/0068086 | A1 | 3/2012 | DeWitt et al. | |
| 2012/0068523 | A1 | 3/2012 | Bowles | |
| 2012/0074110 | A1 | 3/2012 | Zediker et al. | |
| 2012/0103693 | A1 | 5/2012 | Jeffryes | |
| 2012/0111578 | A1 | 5/2012 | Tverlid | |
| 2012/0118568 | A1 | 5/2012 | Kleefisch et al. | |
| 2012/0118578 | A1 | 5/2012 | Skinner | |
| 2012/0217015 | A1 | 8/2012 | Zediker et al. | |
| 2012/0217017 | A1 | 8/2012 | Zediker et al. | |
| 2012/0217018 | A1 | 8/2012 | Zediker et al. | |
| 2012/0217019 | A1 | 8/2012 | Zediker et al. | |
| 2012/0239013 | A1 | 9/2012 | Islam | |
| 2012/0248078 | A1 | 10/2012 | Zediker et al. | |
| 2012/0255774 | A1 | 10/2012 | Grubb et al. | |
| 2012/0255933 | A1 | 10/2012 | McKay et al. | |
| 2012/0261188 | A1 | 10/2012 | Zediker et al. | |
| 2012/0266803 | A1 | 10/2012 | Zediker et al. | |
| 2012/0267168 | A1 | 10/2012 | Grubb et al. | |
| 2012/0273269 | A1 | 11/2012 | Rinzler et al. | |
| 2012/0273470 | A1 | 11/2012 | Zediker et al. | |
| 2012/0275159 | A1 | 11/2012 | Fraze et al. | |
| 2013/0011102 | A1 | 1/2013 | Rinzler et al. | |
| 2013/0175090 | A1 | 7/2013 | Zediker | |
| 2013/0192893 | A1 | 8/2013 | Zediker | |
| 2013/0192894 | A1 | 8/2013 | Zediker | |
| 2013/0213637 | A1* | 8/2013 | Kearl | 166/248 |
| 2013/0220626 | A1 | 8/2013 | Zediker | |
| 2013/0228557 | A1 | 9/2013 | Zediker | |
| 2013/0266031 | A1 | 10/2013 | Norton | |
| 2013/0319984 | A1 | 12/2013 | Linyaev | |
| 2014/0000902 | A1 | 1/2014 | Wolfe | |
| 2014/0060802 | A1 | 3/2014 | Zediker | |
| 2014/0060930 | A1 | 3/2014 | Zediker | |
| 2014/0069896 | A1 | 3/2014 | Deutch | |
| 2014/0090846 | A1 | 4/2014 | Deutch | |
| 2014/0190949 | A1 | 7/2014 | Zediker | |
| 2014/0231085 | A1 | 8/2014 | Zediker | |
| 2014/0231398 | A1 | 8/2014 | Land | |
| 2014/0248025 | A1 | 9/2014 | Rinzler | |
| 2014/0345872 | A1 | 11/2014 | Zediker | |

FOREIGN PATENT DOCUMENTS

| | | | |
|---|---|---|---|
| EP | 0 565 287 | A1 | 10/1993 |
| EP | 0 950 170 | B1 | 9/2002 |
| FR | 2 716 924 | A1 | 9/1995 |
| GB | 1 284 454 | | 8/1972 |
| GB | 2420358 | B | 5/2006 |
| JP | 09072738 | A | 3/1997 |
| JP | 09-242453 | A | 9/1997 |
| JP | 2000-334590 | A | 12/2000 |
| JP | 2004-108132 | A | 4/2004 |
| JP | 2006-307481 | A | 11/2006 |
| JP | 2007-120048 | A | 5/2007 |
| WO | WO 95/32834 | A1 | 12/1995 |
| WO | WO 97/49893 | A1 | 12/1997 |
| WO | WO 98/50673 | A1 | 11/1998 |
| WO | WO 98/56534 | A1 | 12/1998 |
| WO | WO 02/057805 | A2 | 7/2002 |
| WO | WO 2003/027433 | A1 | 4/2003 |
| WO | WO 2003/060286 | A1 | 7/2003 |
| WO | WO 2004/009958 | A1 | 1/2004 |
| WO | WO 2004/094786 | A1 | 11/2004 |
| WO | WO 2005/001232 | A2 | 1/2005 |
| WO | WO 2005/001239 | A1 | 1/2005 |
| WO | WO 2006/008155 | A1 | 1/2006 |
| WO | WO 2006/041565 | A1 | 4/2006 |
| WO | WO 2006/054079 | A1 | 5/2006 |
| WO | WO 2007/002064 | A1 | 1/2007 |
| WO | WO 2007/112387 | A2 | 10/2007 |
| WO | WO 2007/136485 | A2 | 11/2007 |
| WO | WO 2008/016852 | A1 | 2/2008 |
| WO | WO 2008/070509 | A2 | 6/2008 |
| WO | WO 2008/085675 | A1 | 7/2008 |
| WO | WO 2009/042774 | A2 | 4/2009 |
| WO | WO 2009/042781 | A2 | 4/2009 |
| WO | WO 2009/042785 | A2 | 4/2009 |
| WO | WO 2009/131584 | A1 | 10/2009 |
| WO | WO 2010/036318 | A1 | 4/2010 |
| WO | WO 2010/060177 | A1 | 6/2010 |
| WO | WO 2010/087944 | A1 | 8/2010 |
| WO | WO 2011/008544 | A2 | 1/2011 |
| WO | WO 2011/032083 | A1 | 3/2011 |
| WO | WO 2011/041390 | A2 | 4/2011 |
| WO | WO 2011/075247 | A2 | 6/2011 |
| WO | WO 2011/106078 | A2 | 9/2011 |
| WO | WO 2012/003146 | A2 | 1/2012 |
| WO | WO 2012/012006 | A1 | 1/2012 |

(56) References Cited

FOREIGN PATENT DOCUMENTS

| | | | |
|---|---|---|---|
| WO | WO 2012/027699 | A1 | 3/2012 |
| WO | WO 2012/064356 | A1 | 5/2012 |
| WO | WO 2012/116189 | A2 | 8/2012 |

OTHER PUBLICATIONS

U.S. Appl. No. 12/543,986, filed Aug. 19, 2009, Moxley et al.
U.S. Appl. No. 12/544,094, filed Aug. 19, 2009, Faircloth et al.
U.S. Appl. No. 12/543,968, filed Aug. 19, 2009, Rinzler et al.
U.S. Appl. No. 12/544,136, filed Aug. 19, 2009, Zediker et al.
U.S. Appl. No. 12/544,038, filed Aug. 19, 2009, Zediker et al.
U.S. Appl. No. 12/706,576, filed Feb. 16, 2010, Zediker et al.
U.S. Appl. No. 12/840,978, filed Jul. 21, 2010, Rinzler et al.
U.S. Appl. No. 12/896,021, filed Oct. 1, 2010, Underwood et al.
U.S. Appl. No. 13/034,017, filed Feb. 24, 2011, Zediker et al.
U.S. Appl. No. 13/034,037, filed Feb. 24, 2011, Zediker et al.
U.S. Appl. No. 13/034,175, filed Feb. 24, 2011, Zediker et al.
U.S. Appl. No. 13/034,183, filed Feb. 24, 2011, Zediker et al.
U.S. Appl. No. 13/210,581, filed Aug. 16, 2011, DeWitt et al.
U.S. Appl. No. 13/211,729, filed Aug. 17, 2011, DeWitt et al.
U.S. Appl. No. 13/222,931, filed Aug. 31, 2011, Zediker et al.
U.S. Appl. No. 13/347,445, filed Jan. 10, 2012, Zediker et al.
U.S. Appl. No. 13/403,509, filed Feb. 23, 2012, Fraze et al.
U.S. Appl. No. 13/403,287, filed Feb. 23, 2012, Grubb et al.
U.S. Appl. No. 13/403,615, filed Feb. 23, 2012, Grubb et al.
U.S. Appl. No. 13/366,882, filed Feb. 6, 2012, McKay et al.
U.S. Appl. No. 13/403,692, filed Feb. 23, 2012, Zediker et al.
U.S. Appl. No. 13/403,723, filed Feb. 23, 2012, Rinzler et al.
U.S. Appl. No. 13/403,741, filed Feb. 23, 2012, Zediker et al.
U.S. Appl. No. 13/486,795, filed Feb. 23, 2012, Rinzler et al.
U.S. Appl. No. 13/565,345, filed Feb. 23, 2012, Zediker et al.
U.S. Appl. No. 13/768,149, filed Feb. 15, 2013, Zediker et al.
U.S. Appl. No. 13/777,650, filed Feb. 26, 2013, Zediker et al.
U.S. Appl. No. 13/403,132, filed Feb. 23, 2012, Zediker et al.
U.S. Appl. No. 13/782,942, filed Mar. 1, 2013, Norton et al.
U.S. Appl. No. 13/800,559, filed Mar. 13, 2013, Zediker et al.
U.S. Appl. No. 13/800,820, filed Mar. 13, 2013, Zediker et al.
U.S. Appl. No. 13/800,879, filed Mar. 13, 2013, Zediker et al.
U.S. Appl. No. 13/800,933, filed Mar. 13, 2013, Zediker et al.
U.S. Appl. No. 13/849,831, filed Mar. 25, 2013, Zediker et al.
International Search Report and Written Opinion for PCT App. No. PCT/US10/24368, dated Nov. 2, 2010, 16 pgs.
International Search Report for PCT Application No. PCT/US09/54295, dated Apr. 26, 2010, 16 pgs.
International Search Report for PCT Application No. PCT/US2011/044548, dated Jan. 24, 2012, 17 pgs.
International Search Report for PCT Application No. PCT/US2011/047902, dated Jan. 17, 2012, 9 pgs.
International Search Report for PCT Application No. PCT/US2011/050044 dated Feb. 1, 2012, 26 pgs.
International Search Report for PCT Application No. PCT/US2012/026277, dated May 30, 2012, 11 pgs.
International Search Report for PCT Application No. PCT/US2012/026265, dated May 30, 2012, 14 pgs.
International Search Report for PCT Application No. PCT/US2012/026280, dated May 30, 2012, 12 pgs.
International Search Report for PCT Application No. PCT/US2012/026337, dated Jun. 7, 2012, 21 pgs.
International Search Report for PCT Application No. PCT/US2012/026471, dated May 30, 2012, 13 pgs.
International Search Report for PCT Application No. PCT/US2012/026525, dated May 31, 2012, 8 pgs.
International Search Report for PCT Application No. PCT/US2012/026526, dated May 31, 2012, 10 pgs.
International Search Report for PCT Application No. PCT/US2012/026494, dated May 31, 2012, 12 pgs.
International Search Report for PCT Application No. PCT/US2012/020789, dated Jun. 29, 2012, 9 pgs.
International Search Report for PCT Application No. PCT/US2012/040490, dated Oct. 22, 2012, 14 pgs.
International Search Report for PCT Application No. PCT/US2012/049338, dated Jan. 22, 2013, 14 pgs.
Abdulagatova, Z. et al., "Effect of Temperature and Pressure on the Thermal Conductivity of Sandstone", *International Journal of Rock Mechanics & Mining Sciences*, vol. 46, 2009, pp. 1055-1071.
Abousleiman, Y. et al., "Poroelastic Solution of an Inclined Borehole in a Transversely Isotropic Medium", *Rock Mechanics*, Daemen & Schultz (eds), 1995, pp. 313-318.
Ackay, H. et al., Paper titled "Orthonormal Basis Functions for Continuous-Time Systems and Lp Convergence", date unknown but prior to Aug. 19, 2009, pp. 1-12.
Acosta, A. et al., Paper from X Brazilian MRS meeting titled "Drilling Granite With Laser Light", X Encontro da SBPMat Granado-RS, Sep. 2011, 4 pages including pp. 56 and 59.
Agrawal Dinesh et al., "Microstructural by TEM of WC/Co composites Prepared by Conventional and Microwave Processes", Materials Research Lab, The Pennsylvania State University, *15th International Plansee Seminar*, vol. 2 2001, pp. 677-684.
Agrawal Dinesh et al., Report on "Development of Advanced Drill Components for BHA Using Mircowave Technology Incorporating Carbide Diamond Composites and Functionally Graded Materials", Microwave Processing and Engineering Center, Material Research Institute, The Pennsylvania State University, 2003, 10 pgs.
Agrawal Dinesh et al., Report on "Graded Steele-Tungsten Cardide/Cobalt-Diamond Systems Using Microwave Heating", Material Research Institute, Penn State University, *Proceedings of the 2002 International Conference on Functionally Graded Materials*, 2002, pp. 50-58.
Agrawal, Govind P., "Nonlinear Fiber Optics", Chap. 9, Fourth Edition, Academic Press copyright 2007, pp. 334-337.
Ahmadi, M. et al., "The Effect of Interaction Time and Saturation of Rock on Specific Energy in ND:YAG Laser Perforating", *Optics and Laser Technology*, vol. 43, 2011, pp. 226-231.
Ai, H.A. et al., "Simulation of dynamic response of granite: A numerical approach of shock-induced damage beneath impact craters", *International Journal of Impact Engineering*, vol. 33, 2006, pp. 1-10.
Akhatov, I. et al., "Collapse and Rebound of a Laser-Induced Cavitation Bubble", *Physics of Fluids*, vol. 13, No. 10, Oct. 2001, pp. 2805-2819.
Albertson, M. L. et al., "Diffusion of Submerged Jets", a paper for the *American Society of Civil Engineers*, Nov. 5, 1852, pp. 1571-1596.
Al-Harthi, A. A. et al., "The Porosity and Engineering Properties of Vesicular Basalt in Saudi Arabia", *Engineering Geology*, vol. 54, 1999, pp. 313-320.
Anand, U. et al., "Prevention of Nozzle Wear in Abrasive Water Suspension Jets (AWSJ) Using PoroLubricated Nozzles", *Transactions of the ASME*, vol. 125, Jan. 2003, pp. 168-181.
Andersson, J. C. et al., "The Aspo Pillar Stability Experiment: Part II—Rock Mass Response to Coupled Excavation-Induced and Thermal-Induced Stresses", *International Journal of Rock Mechanics & Mining Sciences*, vol. 46, 2009, pp. 879-895.
Anovitz, L. M. et al., "A New Approach to Quantification of Metamorphism Using Ultra-Small and Small Angle Neutron Scattering", *Geochimica et Cosmochimica Acta*, vol. 73, 2009, pp. 7303-7324.
Anton, Richard J. et al., "Dynamic Vickers indentation of brittle materials", *Wear*, vol. 239, 2000, pp. 27-35.
Antonucci, V. et al., "Numerical and Experimental Study of a Concentrated Indentation Force on Polymer Matrix Composites", an excerpt from the *Proceedings of the COMSOL Conference*, 2009, 4 pages.
Aptukov, V. N., "Two Stages of Spallation", publisher unknown, while the date of the publication is unknown, it is believed to be prior to Aug. 19, 2009, 6 pages.
Ashby, M. F. et al., "The Failure of Brittle Solids Containing Small Cracks Under Compressive Stress States", *Acta Metall.*, vol. 34, No. 3,1986, pp. 497-510.

(56) References Cited

OTHER PUBLICATIONS

ASTM International, "Standard Test Method for Thermal Conductivity of Solids by Means of the Guarded-Comparative-Longitudinal Heat Flow Technique", Standard under the fixed Designation E1225-09, 2009, pp. 1-9.
Atkinson, B. K., "Introduction to Fracture Mechanics and Its Geophysical Applications", *Fracture Mechanics of Rock*, 1987, pp. 1-26.
Aubertin, M. et al., "A Multiaxial Stress Criterion for Short- and Long-Term Strength of Isotropic Rock Media", *International Journal of Rock Mechanics & Mining Sciences*, vol. 37, 2000, pp. 1169-1193.
Author unknown, by RIO Technical Services, "Sub-Task 1: Current Capabilities of Hydraulic Motors, Air/Nitrogen Motors, and Electric Downhole Motors", a final report for Department of Energy National Petroleum Technology Office for the Contract Task 03NT30429, Jan. 30, 2004, 26 pages.
Aver, B. B. et al., "Porosity Dependence of the Elastic Modulof Lithophysae-rich Tuff: Numerical and Experimental Investigations", *International Journal of Rock Mechanics & Mining Sciences*, vol. 40, 2003, pp. 919-928.
Aydin, A. et al., "The Schmidt hammer in rock material characterization", *Engineering Geology*, vol. 81, 2005, pp. 1-14.
Backers, T. et al., "Tensile Fracture Propagation and Acoustic Emission Activity in Sandstone: The Effect of Loading Rate", *International Journal of Rock Mechanics & Mining Sciences*, vol. 42, 2005, pp. 1094-1101.
Baek, S. Y. et al., "Simulation of the Coupled Thermal/Optical Effects for Liquid Immersion Micro-/Nanolithography", source unknown, believed to be publically available prior to 2012, 13 pages.
Baflon, Jean-Paul et al., "On the Relationship Between the Parameters of Paris' Law for Fatigue Crack Growth in Aluminium Alloys", *Scripta Metallurgica*, vol. 11, No. 12, 1977, pp. 1101-1106.
Bagatur, T. et al., "Air-entrainment Characteristics in a Plunging Water Jet System Using Rectangular Nozzles with Rounded Ends", *Water SA*, vol. 29, No. 1, Jan. 2003, pp. 35-38.
Bailo, El Tahir et al., "Spectral signatures and optic coefficients of surface and reservoir shales and limestones at COIL, $CO_2$ and Nd:YAG laser wavelengths", *Petroleum Engineering Department, Colorado School of Mines*, 2004, 13 pgs.
Baird, J. A. "GEODYN: A Geological Formation/Drillstring Dynamics Computer Program", *Society of Petroleum Engineers of AIME*, 1964, 9 pgs.
Baird, J. A. et al., "Analyzing the Dynamic Behavior of Downhole Equipment During Drilling", government Sandia Report, SAND-84-0758C, DE84 008840, 7 pages.
Baird, Jerold et al., Phase 1 Theoretical Description, a Geological Formation Drill String Dynamic Interaction Finite Element Program (GEODYN), *Sandia National Laboratories*, Report No. Sand-84-7101, 1984, 196 pgs.
Batarseh, S. I. et al, "Innovation in Wellbore Perforation Using High-Power Laser", *International Petroleum Technology Conference*, IPTC No. 10981, Nov. 2005, 7 pages.
Batarseh, S. et al. "Well Perforation Using High-Power Lasers", *Society of Petroleum Engineers*, SPE 84418, 2003, pp. 1-10.
Batarseh, S. et al., "Well Perforation Using High-Power Lasers", a paper prepared for presentation at the SPE (Society of Petroleum Engineers) Annual Technical Conference and Exhibition, SPE No. 84418, Oct. 2003, 10 pages.
Baykasoglu, A. et al., "Prediction of Compressive and Tensile Strength of Limestone via Genetic Programming", *Expert Systems with Applications*, vol. 35, 2008, pp. 111-123.
Bdm Corporation, Geothermal Completion Technology Life-Cycle Cost Model (GEOCOM), *Sandia National Laboratories*, for the U.S. Dept. of Energy, vols. 1 and 2, 1982, 222 pgs.
Bechtel SAIC Company LLC, "Heat Capacity Analysis", a report prepared for Department of Energy, Nov. 2004, 100 pages.
Belushi, F. et al., "Demonstration of the Power of Inter-Disciplinary Integration to Beat Field Development Challenges in Complex Brown Field-South Oman", *Society of Petroleum Engineers*, a paper prepared for presentation at the Abu Dhabi International Petroleum Exhibition & Conference, SPE No. 137154, Nov. 2010, 18 pages.
Belyaev, V. V., "Spall Damage Modelling and Dynamic Fracture Specificities of Ceramics", *Journal of Materials Processing Technology*, vol. 32, 1992, pp. 135-144.
Benavente, D. et al., "The Combined Influence of Mineralogical, Hygric and Thermal Properties on the Durability of PoroBuilding Stones", *Eur. J. Mineral*, vol. 20, Aug. 2008, pp. 673-685.
Beste, U. et al., "Micro-scratch evaluation of rock types—a means to comprehend rock drill wear", *Tribology International*, vol. 37, 2004, pp. 203-210.
Bieniawski, Z. T., "Mechanism of Brittle Fracture of Rock: Part I—Theory of the Fracture Process", *Int. J. Rock Mech. Min. Sci.*, vol. 4, 1967, pp. 395-406.
Bilotsky, Y. et al., "Modelling Multilayers Systems with Time-Depended Heaviside and New Transition Functions", excerpt from the Proceedings of the 2006 Nordic COMSOL Conference, 2006, 4 pages.
Birkholzer, J. T. et al., "The Impact of Fracture—Matrix Interaction on Thermal—Hydrological Conditions in Heated Fractured Rock", an origial research paper published online http://vzy.scijournals.org/cgi/content/full/5/2/657, May 26, 2006, 27 pages.
Blackwell, B. F., "Temperature Profile in Semi-infinite Body With Exponential Source and Convective Boundary Condition", *Journal of Heat Transfer, Transactions of the ASME*, vol. 112, 1990, pp. 567-571.
Blackwell, D. D. et al., "Geothermal Resources in Sedimentary Basins", a presentation for the Geothermal Energy Generation in Oil and Gas Settings, Mar. 13, 2006, 28 pages.
Blair, S. C. et al., "Analysis of Compressive Fracture in Rock Using Statistical Techniques: Part I. A Non-linear Rule-based Model", *Int. J. Rock Mech. Min. Sci.*, vol. 35 No. 7, 1998, pp. 837-848.
Blomqvist, M. et al., "All-in-Quartz Optics for Low Focal Shifts", *SPIE Photonics West Conference in San Francisco*, Jan. 2011, 12 pages.
Boechat, A. A. P. et al., "Bend Loss in Large Core Multimode Optical Fiber Beam Delivery Systems", *Applied Optics.*, vol. 30 No. 3, Jan. 20, 1991, pp. 321-327.
Bolme, C. A., "Ultrafast Dynamic Ellipsometry of Laser Driven Shock Waves", a dissertation for the degree of Doctor of Philosophy in Physical Chemistry at Massachusetts Institute of Technology, Sep. 2008, pp. 1-229.
Britz, Dieter, "Digital Simulation in Electrochemistry", *Lect. Notes Phys.*, vol. 666, 2005, pp. 103-117.
Brown, G., "Development, Testing and Track Record of Fiber-Optic, Wet-Mate, Connectors", *IEEE*, 2003, pp. 83-88.
Browning, J. A. et al., "Recent Advances in Flame Jet Working of Minerals", *7th Symposium on Rock Mechanics*, Pennsylvania State Univ., 1965, pp. 281-313.
Brujan, E. A. et al., "Dynamics of Laser-Induced Cavitation Bubbles Near an Elastic Boundar", *J. Fluid Mech.*, vol. 433, 2001, pp. 251-281.
Burdine, N. T., "Rock Failure Under Dynamic Loading Conditions", Society of Petroleum Engineers Journal, Mar. 1963, pp. 1-8.
Bybee, K., "Modeling Laser-Spallation Rock Drilling", *JPT*, an SPE available at www.spe.org/jpt, Feb. 2006, 2 pp. 62-63.
Bybee, Karen, highlight of "Drilling a Hole in Granite Submerged in Water by Use of CO2 Laser", an SPE available at www.spe.org/jpt, *JPT*, Feb 2010, pp. 48, 50 and 51.
Cai, W. et al., "Strength of Glass from Hertzian Line Contact", *Optomechanics 2011: Innovations and Solutions*, 2011, 5 pages.
Capetta, I. S. et al., "Fatigue Damage Evaluation on Mechanical Components Under Multiaxial Loadings", European Comsol Conference, University of Ferrara, Oct. 16, 2009, 25 pages.
Cardenas, R., "Protected Polycrystalline Diamond Compact Bits for Hard Rock Drilling", Report No. DOE-99049-1381, *U.S. Department of Energy*, 2000, pp. 1-79.
Carstens, J. P. et al., "Rock Cutting by Laser", a paper of *Society of Petroleum Engineers of AIME*, 1971, 11 pages.

(56) References Cited

OTHER PUBLICATIONS

Carstens, Jeffrey et al., "Heat-Assisted Tunnel Boring Machines", *Federal Railroad Administration and Urban Mass Transportation Administration*, U.S. Dept. of Transportation, Report No. FRA-RT-71-63, 1970, 340 pgs.
Caruso, C. et al., "Dynamic Crack Propagation in Fiber Reinforced Composites", Excerpt from the Proceedings of the COMSOL Conference, 2009, 5 pages.
Chastain, T. et al., "Deepwater Drilling Riser System", *SPE Drilling Engineering*, Aug. 1986, pp. 325-328.
Chen, H. Y. et al., "Characterization of the Austin Chalk Producing Trend", *SPE*, a paper prepared for presentation at the 61st Annual Technical Conference and Exhibition of the Society of Petroleum Engineers, SPE No. 15533, Oct. 1986, pp. 1-12.
Chen, K., paper titled "Analysis of Oil Film Interferometry Implementation in Non-Ideal Conditions", source unknown, Jan. 7, 2010, pp. 1-18.
Chraplyvy, A. R., "Limitations on Lightwave Communications Imposed by Optical-Fiber Nonlinearities", *Journal of Lightwave Technology*, vol. 8 No. 10, Oct. 1990, pp. 1548-1557.
Churcher, P. L. et al., "Rock Properties of Berea Sandstone, Baker Dolomite, and Indiana Limestone", a paper prepared for presentation at the SPE International Symposium on Oilfield Chemistry), *SPE*, SPE No. 21044, Feb. 1991, pp. 431-446 and 3 additional pages.
Cimetiere, A. et al., "A Damage Model for Concrete Beams in Compression", *Mechanics Research Communications*, vol. 34, 2007, pp. 91-96.
Clegg, John et al., "Improved Optimisation of Bit Selection Using Mathematically Modelled Bit-Performance Indices", *IADC/SPE International* 102287, 2006, pp. 1-10.
Close, F. et al., "Successful Drilling of Basalt in a West of Shetland Deepwater Discovery", a paper prepared for presentation at Offshore Europe 2005 by SPE (Society of Petroleum Engineers) Program Committee, SPE No. 96575, Sep. 2005, pp. 1-10.
Close, F. et al., "Successful Drilling of Basalt in a West of Shetland Deepwater Discovery", *SPE International* 96575, Society of Petroleum Engineers, 2006, pp. 1-10.
Cobern, Martin E., "Downhole Vibration Monitoring & Control System Quarterly Technical Report #1", *APS Technology, Inc.*, Quarterly Technical Report #1, DVMCS, 2003, pp. 1-15.
Cogotsi, G. A. et al., "Use of Nondestructive Testing Methods in Evaluation of Thermal Damage for Ceramics Under Conditions of Nonstationary Thermal Effects", *Institute of Strength Problems, Academy of Sciences of the Ukrainian SSR*, 1985, pp. 52-56.
Cohen, J. H., "High-Power Slim-Hole Drilling System", a paper presented at the conference entitled Natural Gas RD&D Contractors Review Meeting, Office of Scientific and Technical Information, Apr. 1995, 10 pages.
Cone, C., "Case History of the University Block 9 (Wolfcamp) Field—Gas-Water Injection Secondary Recovery Project", *Journal of Petroleum Technology*, Dec. 1970, pp. 1485-1491.
Contreras, E. et al., "Effects of Temperature and Stress on the Compressibilities, Thermal Expansivities, and Porosities of Cerro Prieto and Berea Sandstones to 9000 PSI and 208 degrees Celsius", Proceedings Eighth Workshop Geothermal Reservoir Engineering, Leland Stanford Junior University, Dec. 1982, pp. 197-203.
Cook, Troy, "Chapter 23, Calculation of Estimated Ultimate Recovery (EUR) for Wells in Continuous-Type Oil and Gas Accumulations", *U.S. Geological Survey Digital Data Series DDS-69-D*, Denver, Colorado: Version 1, 2005, pp. 1-9.
Cooper, R., "Coiled Tubing Deployed ESPs Utilizing Internally Installed Power Cable—A Project Update", a paper prepared by SPE (Society of Petroleum Engineers) Program Committee for presentation at the 2nd North American Coiled Tubing Roundtable, SPE 38406, Apr. 1997, pp. 1-6.
Coray, P. S. et al., "Measurements on 5:1 Scale Abrasive Water Jet Cutting Head Models", source unknown, available prior to 2012, 15 pages.
Cruden, D. M., "The Static Fatigue of Brittle Rock Under Uniaxial Compression", *Int. J. Rock Mech. Min. Sci. & Geomech. Abstr.*, vol. 11, 1974, pp. 67-73.
da Silva, B. M. G., "Modeling of Crack Initiation, Propagation and Coalescence in Rocks", a thesis for the degree of Master of Science in Civil and Environmental Engineering at the Massachusetts Institute of Technology, Sep. 2009, pp. 1-356.
Dahl, F. et al., "Development of a New Direct Test Method for Estimating Cutter Life, Based on the Sievers' J Miniature Drill Test", *Tunnelling and Underground Space Technology*, vol. 22, 2007, pp. 106-116.
Dahl, Filip et al., "Development of a new direct test method for estimating cutter life, based on the Sievers J miniature drill test", *Tunnelling and Underground Space Technology*, vol. 22, 2007, pp. 106-116.
Damzen, M. J. et al., "Stimulated Brillion Scattering", Chapter 8—SBS in Optical Fibres, OP Publishing Ltd, Published by Institute of Physics, London, England, 2003, pp. 137-153.
Das, A. C. et al., "Acousto-ultrasonic study of thermal shock damage in castable refractory", *Journal of Materials Science Letters*, vol. 10, 1991, pp. 173-175.
de Castro Lima, J. J. et al., "Linear Thermal Expansion of Granitic Rocks: Influence of Apparent Porosity, Grain Size and Quartz Content", *Bull Eng Geol Env.*, 2004, vol. 63, pp. 215-220.
De Guire, Mark R., "Thermal Expansion Coefficient (start)", *EMSE 201—Introduction to Materials Science & Engineering*, 2003, pp. 15.1-15.15.
Degallaix, J. et al., "Simulation of Bulk-Absorption Thermal Lensing in Transmissive Optics of Gravitational Waves Detector", *Appl. Phys.*, B77, 2003, pp. 409-414.
Dey, T. N. et al., "Some Mechanisms of Microcrack Growth and Interaction in Compressive Rock Failure", *Int. J. Rock Mech. Min. Sci. & Geomech. Abstr.*, vol. 18, 1981, pp. 199-209.
Diamond-Cutter Drill Bits, by Geothermal Energy Program, Office of Geothermal and Wind Technologies, 2000, 2 pgs.
Dimotakis, P. E. et al., "Flow Structure and Optical Beam Propagation in High-Reynolds-Number Gas-Phase Shear Layers and Jets", *J. Fluid Mech.*, vol. 433, 2001, pp. 105-134.
Din Dinçer, er, Ismail et al., "Correlation between Schmidt hardness, uniaxial compressive strength and Young's modulfor andesites, basalts and tuffs", *Bull Eng Geol Env*, vol. 63, 2004, pp. 141-148.
Dole, L. et al., "Cost-Effective CementitioMaterial Compatible with Yucca Mountain Repository Geochemistry", a paper prepared by Oak Ridge National Laboratory for the Department of Energy, No. ORNL/TM-2004/296, Dec. 2004, 128 pages.
Dumans, C. F. F. et al., "PDC Bit Selection Method Through the Analysis of Past Bit Performances", a paper prepared for presentation at the *SPE* (Society of Petroleum Engineers—Latin American Petroleum Engineering Conference), Oct. 1990, pp. 1-6.
Dunn, James C., "Geothermal Technology Development at Sandia", *Geothermal Research Division, Sandia National Laboratories*, 1987, pp. 1-6.
Dutton, S. P. et al., "Evolution of Porosity and Permeability in the Lower CretaceoTravis Peak Formation, East Texas", *The American Association of Petroleum Geologists Bulletin*, vol. 76, No. 2, Feb. 1992, pp. 252-269.
Dyskin, A. V. et al., "Asymptotic Analysis of Crack Interaction with Free Boundary", *International Journal of Solids and Structure*, vol. 37, 2000, pp. 857-886.
Eckel, J. R. et al., "Nozzle Design and its Effect on Drilling Rate and Pump Operation", a paper presented at the spring meeting of the Southwestern District, Division of Production, Beaumont, Texas, Mar. 1951, pp. 28-46.
Ehrenberg, S. N. et al., "Porosity-Permeability Relationship in Interlayered Limestone-Dolostone Reservoir", *The American Association of Petroleum Geologists Bulletin*, vol. 90, No. 1, Jan. 2006, pp. 91-114.
Eichler, H.J. et al., "Stimulated Brillouin Scattering in Multimode Fibers for Optical Phase Conjugation", *Optics Communications*, vol. 208, 2002, pp. 427-431.

(56) References Cited

OTHER PUBLICATIONS

Eighmy, T. T. et al., "Microfracture Surface Charaterizations: Implications for In Situ Remedial Methods in Fractured Rock", *Bedrock Bioremediation Center, Final Report, National Risk Management Research Laboratory, Office of Research and Development, U.S. Environmental Protection Agency*, EPA/600/R-05/121, 2006, pp. 1-99.
Elsayed, M.A. et al., "Measurement and analysis of Chatter in a Compliant Model of a Drillstring Equipped With a PDC Bit", *Mechanical Engineering Dept., University of Southwestern Louisiana and Sandia National Laboratories*, 2000, pp. 1-10.
Ersoy, A., "Wear Characteristics of PDC Pin and Hybrid Core Bits in Rock Drilling", *Wear*, vol. 188, 1995, pp. 150-165.
Extreme Coil Drilling, by Extreme Drilling Corporation, 2009, 10 pgs.
Falcao, J. L. et al., "PDC Bit Selection Through Cost Prediction Estimates Using Crossplots and Sonic Log Data", *SPE*, a paper prepared for presentation at the 1993 SPE/IADC Drilling Conference, Feb. 1993, pp. 525-535.
Falconer, I. G. et al., "Separating Bit and Lithology Effects from Drilling Mechanics Data", *SPE*, a paper prepared for presentation at the 1988 IADC/SPE Drilling Conference, Feb./Mar. 1988, pp. 123-136.
Farra, G., "Experimental Observations of Rock Failure Due to Laser Radiation", a thesis for the degree of Master of Science at Massachusetts Institute of Technology, Jan. 1969, 128 pages.
Farrow, R. L. et al., "Peak-Power Limits on Fiber Amplifiers Imposed by Self-Focusing", *Optics Letters*, vol. 31, No. 23, Dec. 1, 2006, pp. 3423-3425.
Ferro, D. et al., "Vickers and Knoop hardness of electron beam deposited ZrC and HfC thin films on titanium", *Surface & Coatings Technology*, vol. 200, 2006, pp. 4701-4707.
Fertl, W. H. et al., "Spectral Gamma-Ray Logging in the Texas Austin Chalk Trend", *SPE of AIME*, a paper for Journal of Petroleum Technology, Mar. 1980, pp. 481-488.
Field, F. A., "A Simple Crack-Extension Criterion for Time-Dependent Spallation", *J. Mech. Phys. Solids*, vol. 19, 1971, pp. 61-70.
Figueroa, H. et al., "Rock removal using high power lasers for petroleum exploitation purposes", *Gas Technology Institute, Colorado School of Mines, Halliburton Energy Services*, Argonne National Laboratory, 2002, pp. 1-13.
Finger, J. T. et al., "PDC Bit Research at Sandia National Laboratories", Sandia Report No. SAND89-0079-UC-253, a report prepared for Department of Energy, Jun. 1989, 88 pages.
Finger, John T. et al., "PDC Bit Research at Sandia National Laboratories", Sandia Report, Geothermal Research Division 6252, *Sandia National Laboratories*, SAND89-0079-UC-253, 1989, pp. 1-88.
Freeman, T. T. et al., "THM Modeling for Reservoir Geomechanical Applications", presented at the COMSOL Conference, Oct. 2008, 22 pages.
Friant, J. E. et al., "Disc Cutter Technology Applied to Drill Bits", a paper prepared by Exacavation Engineering Associates, Inc. for the Department of Energy's Natural Gas Conference, Mar. 1997, pp. 1-16.
Fuerschbach, P. W. et al., "Understanding Metal Vaporization from Laser Welding", Sandia Report No. SAND-2003-3490, a report prepared for DOE, Sep. 2003, pp. 1-70.
Gahan, B. C. et al., "Analysis of Efficient High-Power Fiber Lasers for Well Perforation", *SPE*, No. 90661, a paper prepared for presentation at the SPE Annual Technical Conference and Exhibition, Sep. 2004, 9 pages.
Gahan, B. C. et al., "Effect of Downhole Pressure Conditions on High-Power Laser Perforation", *SPE*, No. 97093, a paper prepared for the 2005 SPE (Society of Petroleum Engineers) Annual Technical Conference and Exhibition, Oct. 12, 2005, 7 pages.
Gahan, B. C. et al., "Laser Drilling: Drilling with the Power of Light, Phase 1: Feasibility Study", a Topical Report by the *Gas Technology Institute*, for the Government under Cooperative Agreement No. DE-FC26-00NT40917, Sep. 30, 2001, 107 pages.
Gahan, B. C. et al., "Laser Drilling: Determination of Energy Required to Remove Rock", *Society of Petroleum Engineers* International, SPE 71466, 2001, pp. 1-11.
Gahan, B. C., et al., "Laser Drilling—Drilling with the Power of Light: High Energy Laser Perforation and Completion Techniques", Annual Technical Progress Report by the *Gas Technology Institute*, to the Department of Energy, Nov. 2006, 94 pages.
Gahan, Brian C. et al. "Analysis of Efficient High-Power Fiber Lasers for Well Perforation", *Society of Petroleum Engineers*, SPE 90661, 2004, pp. 1-9.
Gahan, Brian C. et al. "Efficient of Downhole Pressure Conditions on High-Power Laser Perforation", *Society of Petroleum Engineers*, SPE 97093, 2005, pp. 1-7.
Gahan, Brian C. et al., "Laser Drilling: Drilling with the Power of Light, Phase 1: Feasibility Study", *Topical Report*, Cooperative Agreement No. DE-FC26-00NT40917, 2000-2001, pp. 1-148.
Gale, J. F. W. et al., "Natural Fractures in the Barnett Shale and Their Importance for Hydraulic Fracture Treatments", The American Assoction of Petroleum Geologists, *AAPG Bulletin*, vol. 91, No. 4, Apr. 2007, pp. 603-622.
Gardner, R. D. et al., "Flourescent Dye Penetrants Applied to Rock Fractures", *Int. J. Rock Mech. Min. Sci.*, vol. 5, 1968, pp. 155-158 with 2 additional pages.
Gelman, A., "Multi-level (hierarchical) modeling: what it can and can't do", source unknown, Jun. 1, 2005, pp. 1-6.
Gerbaud, L. et al., "PDC Bits: All Comes From the Cutter/Rock Interaction", SPE, No. IADC/SPE 98988, a paper presented at the IADC/SPE Drilling Conference, Feb. 2006, pp. 1-9.
Glowka, David A. et al., "Program Plan for the Development of Advanced Synthetic-Diamond Drill Bits for Hard-Rock Drilling", *Sandia National Laboratories*, SAND 93-1953, 1993, pp. 1-50.
Glowka, David a. et al., "Progress in the Advanced Synthetic-Diamond Drill Bit Program", *Sandia National Laboratories*, SAND95-2617C, 1994, pp. 1-9.
Glowka, David A., "Design Considerations for a Hard-Rock PDC Drill Bit", *Geothermal Technology Development Division 6241, Sandia National Laboratories*, SAND-85-0666C, DE85 008313, 1985, pp. 1-23.
Glowka, David A., "Development of a Method for Predicting the Performance and Wear of PDC Drill Bits", *Sandia National Laboratories*, SAND86-1745-UC-66c, 1987, pp. 1-206.
Glowka, David A., "The Use of Single—Cutter Data in the Analysis of PDC Bit Designs", *61st Annual Technical Conference and Exhibition of Society of Petroleum Engineers*, 1986, pp. 1-37.
Gonthier, F. "High-power All-Fiber® components: The missing link for high power fiber fasers", source unknown, 11 pages.
Graves, R. M. et al., "Comparison of Specific Energy Between Drilling With High Power Lasers and Other Drilling Methods", *SPE*, No. SPE 77627, a paper presented at the SPE (Society of Petroleum Engineers) Annual Technical Conference and Exhibiton, Sep. 2002, pp. 1-8.
Graves, R. M. et al., "Spectral signatures and optic coeffecients of surface and reservoir rocks at COIL, CO2 and Nd:YAG laser wavelenghts", source unknown, 13 pages.
Graves, R. M. et al., "StarWars Laser Technology Applied to Drilling and Completing Gas Wells", *SPE*, No. 49259, a paper prepared for presentation at the 1998 SPE Annual Technical Conference and Exhibition, 1998, pp. 761-770.
Graves, Ramona M. et al., "Application of High Power Laser Technology to Laser/Rock Destruction: Where Have We Been? Where Are We Now?", *SW AAPG Convention*, 2002, pp. 213-224.
Graves, Ramona M. et al., "Laser Parameters That Effect Laser-Rock Interaction: Determining the Benefits of Applying Star Wars Laser Technology for Drilling and Completing Oil and Natural Gas Wells", Topical Report, *Petroleum Engineering Department*, Colorado School of Mines, 2001, pp. 1-157.
Green, D. J. et al., "Crack Arrest and Multiple Crackling in Glass Through the Use of Designed Residual Stress Profiles", *Science*, vol. 283, No. 1295, 1999, pp. 1295-1297.
Grigoryan, V., "InhomogeneoBoundary Value Problems", a lecture for Math 124B, Jan. 26, 2010, pp. 1-5.
Grigoryan, V., "Separathion of variables: Neumann Condition", a lecture for Math 124A, Dec. 1, 2009, pp. 1-3.

(56) References Cited

OTHER PUBLICATIONS

Gunn, D. A. et al., "Laboratory Measurement and Correction of Thermal Properties for Application to the Rock Mass", *Geotechnical and Geological Engineering*, vol. 23, 2005, pp. 773-791.
Guo, B. et al., "Chebyshev Rational Spectral and Pseudospectral Methods on a Semi-infinite Interval", *Int. J. Numer. Meth. Engng*, vol. 53, 2002, pp. 65-84.
Gurarie, V. N., "Stress Resistance Parameters of Brittle Solids Under Laser/Plasma Pulse Heating", *Materials Science and Engineering*, vol. A288, 2000, pp. 168-172.
Habib, P. et al., "The Influence of Residual Stresses on Rock Hardness", *Rock Mechanics*, vol. 6, 1974, pp. 15-24.
Hagan, P. C., "The Cuttability of Rock Using a High Pressure Water Jet", University of New South Wales, Sydney, Australia, obtained form the Internet on Sep. 7, 2010, at: http://www.mining.unsw.edu.au/Publications/publications_staff/Paper_Hagan_WASM.htm, 16 pages.
Hall, K. et al., "Rock Albedo and Monitoring of Thermal Conditions in Respect of Weathering: Some Expected and Some Unexpected Results", *Earth Surface Processes and Landforms*, vol. 30, 2005, pp. 801-811.
Hall, Kevin, "The role of thermal stress fatigue in the breakdown of rock in cold regions", *Geomorphology*, vol. 31, 1999, pp. 47-63.
Hammer, D. X. et al., "Shielding Properties of Laser-Induced Breakdown in Water for Pulse Durations from 5 ns. to 125 fs", *Applied Optics*, vol. 36, No. 22, Aug. 1, 1997, pp. 5630-5640.
Han, Wei, "Computational and experimental investigations of laser drilling and welding for microelectronic packaging", *Dorchester Polytechnic Institute*, A Dissertation submitted in May 2004, 242 pgs.
Hancock, M. J., "The 1-D Heat Equation: 18.303 Linear Partial Differential Equations", source unknown, 2004, pp. 1-41.
Hareland, G. et al., "Drag—Bit Model Including Wear", *SPE*, No. 26957, a paper prepared for presentation at the Latin American/Caribbean Petroleum Engineering Conference, Apr. 1994, pp. 657-667.
Hareland, G. et al., "Cutting Efficiency of a Single PDC Cutter on Hard Rock", *Journal of Canadian Petroleum Technology*, vol. 48, No. 6, 2009, pp. 1-6.
Hareland, G., et al., "A Drilling Rate Model for Roller Cone Bits and Its Application", *SPE*, No. 129592, a paper prepared for presentation at the CPS/SPE International Oil and Gas Conference and Exhibition, Jun. 2010, pp. 1-7.
Harrison, C. W. III et al., "Reservoir Characterization of the Frontier Tight Gas Sand, Green River Basin, Wyoming", *SPE*, No. 21879, a paper prepared for presentation at the Rocky Mountain Regional Meeting and Low-Permeability Reservoirs Symposium, Apr. 1991, pp. 717-725.
Hashida, T. et al., "Numerical Simulation with Experimental Verification of the Fracture Behavior in Granite Under Confining Pressures based on the Tension-Softening Model", *International Journal of Fracture*, vol. 59, 1993, pp. 227-244.
Nesting, M. A. et al., "Evaluation of the Environmental Impacts of Induced Seismicity at the Naknek Geothermal Energy Project, Naknek, Alaska", a final report prepared for ASRC Energy Services Alaska Inc., May 2010, pp. 1-33.
Head, P. et al., "Electric Coiled Tubing Drilling (E-CTD) Project Update", *SPE*, No. 68441, a paper prepared for presentation at the SPE/CoTA Coiled Tubing Roundtable, Mar. 2001, pp. 1-9.
Healy, Thomas E., "Fatigue Crack Growth in Lithium Hydride", *Lawrence Livermore National Laboratory*, 1993, pp. 1-32.
Hettema, M. H. H. et al., "The Influence of Steam Pressure on Thermal Spalling of Sedimentary Rock: Theory and Experiments", *Int. J. Rock Mech. Min. Sci.*, vol. 35, No. 1, 1998, pp. 3-15.
Hibbs, Louis E. et al., "Wear Machanisms for Polycrystalline-Diamond Compacts as Utilized fro Drilling in Geothermal Environments", *Sandia National Laboratories*, for the United States Government, Report No. SAND-82-7213, 1983, 287 pgs.
Hoek, E., "Fracture of Anisotropic Rock", *Journal of the South African Institute of Mining and Metallurgy*, vol. 64, No. 10, 1964, pp. 501-523.
Hood, M., "Waterjet-Assisted Rock Cutting Systems—The Present State of the Art", *International Journal of Mining Engineering*, vol. 3, 1985, pp. 91-111.
Hoover, Ed R. et al., "Failure Mechanisms of Polycrystalline-Diamond Compact Drill Bits in Geothermal Environments", Sandia Report, *Sandia National Laboratories*, SAND81-1404, 1981, pp. 1-35.
Howard, A. D. et al., "VOLAN Interpretation and Application in the Bone Spring Formation (Leonard Series) in Southeastern New Mexico", *SPE*, No. 13397, a paper presented at the 1984 SPE Production Technology Symposium, Nov. 1984, 10 pages.
Howells, G., "Super-Water [R] Jetting Applications from 1974 to 1999", paper presented st the Proceedings of the $10^{th}$ American Waterjet Confeence in Houston, Texas, 1999, 25 pages.
Hu, H. et al., "SimultaneoVelocity and Concentration Measurements of a Turbulent Jet Mixing Flow", *Ann. N.Y. Acad. Sci.*, vol. 972, 2002, pp. 254-259.
Huang, C. et al., "A Dynamic Damage Growth Model for Uniaxial Compressive Response of Rock Aggregates", *Mechanics of Materials*, vol. 34, 2002, pp. 267-277.
Huang, H. et al., "Intrinsic Length Scales in Tool-Rock Interaction", *International Journal of Geomechanics*, Jan./Feb. 2008, pp. 39-44.
Huenges, E. et al., "The Stimulation of a Sedimentary Geothermal Reservoir in the North German Basin: Case Study Grob Schonebeck", *Proceedings, Twenty-Ninth Workshop on Geothermal Reservoir Engineering*, Stanford University, Stanford, California, Jan. 26-28, 2004, 4 pages.
Huff, C. F. et al., "Recent Developments in Polycrystalline Diamond-Drill-Bit Design", Drilling Technology Division—4741, *Sandia National Laboratories*, 1980, pp. 1-29.
Hutchinson, J. W., "Mixed Mode Cracking in Layered Materials", *Advances in Applied Mechanics*, vol. 29, 1992, pp. 63-191.
IADC Dull Grading System for Fixed Cutter Bits, by Hughes Christensen, 1996, 14 pgs.
Imbt, W. C. et al., "Porosity in Limestone and Dolomite Petroleum Reservoirs", paper presented at the Mid Continent District, Division of Production, Oklahoma City, Oklahoma, Jun. 1946, pp. 364-372.
Jackson, M. K. et al., "Nozzle Design for Coherent Water Jet Production", source unknown, believed to be published prior to 2012, pp. 53-89.
Jadoun, R. S., "Study on Rock-Drilling Using PDC Bits for the Prediction of Torque and Rate of Penetration", *Int. J. Manufacturing Technology and Management*, vol. 17, No. 4, 2009, pp. 408-418.
Jain, R. K. et al., "Development of Underwater Laser Cutting Technique for Steel and Zircaloy for Nuclear Applications", *Journal of Physics for Indian Academy of Sciences*, vol. 75 No. 6, Dec. 2010, pp. 1253-1258.
Jen, C. K. et al., "Leaky Modes in Weakly Guiding Fiber Acoustic Waveguides", *IEEE Transactions on Ultrasonic Ferroelectrics and Frequency Control*, vol. UFFC-33 No. 6, Nov. 1986, pp. 634-643.
Jimeno, Carlos Lopez et al., Drilling and Blasting of Rocks, *a. a. Balkema* Publishers, 1995, 30 pgs.
Judzis, A. et al., "Investigation of Smaller Footprint Drilling System; Ultra-High Rotary Speed Diamond Drilling Has Potential for Reduced Energy Requirements", IADC/SPE No. 99020, 33 pages.
Jurewicz, B. R., "Rock Excavation with Laser Assistance", *Int. J. Rock Mech. Min. Sci. & Geomech. Abstr.*, vol. 13, 1976, pp. 207-219.
Kahraman, S. et al., "Dominant rock properties affecting the penetration rate of percussive drills", *International Journal of Rock Mechanics and Mining Sciences*, 2003, vol. 40, pp. 711-723.
Karakas, M., "Semianalytical Productivity Models for Perforated Completions", *SPE*, No. 18247, a paper for SPE (Society of Petroleum Engineers) Production Engineering, Feb. 1991, pp. 73-82.
Karasawa, H. et al., "Development of PDC Bits for Downhole Motors", *Proceedings 17th NZ Geothermal Workshop*, 1995, pp. 145-150.
Kelsey, James R., "Drilling Technology/GDO", *Sandia National Laboratories*, SAND-85-1866c, DE85 017231, 1985, pp. 1-7.

(56) References Cited

OTHER PUBLICATIONS

Kemeny, J. M., "A Model for Non-linear Rock Deformation Under Compression Due to Sub-critical Crack Growth", *Int. J. Rock Mech. Min. Sci. & Geomech. Abstr.*, vol. 28 No. 6, 1991, pp. 459-467.
Kerr, Callin Joe, "PDC Drill Bit Design and Field Application Evolution", *Journal of Petroleum Technology*, 1988, pp. 327-332.
Ketata, C. et al., "Knowledge Selection for Laser Drilling in the Oil and Gas Industry", *Computer Society*, 2005, pp. 1-6.
Khan, Ovais U. et al., "Laser heating of sheet metal and thermal stress development", *Journal of Materials Processing Technology*, vol. 155-156, 2004, pp. 2045-2050.
Khandelwal, M., "Prediction of Thermal Conductivity of Rocks by Soft Computing", *Int. J. Earth Sci.* (*Geol. Rundsch*), May 11, 2010, 7 pages.
Kim, C. B. et al., "Measurement of the Refractive Index of Liquids at 1.3 and 1.5 Micron Using a Fibre Optic Fresnel Ratio Meter", *Meas. Sci. Technol.*, vol. 5, 2004, pp. 1683-1686.
Kim, K. R. et al., "$CO_2$ laser-plume interaction in materials processing", *Journal of Applied Physics*, vol. 89, No. 1, 2001, pp. 681-688.
Kiwata, T. et al., "Flow Visualization and Characteristics of a Coaxial Jet with a Tabbed Annular Nozzle", *JSME International Journal Series B*, vol. 49, No. 4, 2006, pp. 906-913.
Klotz, K. et al., "Coatings with intrinsic stress profile: Refined creep analysis of (Ti,A1)N and cracking due to cyclic laser heating", *Thin Solid Films*, vol. 496, 2006, pp. 469-474.
Kobayashi, T. et al., "Drilling a 2-inch in Diameter Hole in Granites Submerged in Water by CO2 Lasers", *SPE*, No. 119914, a paper prepared for presentation at the SPE/IADC Drilling Conference and Exhibition, Mar. 2009, 6 pages.
Kobayashi, Toshio et al., "Drilling a 2-inch in Diameter Hole in Granites Submerged in Water by $CO_2$ Lasers", *SPE International, IADC 119914 Drilling Conference and Exhibition*, 2009, pp. 1-11.
Kobyakov, A. et al., "Design Concept for Optical Fibers with Enhanced SBS Threshold", *Optics Express*, vol. 13, No. 14, Jul. 11, 2005, pp. 5338-5346.
Kolari, K., "Damage Mechanics Model for Brittle Failure of Transversely Isotropic Solids (Finite Element Implementation)", *VTT Publications 628*, 2007, 210 pages.
Kollé, J. J., "A Comparison of Water Jet, Abrasive Jet and Rotary Diamond Drilling in Hard Rock", *Tempress Technologies Inc.*, 1999, pp. 1-8.
Kolle, J. J., "HydroPulse Drilling", a Final Report for Department of Energy under Cooperative Development Agreement No. DE-FC26-FT34367, Apr. 2004, 28 pages.
Kovalev, V. I. et al., "Observation of Hole Burning in Spectrum in SBS in Optical Fibres Under CW Monochromatic Laser Excitation", *IEEE*, Jun. 3, 2010, pp. 56-57.
Koyamada, Y. et al., "Simulating and Designing Brillouin Gain Spectrum in Single-Mode Fibers", *Journal of Lightwave Technology*, vol. 22, No. 2, Feb. 2004, pp. 631-639.
Krajcinovic, D. et al., "A Micromechanical Damage Model for Concrete", *Engineering Fracture Mechanics*, vol. 25, No. 5/6, 1986, pp. 585-596.
Kranz, R. L., "Microcracks in Rocks: A Review", *Tectonophysics*, vol. 100, 1983, pp. 449-480.
Kubacki, Emily et al., "Optics for Fiber Laser Applications", *CVI Laser, LLC*, Technical Reference Document #20050415, 2005, 5 pgs.
Kujawski, Daniel, "A fatigue crack driving force parameter with load ratio effects", *International Journal of Fatigue*, vol. 23, 2001, pp. S239-S246.
Labuz, J. F. et al., "Experiments with Rock: Remarks on Strength and Stability Issues", *International Journal of Rock Mechanics & Mining Science*, vol. 44, 2007, pp. 525-537.
Labuz, J. F. et al., "Size Effects in Fracture of Rock", *Rock Mechanics for Industry*, Amadei, Kranz, Scott & Smeallie (eds), 1999, pp. 1137-1143.
Labuz, J. F. et al., "Microrack-dependent fracture of damaged rock", *International Journal of Fracture*, vol. 51, 1991, pp. 231-240.
Lacy, Lewis L., "Dynamic Rock Mechanics Testing for Optimized Fracture Designs", *Society of Petroleum Engineers International, Annual Technical Conference and Exhibition*, 1997, pp. 23-36.
Lally, Evan M., "A Narrow-Linewidth Laser at 1550 nm Using the Pound-Drever-Hall Stabilization Technique", *Thesis*, submitted to Virginia Polytechnic Institute and State University, Blacksburg, Virginia, 2006, 92 pgs.
Langeveld, C. J., "PDC Bit Dynamics", a paper prepared for presentation at the 1992 IADC/SPE Drilling Conference, Feb. 1992, pp. 227-241.
Lau, John H., "Thermal Fatigue Life Prediction of Flip Chip Solder Joints by Fracture Mechanics Method", *Engineering Fracture Mechanics*, vol. 45, No. 5, 1993, pp. 643-654.
Lee, S. H. et al., "Themo-Poroelastic Analysis of Injection-Induced Rock Deformation and Damage Evolution", *Proceedings Thirty-Fifth Workshop on Geothermal Reservoir Engineering*, Feb. 2010, 9 pages.
Lee, Y. W. et al., "High-Power Yb3+ Doped Phosphate Fiber Amplifier", *IEEE Journal of Selected Topics in Quantum Electronics*, vol. 15, No. 1, Jan./Feb. 2009, pp. 93-102.
Legarth, B. et al., "Hydraulic Fracturing in a Sedimentary Geothermal Reservoir: Results and Implications", *International Journal of Rock Mechanics & Mining Sciences*, vol. 42 , 2005, pp. 1028-1041.
Lehnhoff, T. F. et al., "The Influence of Temperature Dependent Properties on Thermal Rock Fragmentation", *Int. J. Rock Mech. Min. Sci. & Geomech. Abstr.*, vol. 12, 1975, pp. 255-260.
Leong, K. H. et al., "Lasers and Beam Delivery for Rock Drilling", *Argonne National Laboratory*, ANL/TD/TM03-01, 2003, pp. 1-35.
Leong, K. H., "Modeling Laser Beam-Rock Interaction", a report prepared for Department of Energy (http://www.doe.gov/bridge), 8 pages.
Leung, M. et al., "Theoretical study of heat transfer with moving phase-change interface in thawing of frozen food", *Journal of Physics D: Applied Physics*, vol. 38, 2005, pp. 477-482.
Li, Q. et al., "Experimental Research on Crack Propagation and Failure in Rock-type Materials under Compression", *EJGE*, vol. 13, Bund. D, 2008, p. 1-13.
Li, X. B. et al., "Experimental Investigation in the Breakage of Hard Rock by the PDC Cutters with Combined Action Modes", *Tunnelling and Underground Space Technology*, vol. 16., 2001, pp. 107-114.
Liddle, D. et al., "Cross Sector Decommissioning Workshop", presentation, Mar. 23, 2011, 14 pages.
Lima, R. S. et al., "Elastic ModulMeasurements via Laser-Ultrasonic and Knoop Indentation Techniques in Thermally Sprayed Coatings", *Journal of Thermal Spray Technology*, vol. 14(1), 2005, pp. 52-60.
Lin, Y. T., "The Impact of Bit Performance on Geothermal-Well Cost", *Sandia National Laboratories*, SAND-81-1470C, 1981, pp. 1-6.
Lindholm, U. S. et al., "The Dynamic Strength and Fracture Properties of Dresser Basalt", *Int. J. Rock Mech. Min. Sci. & Geomech. Abstr.*, vol. 11, 1974, pp. 181-191.
Loland, K. E., "ContinuoDamage Model for Load-Response Estimation of Concrete", *Cement and Concrete Research*, vol. 10, 1980, pp. 395-402.
Lomov, I. N. et al., "Explosion in the Granite Field: Hardening and Softening Behavior in Rocks", *U.S. Department of Energy, Lawrence Livermore National Laboratory*, 2001, pp. 1-7.
Long, S. G. et al., "Thermal fatigue of particle reinforced metal-matrix composite induced by laser heating and mechanical load", *Composites Science and Technology*, vol. 65, 2005, pp. 1391-1400.
Lorenzana, H. E. et al., "Metastability of Molecular Phases of Nitrogen: Implications to the Phase Diagram", a manuscript submitted to the European Hight Pressure Research Group 39 Conference, *Advances on High Pressure*, Sep. 21, 2001, 18 pages.
Lubarda, V. A. et al., "Damage Model for Brittle Elastic Solids with Unequal Tensile and Compressive Strengths", *Engineering Fracture Mechanics*, vol. 29, No. 5, 1994, pp. 681-692.
Lucia, F. J. et al., "Characterization of Diagenetically Altered Carbonate Reservoirs, South Cowden Grayburg Reservoir, West Texas", a paper prepared for presentation at the 1996 SPE Annual Technical Conference and Exhibition, Oct. 1996, pp. 883-893.

(56) References Cited

OTHER PUBLICATIONS

Luffel, D. L. et al., "Travis Peak Core Permeability and Porosity Relationships at Reservoir Stress", *SPE Formation Evaluation*, Sep. 1991, pp. 310-318.
Luft, H. B. et al., "Development and Operation of a New Insulated Concentric Coiled Tubing String for ContinuoSteam Injection in Heavy Oil Production", Conference Paper published by Society of Petroleum Engineers on the Internet at: (http://www.onepetro.org/mslib/servlet/onepetropreview?id=00030322), on Aug. 8, 2012, 1 page.
Lund, M. et al., "Specific Ion Binding to Macromolecules: Effect of Hydrophobicity and Ion Pairing", *Langmuir*, 2008 vol. 24, 2008, pp. 3387-3391.
Lyons, K. David et al., "NETL Extreme Drilling Laboratory Studies High Pressure High Temperature Drilling Phenomena", *U.S. Department of Energy, National Energy Technology Laboratory*, 2007, pp. 1-6.
Manrique, E. J. et al., "EOR Field Experiences in Carbonate Reservoirs in the United States", *SPE Reservoir Evaluation & Engineering*, Dec. 2007, pp. 667-686.
Maqsood, A. et al., "Thermophysical Properties of PoroSandstones: Measurement and Comparative Study of Some Representative Thermal Conductivity Models", *International Journal of Thermophysics*, vol. 26, No. 5, Sep. 2005, pp. 1617-1632.
Marcuse, D., "Curvature Loss Formula for Optical Fibers", *J. Opt. Soc. Am.*, vol. 66, No. 3, 1976, pp. 216-220.
Marshall, David B. et al., "Indentation of Brittle Materials", *Microindentation Techniques in Materials Science and Engineering, ASTM STP 889; American Society for Testing and Materials*, 1986, pp. 26-46.
Martin, C. D., "Seventeenth Canadian Geotechnical Colloquium: The Effect of Cohesion Loss and Stress Path on Brittle Rock Strength", *Canadian Geotechnical Journal*, vol. 34, 1997, pp. 698-725.
Martins, A. et al., "Modeling of Bend Losses in Single-Mode Optical Fibers", Institutu de Telecomunicacoes, Portugal, 3 pages.
Maurer, W. C. et al., "Laboratory Testing of High-Pressure, High-Speed PDC Bits", a paper prepared for presentation at the 61st Annual Technical Conference and Exhibition of the Society of Petroleum Engineers, Oct. 1986, pp. 1-8.
Maurer, William C., "Advanced Drilling Techniques", published by Petroleum Publishing Co., copyright 1980, 26 pgs.
Maurer, William C., "Novel Drilling Techniques", published by Pergamon Press, UK, copyright 1968, pp. 1-64.
Mazerov, Katie, "Bigger coil sizes, hybrid rigs, rotary steerable advances push coiled tubing drilling to next level", *Drilling Contractor*, 2008, pp. 54-60.
McElhenny, John E. et al., "Unique Characteristic Features of Stimulated Brillouin Scattering in Small-Core Photonic Crystal Fibers", *J. Opt. Soc. Am. B*, vol. 25, No. 4, 2008, pp. 582-593.
McKenna, T. E. et al., "Thermal Conductivity of Wilcox and Frio Sandstones in South Texas (Gulf of Mexico Basin)", *AAPG Bulletin*, vol. 80, No. 8, Aug. 1996, pp. 1203-1215.
Medvedev, I. F. et al., "Optimum Force Characteristics of Rotary-Percussive Machines for Drilling Blast Holes", Moscow, Translated from *Fiziko-Tekhnicheskie Problemy Razrabotki Poleznykh Iskopaemykh*, No. 1, 1967, pp. 77-80.
Meister, S. et al., "Glass Fibers for Stimulated Brillouin Scattering and Phase Conjugation", *Laser and Particle Beams*, vol. 25, 2007, pp. 15-21.
Mejia-Rodriguez, G. et al., "Multi-Scale Material Modeling of Fracture and Crack Propagation", Final Project Report in Multi-Scale Methods in Applied Mathematics, while the date of the publication is unknown, it is believed to be prior to Aug. 19, 2009, pp. 1-9.
Mensa-Wilmot, G. et al., "New PDC Bit Technology, Improved Drillability Analysis, and Operational Practices Improve Drilling Performance in Hard and Highly HeterogeneoApplications", a paper prepared for the 2004 SPE (Society of Petroleum Engineers) Eastern Regional Meeting, Sep. 2004, pp. 1-14.
Mensa-Wilmot, Graham et al., "Advanced Cutting Structure Improves PDC Bit Performance in Hard and Abrasive Drilling Environments", *Society of Petroleum Engineers International*, 2003, pp. 1-13.
Messaoud, Louafi, "Influence of Fluids on the Essential Parameters of Rotary Percussive Drilling", *Laboratoire d'Environnement (Tébessa)*, vol. 14, 2009, pp. 1-8.
Messica, A. et al., "Theory of Fiber-Optic Evanescent-Wave Spectroscopy and Sensor", *Applied Optics*, vol. 35, No. 13, May 1, 1996, pp. 2274-2284.
Mills, W. R. et al., "Pulsed Neutron Porosity Logging", SPWLA Twenty-Ninth Annual Logging Symposium, Jun. 1988, pp. 1-21.
Mirkovich, V. V., "Experimental Study Relating Thermal Conductivity to Thermal Piercing of Rocks", *Int. J. Rock Mech. Min. Sci.*, vol. 5, 1968, pp. 205-218.
Mittelstaedt, E. et al., "A Noninvasive Method for Measuring the Velocity of Diffuse Hydrothermal Flow by Tracking Moving Refractive Index Anomalies", *Geochemistry Geophysics Geosystems*, vol. 11, No. 10, Oct. 8, 2010, pp. 1-18.
Moavenzadeh, F. et al., "Thin Disk Technique for Analyzing Fock Fractures Induced by Laser Irradiation", a report prepared for the Department of Transportation under Contract C-85-65, May 1968, 91 pages.
Mocofanescu, A. et al., "SBS threshold for single mode and multimode GRIN fibers in an all fiber configuration", *Optics Express*, vol. 13, No. 6, 2005, pp. 2019-2024.
Montross, C. S. et al., "Laser-Induced Shock Wave Generation and Shock Wave Enhancement in Basalt", *International Journal of Rock Mechanics and Mining Sciences*, 1999, pp. 849-855.
Moradian, Z. A. et al., "Predicting the Uniaxial Compressive Strength and Static Young's Modulof Intact Sedimentary Rocks Using the Ultrasonic Test", *International Journal of Geomechanics*, vol. 9, No. 1, 2009, pp. 14-19.
Morozumi, Y. et al., "Growth and Structures of Surface Disturbances of a Round Liquid Jet in a Coaxial Airflow", *Fluid Dynamics Research*, vol. 34, 2004, pp. 217-231.
Morse, J. W. et al., "Experimental and Analytic Studies to Model Reaction Kinetics and Mass Transport of Carbon Dioxide Sequestration in Depleted Carbonate Reservoirs", a Final Scientific/Technical Report for DOE, while the date of the publication is unknown, it is believed to be prior to Aug. 19, 2009, 158 pages.
Moshier, S. O., "Microporosity in Micritic Limestones: A Review", *Sedimentary Geology*, vol. 63, 1989, pp. 191-213.
Mostafa, M. S. et al., "Investigation of Thermal Properties of Some Basalt Samples in Egypt", *Journal of Thermal Analysis and Calorimetry*, vol. 75, 2004, pp. 178-188.
Mukhin, I. B. et al., "Experimental Study of Kilowatt-Average-Power Faraday Isolators", OSA/ASSP, 2007, 3 pages.
Multari, R. A. et al., "Effect of Sampling Geometry on Elemental Emissions in Laser-Induced Breakdown Spectroscopy", *Applied Spectrowscopy*, vol. 50, No. 12, 1996, pp. 1483-1499.
Munro, R. G., "Effective Medium Theory of the Porosity Dependence of Bulk Moduli", *Communications of American Ceramic Society*, vol. 84, No. 5, 2001, pp. 1190-1192.
Murphy, H. D., "Thermal Stress Cracking and Enhancement of Heat Extraction from Fractured Geothermal Reservoirs", a paper submitted to the Geothermal Resource Council for its 1978 Annual Meeting, Jul. 1978, 7 pages.
Murrell, S. A. F. et al., "The Effect of Temperature on the Strength at High Confining Pressure of Granodiorite Containing Free and Chemically-Bound Water", *Mineralogy and Petrology*, vol. 55, 1976, pp. 317-330.
Muto, Shigeki et al., "Laser cutting for thick concrete by multi-pass technique", *Chinese Optics Letters*, vol. 5 Supplement, 2007, pp. S39-S41.
Myung, I. J., "Tutorial on Maximum Likelihood Estimation", *Journal of Mathematical Psychology*, vol. 47, 2003, pp. 90-100.
Nakano, A. et al., "Visualization for Heat and Mass Transport Phenomena in Supercritical Artificial Air", *Cryogenics*, vol. 45, 2005, pp. 557-565.
Naqavi, I. Z. et al., "Laser heating of multilayer assembly and stress levels: elasto-plastic consideration", *Heat and Mass Transfer*, vol. 40, 2003, pp. 25-32.

(56) References Cited

OTHER PUBLICATIONS

Nara, Y. et al., "Study of Subcritical Crack Growth in Andesite Using the Double Torsion Test", *International Journal of Rock Mechanics & Mining Sciences*, vol. 42, 2005, pp. 521-530.
Nara, Y. et al., "Sub-critical crack growth in anisotropic rock", *International Journal of Rock Mechanics and Mining Sciences*, vol. 43, 2006, pp. 437-453.
Nemat-Nasser, S. et al., "Compression-Induced Nonplanar Crack Extension With Application to Splitting, Exfoliation, and Rockburst", *Journal of Geophysical Research*, vol. 87, No. B8, 1982, pp. 6805-6821.
Nicklaus, K. et al., "Optical Isolator for Unpolarized Laser Radiation at Multi-Kilowatt Average Power", *Optical Society of America*, 2005, 3 pages.
Nikles, M. et al., "Brillouin Gain Spectrum Characterization in Single-Mode Optical Fibers", *Journal of Lightwave Technology*, vol. 15, No. 10, Oct. 1997, pp. 1842-1851.
Nilsen, B. et al., "Recent Developments in Site Investigation and Testing for Hard Rock TBM Projects", *1999 RETC Proceedings*, 1999, pp. 715-731.
Nimick, F. B., "Empirical Relationships Between Porosity and the Mechanical Properties of Tuff", *Key Questions in Rock Mechanics*, Cundall et al. (eds), 1988, pp. 741-742.
Nolen-Hoeksema, R., "Fracture Development and Mechnical Stratigraphy of Austin Chalk, Texas: Discussion", a discussion for the American Association of Petroleum Geologists Bulletin, vol. 73, No. 6, Jun. 1989, pp. 792-793.
O'Hare, Jim et al., "Design Index: A Systematic Method of PDC Drill-Bit Selection", *Society of Petroleum Engineers International*, IADC/SPE Drilling Conference, 2000, pp. 1-15.
Oglesby, K. et al., "Advanced Ultra High Speed Motor for Drilling", a project update by Impact Technologies LLC for the Department of Energy, Sep. 12, 2005, 36 pages.
Okon, P. et al., "Laser Welding of Aluminium Alloy 5083", *21st International Congress on Applications of Lasers and Electro-Optics*, 2002, pp. 1-9.
Olsen, F. O., "Fundamental Mechanisms of Cutting Front Formation in Laser Cutting", *SPIE*, vol. 2207, pp. 402-413.
Ortega, Alfonso et al., "Frictional Heating and Convective Cooling of Polycrystalline Diamond Drag Tools During Rock Cutting", Report No. SAND 82-0675c, *Sandia National Laboratories*, 1982, 23 pgs.
Ortega, Alfonso et al., "Studies of the Frictional Heating of Polycrystalline Diamond Compact Drag Tools During Rock Cutting", *Sandia National Laboratories*, SAND-80-2677, 1982, pp. 1-151.
Ortiz, Blas et al., Improved Bit Stability Reduces Downhole Harmonics (Vibrations), *International Association of Drilling Contractors/Society of Petroleum Engineers Inc.*, 1996, pp. 379-389.
Ouyang, L. B. et al., "General Single Phase Wellbore Flow Model", a report prepared for the COE/PETC, May 2, 1997, 51 pages.
Palashchenko, Yuri a., "Pure Rolling of Bit Cones Doubles Performance", *I & Gas Journal*, vol. 106, 2008, 8 pgs.
Palchaev, D. K. et al., "Thermal Expansion of Silicon Carbide Materials", *Journal of Engineering Physics and Thermophysics*, vol. 66, No. 6, 1994, 3 pages.
Pardoen, T. et al., "An extended model for void growth and Coalescence", *Journal of the Mechanics and Physics of Solids*, vol. 48, 2000, pp. 2467-2512.
Park, Un-Chul et al., "Thermal Analysis of Laser Drilling Processes", *IEEE Journal of Quantum Electronics*, 1972, vol. QK-8, No. 2, 1972, pp. 112-119.
Parker, R. et al., "Drilling Large Diameter Holes in Rocks Using Multiple Laser Beams (504)", while the date of the publication is unknown, it is believed to be prior to Aug. 19, 2009, 6 pages.
Parker, Richard A. et al., "Laser Drilling Effects of Beam Application Methods on Improving Rock Removal", *Society of Petroleum Engineers*, SPE 84353, 2003, pp. 1-7.
Patricio, M. et al., "Crack Propagation Analysis", while the date of the publication is unknown, it is believed to be prior to Aug. 19, 2009, 24 pages.
Pavlina, E. J. et al., "Correlation of Yield Strength and Tensile Strength with Hardness for Steels", *Journals of Materials Engineering and Performance*, vol. 17, No. 6, 2008, pp. 888-893.
Peebler, R. P. et al., "Formation Evaluation with Logs in the Deep Anadarko Basin", *SPE of AIME*, 1972, 15 pages.
Pepper, D. W. et al., "Benchmarking COMSOL Multiphysics 3.5a—CFD Problems", a presentation, Oct. 10, 2009, 54 pages.
Percussion Drilling Manual, by Smith Tools, 2002, 67 pgs.
Pettitt, R. et al., "Evolution of a Hybrid Roller Cone/PDC Core Bit", a paper prepared for Geothermal Resources Council 1980 Annual Meeting, Sep. 1980, 7 pages.
Phani, K. K. et al., "Pororsity Dependence of Ultrasonic Velocity and Elastic Modulin Sintered Uranium Dioxide—a discussion", *Journal of Materials Science Letters*, vol. 5, 1986, pp. 427-430.
Ping, Cao et al., "Testing study of subcritical crack growth rate and fracture toughness in different rocks", *Transactions of NonferroMetals Society of China*, vol. 16, 2006, pp. 709-714.
Plinninger, Dr. Ralf J. et al., "Wear Prediction in Hardrock Excavation Using the CERCHAR Abrasiveness Index (CAI)", *EUROCK 2004 & 53rd Geomechanics Colloquium. Schubert (ed.)*, VGE, 2004, pp. 1-6.
Plinninger, R. J. et al., "Wear Prediction in Hardrock Excavation Using the CERCHAR Abrasiveness Index (CAI)", EUROCK 2004 & 53rd Geomechanics Colloquium, 2004, 6 pages.
Plinninger, Ralf J. et al., "Predicting Tool Wear in Drill and Blast", *Tunnels & Tunneling International Magazine*, 2002, pp. 1-5.
Plumb, R. A. et al., "Influence of Composition and Texture on Compressive Strength Variations in the Travis Peak Formation", a paper prepared for presentation at the 67th Annual Technical Conference and Exhibition of the Society of Petroleum Engineers, Oct. 1992, pp. 985-998.
Polsky, Yarom et al., "Enhanced Geothermal Systems (EGS) Well Construction Technology Evaluation Report", *Sandia National Laboratories*, Sandia Report, SAND2008-7866, 2008, pp. 1-108.
Pooniwala, S. et al., "Lasers: The Next Bit", a paper prepared for the presentation at the 2006 SPE (Society of Petroleum Engineers) Eastern Regional Meeting, Oct. 2006, pp. 1-10.
Pooniwala, Shahvir, "Lasers: The Next Bit", *Society of Petroleum Engineers*, No. SPE 104223, 2006, 10 pgs.
Porter, J. A. et al., "Cutting Thin Sheet Metal with a Water Jet Guided Laser Using VarioCutting Distances, Feed Speeds and Angles of Incidence", *Int. J. Adv. Manuf. Technol.*, vol. 33, 2007, pp. 961-967.
Potyondy, D. O. et al., "A Bonded-particle model for rock", *International Journal of Rock Mechanics and Mining Sciences*, vol. 41, 2004, pp. 1329-1364.
Potyondy, D. O., "Simulating Stress Corrosion with a Bonded-Particle Model for Rock", *International Journal of Rock Mechanics & Mining Sciences*, vol. 44, 2007, pp. 677-691.
Potyondy, D., "Internal Technical Memorandum—Molecular Dynamics with PFC", a Technical Memorandum to PFC Development Files and Itasca Website, *Molecular Dynamics with PFC*, Jan. 6, 2010, 35 pages.
Powell, M. et al., "Optimization of UHP Waterjet Cutting Head, The Orifice", Flow International, while the date of the publication is unknown, it is believed to be prior to Aug. 19, 2009, 19 pages.
Price, R. H. et al., "Analysis of the Elastic and Strength Properties of Yuccs Mountain tuff, Nevada", 26th Symposium on Rock Mechanics, Jun. 1985, pp. 89-96.
Qixian, Luo et al., "Using compression wave ultrasonic transducers to measure the velocity of surface waves and hence determine dynamic modulof elasticity for concrete", *Construction and Building Materials*, vol. 10, No. 4, 1996, pp. 237-242.
Quinn, R. D. et al., "A Method for Calculating Transient Surface Temperatures and Surface Heating Rates for High-Speed Aircraft", NASA, Dec. 2000, 35 pages.
Radkte, Robert, "New High Strength and faster Drilling TSP Diamond Cutters", Report by *Technology International, Inc.*, DOE Award No. DE-FC26-97FT34368, 2006, 97 pgs.

(56) References Cited

OTHER PUBLICATIONS

Ramadan, K. et al., "On the Analysis of Short-Pulse Laser Heating of Metals Using the Dual Phase Lag Heat Conduction Model", *Journal of Heat Transfer*, vol. 131, Nov. 2009, pp. 111301-1 to 111301-7.
Rao, M. V. M. S. et al., "A Study of Progressive Failure of Rock Under Cyclic Loading by Ultrasonic and AE Monitoring Techniques", *Rock Mechanics and Rock Engineering*, vol. 25, No. 4, 1992, pp. 237-251.
Rauenzahn, R. M. et al., "Rock Failure Mechanisms of Flame-Jet Thermal Spallation Drilling—Theory and Experimental Testing", *Int. J. Rock Mech. Min. Sci. & Geomech. Abstr.*, vol. 26, No. 5, 1989, pp. 381-399.
Rauenzahn, R. M., "Analysis of Rock Mechanics and Gas Dynamics of Flame-Jet Thermal Spallation Drilling", a dissertation for the degree of Doctor of Philosophy at Massachusettes Institute of Technology, Sep. 1986, pp. 1-524.
Rauenzahn, R. M. et al., "Rock Failure Mechanisms of Flame-Jet Thermal Spallation Drilling—Theory and Experimental Testing", *Int. J. Rock Merch. Min. Sci. & Geomech. Abstr.*, vol. 26, No. 5, 1989, pp. 381-399.
Rauenzahn, R. M., "Analysis of Rock Mechanics and Gas Dynamics of Flame-Jet Thermal Spallation Drilling", *Massachusetts Institute of Technology*, submitted in partial fulfillment of doctorate degree, 1986 583 pgs.
Ravishankar, M. K., "Some Results on Search Complexity vs Accuracy", DARPA Spoken Systems Technology Workshop, Feb. 1997, 4 pages.
Raymond, David W., "PDC Bit Testing at Sandia Reveals Influence of Chatter in Hard-Rock Drilling", *Geothermal Resources Council Monthly Bulletin*, SAND99-2655J, 1999, 7 pgs.
Ream, S. et al., "Zinc Sulfide Optics for High Power Laser Applications", Paper 1609, while the date of the publication is unknown, it is believed to be prior to Aug. 19, 2009, 7 pages.
Rice, J. R., "On the Stability of Dilatant Hardening for Saturated Rock Masses", *Journal of Geophysical Research*, vol. 80, No. 11, Apr. 10, 1975, pp. 1531-1536.
Richter, D. et al., "Thermal Expansion Behavior of IgneoRocks", *Int. J. Rock Mech. Min. Sci. & Geomech. Abstr.*, vol. 11, 1974, pp. 403-411.
Rietman, N. D. et al., "Comparative Economics of Deep Drilling in Anadarka Basin", a paper presented at the 1979 Society of Petroleum Engineers of AIME Deep Drilling and Production Symposium, Apr. 1979, 5 pages.
Rijken, P. et al., "Predicting Fracture Attributes in the Travis Peak Formation Using Quantitative Mechanical Modeling and Stractural Diagenesis", Gulf Coast Association of Geological Societies Transactions vol. 52, 2002, pp. 837-847.
Rijken, P. et al., "Role of Shale Thickness on Vertical Connectivity of Fractures: Application of Crack-Bridging Theory to the Austin Chalk, Texas", *Tectonophysics*, vol. 337 ,2001, pp. 117-133.
Rosler, M., "Generalized Hermite Polynomials and the Heat Equation for Dunkl Operators", a paper, while the date of the publication is unknown, it is believed to be prior to Aug. 19, 2009, pp. 1-24.
Rossmanith, H. P. et al., "Fracture Mechanics Applications to Drilling and Blasting", *Fatigue & Fracture Engineering Materials & Structures*, vol. 20, No. 11, 1997, pp. 1617-1636.
Rossmanith, H. P. et al., "Wave Propagation, Damage Evolution, and Dynamic Fracture Extension. Part I. Percussion Drilling", *Materials Science*, vol. 32, No. 3, 1996, pp. 350-358.
Rubin, A. M. et al., "Dynamic Tensile-Failure-Induced Velocity Deficits in Rock", *Geophysical Research Letters*, vol. 18, No. 2, Feb. 1991, pp. 219-222.
Sachpazis, C. I, M. Sc., Ph. D., "Correlating Schmidt Hardness With Compressive Strength and Young's ModulOf Carbonate Rocks", *International Association of Engineering Geology*, Bulletin, No. 42, 1990, pp. 75-83.
Salehi, I. A. et al., "Laser Drilling—Drilling with the Power Light", a final report a contract with DOE with award No. DE-FC26-00NT40917, May 2007, in parts 1-4 totaling 318 pages.
Sandler, I. S. et al., "An Algorithm and a Modular Subroutine for the Cap Model", *International Journal for Numerical and Analytical Methods in Geomechanics*, vol. 3, 1979, pp. 173-186.
Sano, Osam et al., "Acoustic Emission During Slow Crack Growth", *Department Mining and Mineral Engineering, NII-Electronic Library Service*, 1980, pp. 381-388.
Santarelli, F. J. et al., "Formation Evaluation From Logging on Cuttings", *SPE Reservoir Evaluation & Engineering*, Jun. 1998, pp. 238-244.
Sattler, A. R., "Core Analysis in a Low Permeability Sandstone Reservoir: Results from the Multiwell Experiment", a report by Sandia National Laboratories for The Department of Energy, Apr. 1989, 69 pages.
Scaggs, M. et al., "Thermal Lensing Compensation Objective for High Power Lasers", published by Haas Lasers Technologies, Inc., while the date of the publication is unknown, it is believed to be prior to Aug. 19, 2009, 7 pages.
Schaff, D. P. et al., "Waveform Cross-Correlation-Based Differential Travel-Time Measurements at the Northern California Seismic Network", *Bulletin of the Seismological Society of America*, vol. 95, No. 6, Dec. 2005, pp. 2446-2461.
Schaffer, C. B. et al., "Dynamics of Femtosecond Laser-Induced Breakdown in Water from Femtoseconds to Microseconds", *Optics Express*, vol. 10, No. 3, Feb. 11, 2002, pp. 196-203.
Scholz, C. H., "Microfracturing of Rock in Compression", a dissertation for the degree of Doctor of Philosophy at Massachusettes Instutute of Trechnology, Sep. 1967, 177 pages.
Schormair, Nik et al., "The influence of anisotropy on hard rock drilling and cutting", The Geological Society of London, *IAEG*, Paper No. 491, 2006, pp. 1-11.
Schroeder, R. J. et al., "High Pressure and Temperature Sensing for the Oil Industry Using Fiber Bragg Gratings Written onto Side Hole Single Mode Fiber", publisher unknown, while the date of the publication is unknown, it is believed to be prior to Aug. 19, 2009, 4 pages.
Shannon, G. J. et al., "High power laser welding in hyperbaric gas and water environments", *Journal of Laser Applications*, vol. 9, 1997, pp. 129-136.
Shiraki, K. et al., "SBS Threshold of a Fiber with a Brillouin Frequency Shift Distribution", *Journal of Lightwave Technology*, vol. 14, No. 1, Jan. 1996, pp. 50-57.
Shuja, S. Z. et al., "Laser heating of semi-infinite solid with consecutive pulses: Influence of materaial properties on temperature field", *Optics & Laser Technology*, vol. 40, 2008, pp. 472-480.
Simple Drilling Methods, WEDC Loughborough University, United Kingdom, 1995, 4 pgs.
Singh, T. N. et al., "Prediction of Thermal Conductivity of Rock Through Physico-Mechanical Properties", *Building and Environment*, vol. 42, 2007, pp. 146-155.
Sinha, D., "Cantilever Drilling—Ushering a New Genre of Drilling", a paper prepared for presentation at the SPE/IADC Middle East Drilling Technology Conference and Exhibition, Oct. 2003, 6 pages.
Sinor, a. et al., "Drag Bit Wear Model", *SPE Drilling Engineering*, Jun. 1989, pp. 128-136.
Smith, D., "Using Coupling Variables to Solve Compressible Flow, Multiphase Flow and Plasma Processing Problems", COMSOL Users Conference 2006, 38 pages.
Smith, E., "Crack Propagation at a Constant Crack Tip Stress Intensity Factor", *Int. Journal of Fracture*, vol. 16, 1980, pp. R215-R218.
Sneider, RM et al., "Rock Types, Depositional History, and Diangenetic Effects, Ivishak reservoir Prudhoe Bay Field", *SPE Reservoir Engineering*, Feb. 1997, pp. 23-30.
Soeder, D. J. et al., "Pore Geometry in High- and Low-Permeability Sandstones, Travis Peak Formation, East Texas", *SPE Formation Evaluation*, Dec. 1990, pp. 421-430.
Solomon, a. D. et al., "Moving Boundary Problems in Phase Change Models Current Research Questions", *Engineering Physics and Mathematics Division*, ACM Signum Newsletter, vol. 20, Issue 2, 1985, pp. 8-12.

(56) References Cited

OTHER PUBLICATIONS

Somerton, W. H. et al., "Thermal Expansion of Fluid Saturated Rocks Under Stress", SPWLA Twenty-Second Annual Logging Symposium, Jun. 1981, pp. 1-8.
Sousa, L. M. O. et al., "Influence of Microfractures and Porosity on the Physico-Mechanical Properties and Weathering of Ornamental Granites", *Engineering Geology*, vol. 77, 2005, pp. 153-168.
Sousa, Luis M. O. et al., "Influence of microfractures and porosity on the physico-mechanical properties and weathering of ornamental granites", *Engineering Geology*, vol. 77, 2005, pp. 153-168.
Stone, Charles M. et al., "Qualification of a Computer Program for Drill String Dynamics", *Sandia National Laboratories*, SAND-85-0633C, 1985, pp. 1-20.
Stowell, J. F. W., "Characterization of Opening-Mode Fracture Systems in the Austin Chalk", *Gulf Coast Association of Geological Societies Transactions*, vol. L1, 2001, pp. 313-320.
Straka, W. A. et al., "Cavitation Inception in Quiescent and Co-Flow Nozzle Jets", 9th International Conference on Hydrodynamics, Oct. 2010, pp. 813-819.
Suarez, M. C. et al., "COMSOL in a New Tensorial Formulation of Non-Isothermal Poroelasticity", publisher unknown, while the date of the publication is unknown, it is believed to be prior to Aug. 19, 2009,2 pages.
Summers, D. A., "Water Jet Cutting Related to Jet & Rock Properties", publisher unknown, while the date of the publication is unknown, it is believed to be prior to Aug. 19, 2009, 13 pages.
Suwarno, et al., "Dielectric Properties of Mixtures Between Mineral Oil and Natural Ester from Palm Oil", *WSEAS Transactions on Power Systems*, vol. 3, Issue 2, Feb. 2008, pp. 37-46.
Takarli, Mokhfi et al., "Damage in granite under heating/cooling cycles and water freeze-thaw condition", *International Journal of Rock Mechanics and Mining Sciences*, vol. 45, 2008, pp. 1164-1175.
Tanaka, K. et al., "The Generalized Relationship Between the Parameters *C* and *m* of Paris' Law for Fatigue Crack Growth", *Scripta Metallurgica*, vol. 15, No. 3, 1981, pp. 259-264.
Tang, C. A. et al., "Numerical Studies of the Influence of Microstructure on Rock Failure in Uniaxial Compression—Park I: Effect of Heterogeneity", *International Journal of Rock Mechanics and Mining Sciences*, vol. 37, 2000, pp. 555-569.
Tang, C. A. et al., "Coupled analysis of flow, stress and damage (FSD) in rock failure", *International Journal of Rock Mechanics and Mining Sciences*, vol. 39, 2002, pp. 477-489.
Tao, Q. et al., "A Chemo-Poro-Thermoelastic Model for Stress/Pore Pressure Analysis around a Wellbore in Shale", a paper prepared for presentation at the Symposium on Rock Mechanics (USRMS): *Rock Mechanics for Energy*, Mineral and Infrastracture Development in the Northern Regions, Jun. 2005, 7 pages.
Terra, O. et al., "Brillouin Amplification in Phase Coherent Transfer of Optical Frequencies over 480 km Fiber", publisher unknown, while the date of the publication is unknown, it is believed to be prior to Aug. 19, 2009, 9 pages.
Terzopoulos, D. et al., "Modeling Inelastic Deformation: Viscoelasticity, Plasticity, Fracture", *SIGGRAPH* '88, Aug. 1988, pp. 269-278.
Thomas, R. P., "Heat Flow Mapping at the Geysers Geothermal Field", published by the California Department of Conservation Division of Oil and Gas, 1986, 56 pages.
Thompson, G. D., "Effects of Formation Compressive Strength on Perforator Performance", a paper presented of the Southern District API Division of Production, Mar. 1962, pp. 191-197.
Thorsteinsson, Hildigunnur et al., "The Impacts of Drilling and Reservoir Technology Advances on EGS Exploitation", Proceedings, *Thirty-Third Workshop on Geothermal Reservoir Engineering, Institute for Sustainable Energy, Environment, and Economy* (*ISEEE*), 2008, pp. 1-14.
Tovo, R. et al., "Fatigue Damage Evaluation on Mechanical Components Under Multiaxial Loadings", excerpt from the Proceedings of the COMSOL Conference, 2009, 8 pages.
Tuler, F. R. et al., "A Criterion for the Time Dependence of Dynamic Fracture", *The International Jopurnal of Fracture Mechanics*, vol. 4, No. 4, Dec. 1968, pp. 431-437.
Turner, D. et al., "New DC Motor for Downhole Drilling and Pumping Applications", a paper prepared for presentation at the SPE/ICoTA Coiled Tubing Roundtable, Mar. 2001, pp. 1-7.
Turner, D. R. et al., "The All Electric BHA: Recent Developments Toward an Intelligent Coiled-Tubing Drilling System", a paper prepared for presentation at the 1999 SPE/ICoTA Coiled Tubing Roundtable, May 1999, pp. 1-10.
Tutuncu, A. N. et al., "An Experimental Investigation of Factors Influencing Compressional- and Shear-Wave Velocities and Attenuations in Tight Gas Sandstones", *Geophysics*, vol. 59, No. 1, Jan. 1994, pp. 77-86.
U.S. Dept of Energy, "Chapter 6—Drilling Technology and Costs", from Report for The Future of Geothermal Energy, 2005, 53 pgs.
U.S. Appl. No. 12/840,978, filed Jul. 21, 2009, 61 pgs.
Udd, E. et al., "Fiber Optic Distributed Sensing Systems for Harsh Aerospace Environments", publisher unknown, while the date of the publication is unknown, it is believed to be prior to Aug. 19, 2009, 12 pages.
Valsangkar, A. J. et al., Stress-Strain Relationship for Empirical Equations of Creep in Rocks, *Engineering Geology*, Mar. 29, 1971, 5 pages.
Varnado, S. G. et al., "The Design and Use of Polycrystalline Diamond Compact Drag Bits in the Geothermal Environment", *Society of Petroleum Engineers of AIME*, SPE 8378, 1979, pp. 1-11.
Wagh, A. S. et al., "Dependence of Ceramic Fracture Properties on Porosity", *Journal of Material Sience*, vol. 28, 1993, pp. 3589-3593.
Wagner, F. et al., "The Laser Microjet Technology—10 Years of Development (M401)", publisher unknown, while the date of the publication is unknown, it is believed to be prior to Aug. 19, 2009, 9 pages.
Waldron, K. et al., "The Microstructures of Perthitic Alkali Feldspars Revealed by Hydroflouric Acid Etching", *Contributions to Mineralogy and Petrology*, vol. 116, 1994, pp. 360-364.
Walker, B. H. et al., "Roller-Bit Penetration Rate Response as a Function of Rock Properties and Well Depth", a paper prepared for presentation at the 61st Annual Technical Conference and Exhibition of the Society of Petroleum Engineers, Oct. 1986, 12 pages.
Wandera, C. et al., "Characterization of the Melt Removal Rate in Laser Cutting of Thick-Section Stainless Steel", *Journal of Laser Applications*, vol. 22, No. 2, May 2010, pp. 62-70.
Wandera, C. et al., "Inert Gas Cutting of Thick-Section Stainless Steel and Medium Section Aluminun Using a High Power Fiber Laser", *Journal of Chemical Physics*, vol. 116, No. 4, Jan. 22, 2002, pp. 154-161.
Wandera, C. et al., "Laser Power Requirement for Cutting of Thick-Section Steel and Effects of Processing Parameters on Mild Steel Cut Quality", a paper accepted for publication in the Proceedings IMechE Part B, *Journal of Engineering Manufacture*, vol. 225, 2011, 23 pages.
Wandera, C. et al., "Optimization of Parameters for Fiber Laser Cutting of 10mm Stainless Steel Plate", a paper for publication in the Proceeding IMechE Part B, *Journal of Engineering Manufacture*, vol. 225, 2011, 22 pages.
Wandera, C., "Performance of High Power Fibre Laser Cutting of Thick-Section Steel and Medium-Section Aluminium", a thesis for the degree of Doctor of Science (Technology) at , Lappeenranta University of Technology, Oct. 2010, 74 pages.
Wang, C. H., "Introduction to Fractures Mechanics", published by DSTO Aeronautical and Maritime Research Laboratory, Jul. 1996, 82 pages.
Wang, G. et al., "Particle Modeling Simulation of Thermal Effects on Ore Breakage", *Computational Materials Science*, vol. 43, 2008, pp. 892-901.
Waples, D. W. et al., "A Review and Evaluation of Specific Heat Capacities of Rocks, Minerals, and Subsurface Fluids. Part 1: Minerals and NonporoRocks", *Natural Resources Research*, vol. 13, No. 2, Jun. 2004, pp. 97-122.

(56) References Cited

OTHER PUBLICATIONS

Waples, D. W. et al., "A Review and Evaluation of Specific Heat Capacities of Rocks, Minerals, and Subsurface Fluids. Part 2: Fluids and PoroRocks", *Natural Resources Research*, vol. 13 No. 2, Jun. 2004, pp. 123-130.
Warren, T. M. et al., "Laboratory Drilling Performance of PDC Bits", *SPE Drilling Engineering*, Jun. 1988, pp. 125-135.
Wen-gui, Cao et al., "Damage constituitive model for strain-softening rock based on normal distribution and its parameter determination", *J. Cent. South Univ. Technol.*, vol. 14, No. 5, 2007, pp. 719-724.
White, E. J. et al., "Reservoir Rock Characteristics of the Madison Limestone in the Williston Basin", *The Log Analyst*, Sep.-Oct. 1970, pp. 17-25.
White, E. J. et al., "Rock Matrix Properties of the Ratcliffe Interval (Madison Limestone) Flat Lake Field, Montana", *SPE of AIME*, Jun. 1968, 16 pages.
Wiercigroch, M., "Dynamics of ultrasonic percussive drilling of hard rocks", *Journal of Sound and Vibration*, vol. 280, 2005, pp. 739-757.
Wilkinson, M. A. et al., "Experimental Measurement of Surface Temperatures During Flame-Jet Induced Thermal Spallation", *Rock Mechanics and Rock Engineering*, 1993, pp. 29-62.
Williams, R. E. et al., "Experiments in Thermal Spallation of VarioRocks", *Transactions of the ASME*, vol. 118, 1996, pp. 2-8.
Willis, David A. et al., "Heat transfer and phase change during picosecond laser ablation of nickel", *International Journal of Heat and Mass Transfer*, vol. 45, 2002, pp. 3911-3918.
Winters, W. J. et al., "Roller Bit Model with Rock Ductility and Cone Offset", a paper prepared for presentation at 62nd Annual Technical Conference and Exhibition of the Society of Petroleum Engineers, Sep. 1987, 12 pages.
Wippich, M. et al., "Tunable Lasers and Fiber-Bragg-Grating Sensors", Obatined from the at: from the Internet website of The Industrial Physicist at: http://www.aip.org/tip/INPHFA/vol-9/iss-3/p24.html, on May 18, 2010, pp. 1-5.
Wong, Teng-fong et al., "Microcrack statistics, Weibull distribution and micromechanical modeling of compressive failure in rock", *Mechanics of Materials*, vol. 38, 2006, pp. 664-681.
Wood, Tom, "Dual Purpose COTD™ Rigs Establish New Operational Records", Treme Coil Drilling Corp., *Drilling Technology Without Borders*, 2009, pp. 1-18.
Wu, X. Y. et al., "The Effects of Thermal Softening and Heat Conductin on the Dynamic Growth of Voids", *International Journal of Solids and Structures*, vol. 40, 2003, pp. 4461-4478.
Xia, K. et al., "Effects of microstructures on dynamic compression of Barre granite", *International Journal of Rock Mechanics and Mining Sciences*, vol. 45, 2008. pp. 879-887, available at: www.sciencedirect.com.
Xiao, J. Q. et al., "Inverted S-Shaped Model for Nonlinear Fatigue Damage of Rock", *International Journal of Rock Mechanics & Mining Sciences*, vol. 46, 2009, pp. 643-648.
Xu, Z et al. "Modeling of Laser Spallation Drilling of Rocks fro gas-and Oilwell Drilling", *Society of Petroleum Engineers*, SPE 95746, 2005, pp. 1-6.
Xu, Z. et al., "Application of High Powered Lasers to Perforated Completions", *International Congress on Applications of Laser & Electro-Optics*, Oct. 2003, 6 pages.
Xu, Z. et al., "Laser Rock Drilling by a Super-Pulsed CO2 Laser Beam", a manuscript created for the Department of Energy, while the date of the publication is unknown, it is believed to be prior to Aug. 19, 2009, 9 pages.
Xu, Z. et al., "Laser Spallation of Rocks for Oil Well Drilling", Proceedings of the 23rd International Congress on Applications of Lasers and Electro-Optics, 2004, pp. 1-6.
Xu, Z. et al., "Modeling of Laser Spallation Drilling of Rocks for Gas-and Oilwell Drilling", a paper prepared for the presentation at the 2005 SPE (Society of Petroleum Engineers) Annual Technical Conference and Exhibition, Oct. 2005, 6 pages.
Xu, Z. et al., "Rock Perforation by Pulsed Nd: YAG Laser", Proceedings of the 23rd International Congress on Applications of Lasers and Electro-Optics 2004, 2004, 5 pages.
Xu, Z. et al., "Specific Energy of Pulsed Laser Rock Drilling", *Journal of Laser Applications*, vol. 15, No. 1, Feb. 2003, pp. 25-30.
Xu, Z. et al., "Specific Energy for Laser Removal of Rocks", *Proceedings of the 20th International Congress on Applications of Lasers & Electro-Optics*, 2001, pp. 1-8.
Xu, Z. et al., "Specific energy for pulsed laser rock drilling", *Journal of Laser Applications*, vol. 15, No. 1, 2003, pp. 25-30.
Xu, Zhiyue et al., "Laser Spallation of Rocks for Oil Well Drilling", *Proceedings of the 23rd International Congress on Applications of Lasers and Electro-Optics*, 2004, pp. 1-6.
Yabe, T. et al., "The Constrained Interpolation Profile Method for Multiphase Analysis", *Journal of Computational Physics*, vol. 169, 2001, pp. 556-593.
Yamamoto, K. Y. et al., "Detection of Metals in the Environment Using a Portable Laser-Induced Breakdown Spectroscopy Instrument", *Applied Spectroscopy*, vol. 50, No. 2, 1996, pp. 222-233.
Yamashita, Y. et al., "Underwater Laser Welding by 4kW CW YAG Laser", *Journal of Nuclear Science and Technology*, vol. 38, No. 10, Oct. 2001, pp. 891-895.
Yamshchikov, V. S. et al., "An Evaluation of the Microcrack Density of Rocks by Ultrasonic Velocimetric Method", *Moscow Mining Institute. (Translated from Fiziko-Tekhnicheskie Problemy Razrabotki Poleznykh Iskopaemykh)*, 1985, pp. 363-366.
Yasar, E. et al., "Determination of the Thermal Conductivity from Physico-Mechanical Properties", *Bull Eng. Geol. Environ.*, vol. 67, 2008, pp. 219-225.
Yilbas, B. S. et al., "Laser short pulse heating: Influence of pulse intensity on temperature and stress fields", *Applied Surface Science*, vol. 252, 2006, pp. 8428-8437.
Yilbas, B. S. et al., "Laser treatment of aluminum surface: Analysis of thermal stress field in the irradiated región", *Journal of Materials Processing Technology*, vol. 209, 2009, pp. 77-88.
Yilbas, B. S. et al., "Nano-second laser pulse heating and assisting gas jet considerations", *International Journal of Machine Tools & Manufacture*, vol. 40, 2000, pp. 1023-1038.
Yilbas, B. S. et al., "Repetitive laser pulse heating with a convective boundary condition at the surface", *Journal of Physics D: Applied Physics*, vol. 34, 2001, pp. 222-231.
York, J. L. et al., "The Influence of Flashing and Cavitation on Spray Formation", a progress report for UMRI Project 2815 with Delavan Manufacturing Company, Oct. 1959, 27 pages.
Yun, Yingwei et al., "Thermal Stress Distribution in Thick Wall Cylinder Under Thermal Shock", *Journal of Pressure Vessel Technology, Transactions of the ASME*, 2009, vol. 131, pp. 1-6.
Zamora, M. et al., "An Empirical Relationship Between Thermal Conductivity and Elastic Wave Velocities in Sandstone", *Geophysical Research Letters*, vol. 20, No. 16, Aug. 20, 1993, pp. 1679-1682.
Zehnder, A. T., "Lecture Notes on Fracture Mechanics", 2007, 227 pages.
Zeng, Z. W. et al., "Experimental Determination of Geomechanical and Petrophysical Properties of Jackfork Sandstone—A Tight Gas Formation", a paper prepared for the presentation at the 6th North American Rock Mechanics Symposium (NARMS): *Rock Mechanics Across Borders and Disciplines*, Jun. 2004, 9 pages.
Zeuch, D. H. et al., "Rock Breakage Mechanisms With a PDC Cutter", a paper prepared for presentation at the 60th Annual Technical Conference and Exhibition of the Society of Petroleum Engineers, Sep. 1985, 12 pages.
Zeuch, D.H. et al., "Rock Breakage Mechanism Wirt a PDC Cutter", *Society of Petroleum Engineers, 60th Annual Technical Conference*, Las Vegas, Sep. 22-25, 1985, 11 pgs.
Zhai, Yue et al., "Dynamic failure analysis on granite under uniaxial impact compressive load", *Front. Archit. Civ. Eng. China*, vol. 2, No. 3, 2008, pp. 253-260.
Zhang, L. et al., "Energy from Abandoned Oil and Gas Reservoirs", a paper prepared for presentation at the 2008 SPE (Society of Petroleum Engineers) Asia Pacific Oil & Gas Conference and Exhibition, 2008, pp. 1-10.

(56) References Cited

OTHER PUBLICATIONS

Zheleznov, D. S. et al., "Faraday Rotators With Short Magneto-Optical Elements for 50-kW Laser Power", *IEEE Journal of Quantum Electronics*, vol. 43, No. 6, Jun. 2007, pp. 451-457.
Zhou, T. et al., "Analysis of Stimulated Brillouin Scattering in Multi-Mode Fiber by Numerical Solution", *Journal of Zhejiang University of Science*, vol. 4 No. 3, May-Jun. 2003, pp. 254-257.
Zhou, X.P., "Microcrack Interaction Brittle Rock Subjected to Uniaxial Tensile Loads", *Theoretical and Applied Fracture Mechanics*, vol. 47, 2007, pp. 68-76.
Zhou, Zehua et al., "A New Thermal-Shock-Resistance Model for Ceramics: Establishment and validation", *Materials Science and Engineering*, A 405, 2005, pp. 272-276.
Zhu, Dongming et al., "Influence of High Cycle Thermal Loads on Thermal Fatigue Behavior of Thick Thermal Barrier Coatings", *National Aeronautics and Space Administration, Army Research Laboratory*, Technical Report ARL-TR-1341, NASA TP-3676, 1997, pp. 1-50.
Zhu, Dongming et al., "Investigation of thermal fatigue behavior of thermal barrier coating systems", *Surface and Coatings Technology*, vol. 94-95, 1997, pp. 94-101.
Zhu, Dongming et al., "Investigation of Thermal High Cycle and Low Cycle Fatigue Mechanisms of Thick Thermal Barrier Coatings", *National Aeronautics and Space Administration, Lewis Research Center*, NASA/TM-1998-206633, 1998, pp. 1-31.
Zhu, Dongming et al., "Thermophysical and Thermomechanical Properties of Thermal Barrier Coating Systems", *National Aeronautics and Space Administration, Glenn Research Center*, NASA/TM-2000-210237, 2000, pp. 1-22.
Zhu, X. et al., "High-Power ZBLAN Glass Fiber Lasers: Review and Prospect", *Advances in OptoElectronics*, vol. 2010, pp. 1-23.
Zietz, J. et al., "Determinants of House Prices: A Quantile Regression Approach", *Department of Economics and Finance Working Paper Series*, May 2007, 27 pages.
Zuckerman, N. et al., "Jet Impingement Heat Transfer: Physics, Correlations, and Numerical Modeling", *Advances in Heat Transfer*, vol. 39, 2006, pp. 565-631.
A Built-for-Purpose Coiled Tubing Rig, by Schulumberger Wells, No. DE-PS26-03NT15474, 2006, 1 pg.
"Chapter I—Laser-Assisted Rock-Cutting Tests", publisher unknown, while the date of the publication is unknown, it is believed to be prior to Aug. 19, 2009, 64 pages.
"Chapter 7: Energy Conversion Systems—Options and Issues", publisher unknown, while the date of the publication is unknown, it is believed to be prior to Aug. 19, 2009, pp. 7-1 to 7-32 and table of contents page.
"Cross Process Innovations", Obtained from the Internet at: http://www.mrl.columbia.edu/ntm/CrossProcess/CrossProcessSect5.htm, on Feb. 2, 2010, 11 pages.
"Fourier Series, Generalized Functions, Laplace Transform", publisher unknown, while the date of the publication is unknown, it is believed to be prior to Aug. 19, 2009, 6 pages.
"Introduction to Optical Liquids", published by Cargille-Sacher Laboratories Inc., Obtained from the Internet at: http://www.cargille.com/opticalintro.shtml, on Dec. 23, 2008, 5 pages.
"Laser Drilling", Oil & Natural Gas Projects (Exploration & Production Technologies) Technical Paper, Dept. of Energy, Jul. 2007, 3 pages.
"Leaders in Industry Luncheon", IPAA & TIPRO, Jul. 8, 2009, 19 pages.
"Measurement and Control of Abrasive Water-Jet Velocity", publisher unknown, while the date of the publication is unknown, it is believed to be prior to Aug. 19, 2009, 8 pages.
"NonhomogeneoPDE—Heat Equation with a Forcing Term", a lecture, 2010, 6 pages.
"Performance Indicators for Geothermal Power Plants", prepared by International Geothermal Association for World Energy Council Working Group on Performance of Renewable Energy Plants, author unknown, Mar. 2011, 7 pages.
"Rock Mechanics and Rock Engineering", publisher unknown, while the date of the publication is unknown, it is believed to be prior to Aug. 19, 2009, 69 pages.
"Shock Tube", Cosmol MultiPhysics 3.5a, 2008, 5 pages.
"Silicone Fluids: Stable, Inert Media", Gelest, Inc., while the date of the publication is unknown, it is believed to be prior to Aug. 19, 2009, 27 pages.
"Stimulated Brillouin Scattering (SBS) in Optical Fibers", Centro de Pesquisa em Optica e Fotonica, Obtained from the Internet at: http://cepof.ifi.unicamp.br/index.php . . . ), on Jun. 25, 2012, 2 pages.
"Underwater Laser Cutting", TWI Ltd, May/Jun. 2011, 2 pages.
Utility U.S. Appl. No. 13/768,149, filed Feb. 15, 2013, 27 pages.
Utility U.S. Appl. No. 13/777,650, filed Feb. 26, 2013, 73 pages.
Utility U.S. Appl. No. 13/782,942, filed Mar. 1, 2013, 81 pages.
Utility U.S. Appl. No. 13/800,559, filed Mar. 13, 2013, 73 pages.
Utility U.S. Appl. No. 13/800,820, filed Mar. 13, 2013, 73 pages.
Utility U.S. Appl. No. 13/800,879, filed Mar. 13, 2013, 73 pages.
Utility U.S. Appl. No. 13/800,933, filed Mar. 13, 2013, 73 pages.
Utility U.S. Appl. No. 13/849,831, filed Mar. 25, 2013, 83 pages.
Daneshy, A., Jr. "Opening of a Pressurized Fracture in an Elastic Medium," Petroleum Society of CIM, Paper No. 7616, Jun. 1971, 17 pp.
Daneshy, A., "A Study of Inclined Hydraulic Fractures," Society of Petroleum Engineers Journal, SPE 4062, Apr. 1973, 8 pp.
Daneshy, A., "Experimental Investigation of Hydraulic Fracturing Through Perforations," Journal of Petroleum Technology, SPE 4333, Oct. 1973. 6 pp.
Daneshy, A., "True and Apparent Direction of Hydraulic Fracture" American Institute Mining, Metallurgical, and Petroleum Engineers, Inc., SPE 3226, 1971, 15 pp.
Van De Ketterij, R.G., "Experimental Study on the Impact of Perforations on Hydraulic Fracture Tortuosity," Society of Petroleum Engineers, Inc., SPE 38149, 1997, 9 pp.
Van De Ketterij, R.G., "Impact of Perforations on Hydraulic Fracture Tortuosity," SPE Prod. & Facilities, 14 (2), May 1999, 8 pages.
Pearson, C.M., "Results of Stress-Oriented and Aligned Perforating in Fracturing Deviated Wells," JPT, Jan. 1992. 9 pp.
Warpinski, Norman R., "Laboratory Investigation on the Effect of In-Situ Stresses on Hydraulic Fracture Containment," Society of Petroleum Engineers of AIME, Jun. 1982, 8 pp.
Weng, Xiaowei, "Fracture initiation and Propagation From Deviated Wellbores," Society of Petroleum Engineers, SPE 26597, 1993, 16 pp.
Teufel, Lawrence, W., "Hydraulic Fracture Propagation in Layered Rock: Experimental Studies of Fracture Containment," Society of Petroleum Engineers of AIME, Feb. 1984 14 pages.
Warpinski, N.R., "influence of Geologic Discontinuities on Hydraulic Fracture Propagation," Journal of Petroleum Technology, Feb. 1987, 14 pages.

* cited by examiner

HIGH POWER LASER PERFORATING AND LASER FRACTURING TOOLS AND METHODS OF USE

This application: (i) claims, under 35 U.S.C. §119(e)(1), the benefit of the filing date of March 1, 2012 of provisional application serial number 61/605,429; (ii) claims, under 35 U.S.C. §119(e)(1), the benefit of the filing date of November 15, 2012 of provisional application serial number 61/727,096; (iii) is a continuation-in-part of US patent application serial number 13/222,931, which claims, under 35 U.S.C. §119(e)(1), the benefit of the filing date of Aug. 31, 2010 of provisional application Ser. No. 61/378,910; and, (iv) is a continuation-in-part of Ser. No. 12/543,986, which claims, under 35 U.S.C. §119(e)(1), the benefit of the filing date of Aug. 20, 2008 of provisional application Ser. No. 61/090,384, the entire disclosures of each of which are incorporated herein by reference.

BACKGROUND OF THE INVENTION

Field of the Invention

The present inventions relate to high power laser tools for perforating, fracturing, and opening, increasing and enhancing the flow of energy sources, such as hydrocarbons and geothermal, from a formation into a production tubing or collection system. In addition to improved performance and safety over conventional explosive based perforating guns, the present inventions provide for the precise and predetermined placement of laser beam energy, e.g., custom geometries, in precise and predetermined energy distribution patterns. These patterns can be tailored and customized to the particular geological and structural features of a formation and pay zone. Unlike explosive perforating tools, the laser beam and laser perforating process can be controlled or operated in a manner that maintains and enhances the porosity, openness and structure of the inner surface of the perforation.

As used herein, unless specified otherwise "high power laser energy" means a laser beam having at least about 1 kW (kilowatt) of power. As used herein, unless specified otherwise "great distances" means at least about 500 m (meter). As used herein, unless specified otherwise, the term "substantial loss of power," "substantial power loss" and similar such phrases, mean a loss of power of more than about 3.0 dB/km (decibel/kilometer) for a selected wavelength. As used herein the term "substantial power transmission" means at least about 50% transmittance.

As used herein, unless specified otherwise, "optical connector", "fiber optics connector", "connector" and similar terms should be given their broadest possible meanings and include any component from which a laser beam is or can be propagated, any component into which a laser beam can be propagated, and any component that propagates, receives or both a laser beam in relation to, e.g., free space, (which would include a vacuum, a gas, a liquid, a foam and other non-optical component materials), an optical component, a wave guide, a fiber, and combinations of the forgoing.

As used herein, unless specified otherwise, the term "earth" should be given its broadest possible meaning, and includes, the ground, all natural materials, such as rocks, and artificial materials, such as concrete, that are or may be found in the ground, including without limitation rock layer formations, such as, granite, basalt, sandstone, dolomite, sand, salt, limestone, rhyolite, quartzite and shale rock.

As used herein, unless specified otherwise, the term "borehole" should be given it broadest possible meaning and includes any opening that is created in a material, a work piece, a surface, the earth, a structure (e.g., building, protected military installation, nuclear plant, offshore platform, or ship), or in a structure in the ground, (e.g., foundation, roadway, airstrip, cave or subterranean structure) that is substantially longer than it is wide, such as a well, a well bore, a well hole, a micro hole, slimhole and other terms commonly used or known in the arts to define these types of narrow long passages. Wells would further include exploratory, production, abandoned, reentered, reworked, and injection wells, and cased and uncased or open holes. Although boreholes are generally oriented substantially vertically, they may also be oriented on an angle from vertical, to and including horizontal. Thus, using a vertical line, based upon a level as a reference point, a borehole can have orientations ranging from 0° i.e., vertical, to 90°,i.e., horizontal and greater than 90° e.g., such as a heel and toe, and combinations of these such as for example "U" and "Y" shapes. Boreholes may further have segments or sections that have different orientations, they may have straight sections and arcuate sections and combinations thereof; and for example may be of the shapes commonly found when directional drilling is employed. Thus, as used herein unless expressly provided otherwise, the "bottom" of a borehole, the "bottom surface" of the borehole and similar terms refer to the end of the borehole, i.e., that portion of the borehole furthest along the path of the borehole from the borehole's opening, the surface of the earth, or the borehole's beginning. The terms "side" and "wall" of a borehole should to be given their broadest possible meaning and include the longitudinal surfaces of the borehole, whether or not casing or a liner is present, as such, these terms would include the sides of an open borehole or the sides of the casing that has been positioned within a borehole. Boreholes may be made up of a single passage, multiple passages, connected passages and combinations thereof, in a situation where multiple boreholes are connected or interconnected each borehole would have a borehole bottom. Boreholes may be formed in the sea floor, under bodies of water, on land, in ice formations, or in other locations and settings.

Boreholes are generally formed and advanced by using mechanical drilling equipment having a rotating drilling tool, e.g., a bit. For example and in general, when creating a borehole in the earth, a drilling bit is extending to and into the earth and rotated to create a hole in the earth. In general, to perform the drilling operation the bit must be forced against the material to be removed with a sufficient force to exceed the shear strength, compressive strength or combinations thereof, of that material. Thus, in conventional drilling activity mechanical forces exceeding these strengths of the rock or earth must be applied. The material that is cut from the earth is generally known as cuttings, e.g., waste, which may be chips of rock, dust, rock fibers and other types of materials and structures that may be created by the bit's interactions with the earth. These cuttings are typically removed from the borehole by the use of fluids, which fluids can be liquids, foams or gases, or other materials know to the art.

As used herein, unless specified otherwise, the term "advancing" a borehole should be given its broadest possible meaning and includes increasing the length of the borehole. Thus, by advancing a borehole, provided the orientation is less than 90° the depth of the borehole may also increased. The true vertical depth ("TVD") of a borehole is the distance from the top or surface of the borehole to the depth at which the bottom of the borehole is located, measured along a straight vertical line. The measured depth ("MD") of a borehole is the distance as measured along the actual path of the borehole from the top or surface to the bottom. As used herein unless specified otherwise the term depth of a borehole will refer to MD. In general, a point of reference may be used for the top of the borehole, such as the rotary table, drill floor, well head or initial opening or surface of the structure in which the borehole is placed.

As used herein, unless specified otherwise, the term "drill pipe" is to be given its broadest possible meaning and includes all forms of pipe used for drilling activities; and refers to a single section or piece of pipe. As used herein the terms "stand of drill pipe," "drill pipe stand," "stand of pipe," "stand" and similar type terms should be given their broadest possible meaning and include two, three or four sections of drill pipe that have been connected, e.g., joined together, typically by joints having threaded connections. As used herein the terms "drill string," "string," "string of drill pipe," string of pipe" and similar type terms should be given their broadest definition and would include a stand or stands joined together for the purpose of being employed in a borehole. Thus, a drill string could include many stands and many hundreds of sections of drill pipe.

As used herein, unless specified otherwise, the term "tubular" is to be given its broadest possible meaning and includes drill pipe, casing, riser, coiled tube, composite tube, vacuum insulated tubing ("VIT), production tubing and any similar structures having at least one channel therein that are, or could be used, in the drilling industry. As used herein the term "joint" is to be given its broadest possible meaning and includes all types of devices, systems, methods, structures and components used to connect tubulars together, such as for example, threaded pipe joints and bolted flanges. For drill pipe joints, the joint section typically has a thicker wall than the rest of the drill pipe. As used herein the thickness of the wall of tubular is the thickness of the material between the internal diameter of the tubular and the external diameter of the tubular.

As used herein, unless specified otherwise, the terms "blowout preventer," "BOP," and "BOP stack" should be given their broadest possible meanings, and include: (i) devices positioned at or near the borehole surface, e.g., the surface of the earth including dry land or the seafloor, which are used to contain or manage pressures or flows associated with a borehole; (ii) devices for containing or managing pressures or flows in a borehole that are associated with a subsea riser or a connector; (iii) devices having any number and combination of gates, valves or elastomeric packers for controlling or managing borehole pressures or flows; (iv) a subsea BOP stack, which stack could contain, for example, ram shears, pipe rams, blind rams and annular preventers; and, (v) other such similar combinations and assemblies of flow and pressure management devices to control borehole pressures, flows or both and, in particular, to control or manage emergency flow or pressure situations.

As used herein, unless specified otherwise, the terms "removal of material," "removing material," "remove" and similar such terms should be given their broadest possible meanings. Thus, such terms would include melting, flowing, vaporization, softening, laser induced break down, ablation; as well as, combinations and variations of these, and other processes and phenomena that can occur when directed energy from a laser beam is delivered to a material, object or work surface. Such terms would further include combinations of the forgoing laser induced processes and phenomena with the energy that the fluid jet imparts to the material to be cut. Moreover, irrespective of the processes or phenomena taking place, such terms would include the lessening, opening, cutting, severing or sectioning of the material, object or targeted structure.

As used herein, unless specified otherwise, the terms "workover," "completion" and "workover and completion" and similar such terms should be given their broadest possible meanings and would include activities that place at or near the completion of drilling a well, activities that take place at or the near the commencement of production from the well, activities that take place on the well when the well is a producing or operating well, activities that take place to reopen or reenter an abandoned or plugged well or branch of a well, and would also include for example, perforating, cementing, acidizing, fracturing, pressure testing, the removal of well debris, removal of plugs, insertion or replacement of production tubing, forming windows in casing to drill or complete lateral or branch wellbores, cutting and milling operations in general, insertion of screens, stimulating, cleaning, testing, analyzing and other such activities. These terms would further include applying heat, directed energy, preferably in the form of a high power laser beam to heat, melt, soften, activate, vaporize, disengage, desiccate and combinations and variations of these, materials in a well, or other structure, to remove, assist in their removal, cleanout, condition and combinations and variation of these, such materials.

As used herein, unless specified otherwise, the terms "conveyance structure", "umbilical", "line structure" and similar such terms should be given their broadest possible meanings and may be, contain or be optically or mechanically associated with: a single high power optical fiber; a single high power optical fiber that has shielding; i a single high power optical fiber that has multiple layers of shielding; two, three or more high power optical fibers that are surrounded by a single protective layer, and each fiber may additionally have its own protective layer; a fiber support structure which may be integral with or releasable or fixedly attached to an optical fiber (e.g., a shielded optical fiber is clipped to the exterior of a metal cable and lowered by the cable into a borehole); other conduits such as a conduit to carry materials to assist a laser cutter, for example gas, air, nitrogen, oxygen, inert gases; other optical fibers or metal wires for the transmission of data and control information and signals; and any combinations and variations thereof.

The conveyance structure transmits high power laser energy from the laser to a location where high power laser energy is to be utilized or a high power laser activity is to be performed by, for example, a high power laser tool. The conveyance structure may, and preferably in some applications does, also serve as a conveyance device for the high power laser tool. The conveyance structure's design or configuration may range from a single optical fiber, to a simple to complex arrangement of fibers, support cables, shielding on other structures, depending upon such factors as the environmental conditions of use, performance requirements for the laser process, safety requirements, tool requirements both laser and non-laser support materials, tool function(s), power requirements, information and data gathering and transmitting requirements, control requirements, and combinations and variations of these.

Preferably, the conveyance structure may be coiled tubing, a tube within the coiled tubing, jointed drill pipe, jointed drill pipe having a pipe within a pipe, or may be any other type of line structure, that has a high power optical fiber associated with it. As used herein the term "line structure" should be given its broadest meaning, unless specifically stated otherwise, and would include without limitation: wireline; coiled tubing; slick line; logging cable; cable structures used for completion, workover, drilling, seismic, sensing, and logging; cable structures used for subsea completion and other subsea activities; umbilicals; cables structures used for scale removal, wax removal, pipe cleaning, casing cleaning, cleaning of other tubulars; cables used for ROV control power and data transmission; lines structures made from steel, wire and composite materials, such as carbon fiber, wire and mesh; line structures used for monitoring and evaluating pipeline and boreholes; and would include without limitation such structures as Power & Data Composite Coiled Tubing (PDT-COIL) and structures such as Smart Pipe® and FLATpak®.

Drilling Wells and Perforating Activities

Typically, and by way of general illustration, in drilling a well an initial borehole is made into the earth or seabed and then subsequent and smaller diameter boreholes are drilled to extend the overall depth of the borehole. Thus, as the overall borehole gets deeper its diameter becomes smaller; resulting in what can be envisioned as a telescoping assembly of holes with the largest diameter hole being at the top of the borehole closest to the surface of the earth.

Thus, by way of example, the starting phases of a subsea drill process may be explained in general as follows. Once the drilling rig is positioned on the surface of the water over the area where drilling is to take place, an initial borehole is made by drilling a 36" hole in the earth to a depth of about 200-300 ft. below the seafloor. A 30" casing is inserted into this initial borehole. This 30" casing may also be called a conductor. The 30" conductor may or may not be cemented into place. During this drilling operation a riser is generally not used and the cuttings from the borehole, e.g., the earth and other material removed from the borehole by the drilling activity, are returned to the seafloor. Next, a 26" diameter borehole is drilled within the 30" casing, extending the depth of the borehole to about 1,000-1,500 ft. This drilling operation may also be conducted without using a riser. A 20" casing is then inserted into the 30" conductor and 26" borehole. This 20" casing is cemented into place. The 20" casing has a wellhead secured to it. (In other operations an additional smaller diameter borehole may be drilled, and a smaller diameter casing inserted into that borehole with the wellhead being secured to that smaller diameter casing.) A BOP is then secured to a riser and lowered by the riser to the sea floor; where the BOP is secured to the wellhead. From this point forward all drilling activity in the borehole takes place through the riser and the BOP.

For a land based drill process, the steps are similar, although the large diameter tubulars, 30"-20" are typically not used. Thus, and generally, there is a surface casing that is typically about 13⅜" diameter. This may extend from the surface, e.g., wellhead and BOP, to depths of tens of feet to hundreds of feet. One of the purposes of the surface casing is to meet environmental concerns in protecting ground water. The surface casing should have sufficiently large diameter to allow the drill string, product equipment such as ESPs and circulation mud to pass by. Below the casing one or more different diameter intermediate casings may be used. (It is understood that sections of a borehole may not be cased, which sections are referred to as open hole.) These can have diameters in the range of about 9" to about 7", although larger and smaller sizes may be used, and can extend to depths of thousands and tens of thousands of feet. Inside of the casing and extending from a pay zone, or production zone of the bore hole up to and through the wellhead on the surface is the production tubing. There may be a single production tubing or multiple production tubings in a single borehole, with each of the production tubing ending at different depths.

Typically, when completing a well, it is necessary to perform a perforation operation, and also in some instances perform a hydraulic fracturing, or fracing operation. In general, when a well has been drilled casing, i.e., a metal pipe, and typically cement placed between the casing and the earth, i.e., the formation, prevents the earth from falling back into the hole. (In some situations only the metal casing is present, in others there may be two metal casing present one inside of the other, in still others the metal casing and cement are present, and in others there could be other configurations of metal, cement and metal.) Thus, this casing forms a structural support for the well and a barrier to the earth.

While important for the structural integrity of the well, the casing and cement present a problem when they are in the production zone. Thus, in addition to holding back the earth, they also prevent the hydrocarbons from flowing into the well and from being recovered. Additionally, the formation itself may have been damaged by the drilling process, e.g., by the pressure from the drilling mud, and this damaged area of the formation may form an additional barrier to the flow of hydrocarbons into the well. Similarly, in most situations where casing is not needed in the production area, the formation itself is very tight and will not permit the hydrocarbons to flow into the well. (In some situations the formation pressure is large enough that the hydrocarbons readily flow into the well in an uncased, or open hole. Nevertheless, as formation pressure lessens a point will be reached where the formation itself shuts-off, or significantly reduces, the flow of hydrocarbons into the well.)

To overcome this problem of the flow of hydrocarbons into the well being blocked by the casing, cement and the formation itself, perforations are made in the well in the area of the pay zone. A perforation is a small, about ¼ "to about 1" or 2" in diameter hole that extends through the casing, cement and damaged formation and goes into the formation. This hole creates a passage for the hydrocarbons to flow from the formation into the well. In a typical well a large number of these holes are made through the casing and into the formation in the pay zone.

Generally, in a perforating operation a perforating tool or gun is lowered into borehole to the location where the production zone or pay zone is located. The perforating gun is a long, typically round tool, that has a small enough diameter to fit into the casing and reach the area within the borehole where the production zone is believed to be. Once positioned in the production zone a series of explosive charges, e.g., shaped charges, are ignited. The hot gases and molten metal from the explosion cut a hole, i.e., the pert or perforation, through the casing and into the formation. These explosive made perforation, may only extend a few inches, e.g., 6" into the formation. In hard rock formations the explosive perforation device may only extend an inch or so, and may function poorly, if at all. Additionally, because these perforations are made with explosives they typically have damages areas, which include, loose rock and perforation debris along the bottom of the hole; and a damaged zone extending annularly around the hole. Beyond the damaged zone is a virgin zone extending annularly around the damage zone. The damage zone, which typically encompasses the entire hole generally greatly reduces the permeability of the formation. This has been a long standing, and unsolved problem in the use of explosive perforations. The perforation holes are made to get through one group of obstructions to the flow of hydrocarbons into the well, e.g., the casing, and in doing so they create a new group of these obstructions, e.g., the damage area encompassing the perforation holes.

Generally, in a hydraulic fracturing operation once the perforations have been made a mixture of typically a water based fluid with sand or other small particles is forced into the well, into the perforations and out into the formation. For example, for a single well 3-5 million gallons of water may be used and pressures may be in the range of about 500 psi to 2,000 psi and can go as high as 3,000 psi and potentially higher. As the water and sand are forced into the formation under these very high pressures, they cause the rock to break at weak points in the formation. These breaks usually occur along planes of weakness and are called joints. Naturally occurring joints in the formation may also be further separated, e.g., expanded, and propagated, e.g., lengthened, by the water pressure. In order the keep these newly formed and enlarged joints open, once the pressure and water are removed, the sand or propants, are left behind. They in essence hold open, i.e., prop open, the newly formed and enlarged joints in the formation.

Additionally, hydraulic fracturing has come under public and consequentially regulatory scrutiny for environmental reasons. This scrutiny has looked to such factors as: the large amounts of water used; the large amounts of vehicles, roads and other infrastructure needed to perform a fracturing operation; potential risks to ground water; potential risks of seismic activities; and potential risks from additives to the water, among other things.

SUMMARY

In the acquisition of energy sources, such as oil and natural gas, there exists a long felt need to have safe, controllable and predictable ways to establish and enhance fluid communication between the hydrocarbon reservoir in the formation and the well bore. Incremental improvements in explosive perforating guns and techniques have not met these long felt needs. It is the present inventions, among other things, that solve these needs by providing the articles of manufacture, devices and processes taught herein.

Thus, there is provided herein a method of enhancing fluid communication between a borehole and a hydrocarbon reservoir in a formation, the method including: obtaining data about the geological properties of a formation containing a hydrocarbon reservoir; inserting a high power laser tool into a borehole, and advancing the laser tool to a predetermined location within the borehole; placing the laser tool in optical and control communication with a high power laser delivery system; based, at least in part, on the formation data, determining a laser energy delivery pattern; wherein, the laser energy delivery pattern comprises a plurality of laser perforations for predetermined locations in the formation; and, the laser delivery system and laser tool delivering the laser energy delivery pattern to the predetermined location within the borehole; whereby, the laser energy creates a custom geometry in the formation enhancing fluid communication between the borehole and the hydrocarbon reservoir.

Additionally, there is provided a method of doing a laser enhanced hydraulic fracturing operation to enhance fluid communication between a borehole and a hydrocarbon reservoir in a formation, the method including: obtaining data about the geological properties of a formation containing a hydrocarbon reservoir; obtaining a hydraulic fracturing plan for the formation; inserting a high power laser tool into a borehole, and advancing the laser tool to a predetermined location within the borehole; placing the laser tool in optical and control communication with a high power laser delivery system; based, at least in part, on the formation data and the hydraulic fracturing plan, determining a laser energy delivery pattern; wherein, the laser pattern comprises a plurality of laser perforations for predetermined locations in the formation; the laser delivery system and laser tool delivering the laser pattern to the predetermined location within the borehole; and, hydraulic fracturing the formation based at least in part upon the hydraulic fracturing plan; whereby, the laser energy creates a custom geometry in the formation enhancing the hydraulic fracturing of the formation and thereby enhancing the fluid communication between the borehole and the hydrocarbon reservoir in the formation. This method may further include the hydraulic fracturing plan being based at least in part upon the custom geometry.

Further, there is further provided high power laser perforation methods that may include one of more of: a total internal reflection prism; at least one laser perforation extending at least about 3 inches from the borehole side wall; at least one laser perforation extending at least about 10 inches from the borehole side wall; at least one laser perforation extends at least about 20 inches from the borehole side wall; the laser tool having a Risley prism; the having a passive vertical position determining sub; the laser tool comprises an angled fluid jet intersecting a laser beam path; having at least about 50 perforations; having a pie shaped perforation.

DESCRIPTION OF THE PREFERRED EMBODIMENTS

In general, the present inventions relate to systems, methods and tools to establish and enhance fluid communication between the hydrocarbon reservoir in the formation and the well bore. In particular, the present inventions relate to high power laser tools for perforating, fracturing, and opening, increasing and enhancing the flow of energy sources, such as hydrocarbons and geothermal, from a formation into a production tubing or collection system. The present inventions provided improved performance and safety over conventional explosive based perforating guns, as well as providing for the precise and predetermined placement of laser beam energy, in precise and predetermined energy distribution patterns. These patterns can be tailored and customized to the particular geological and structural features of a formation and pay zone; thus giving rise to never before seen customization of perforating and fracturing patents to precisely match the formation.

In general, and by way of illustration, a laser perforating tool may have several components or sections. The tool may have a one or more of these and similar types of sections: a conveyance structure, a guide assembly, a cable head, a roller section, a casing collar locating section, a swivel, a LWD/MWD section, a vertical positioning section, a tractor, a packer or packer section, an alignment or orientation section, laser directing aiming section, and a laser head. These components or sections may be arranged in different orders and positions going from top to bottom of the tool. In general and unless specified otherwise, the bottom of the tool is that end which first enters the borehole and the top of the tool is that section which last enters the borehole and typically is attached to or first receives the conveyance structure. It is further understood that one component in the tool may perform the functions of two or more other components; that the functions of a single component may be performed by one two or more components; and combinations and variations of these.

Figure 1:
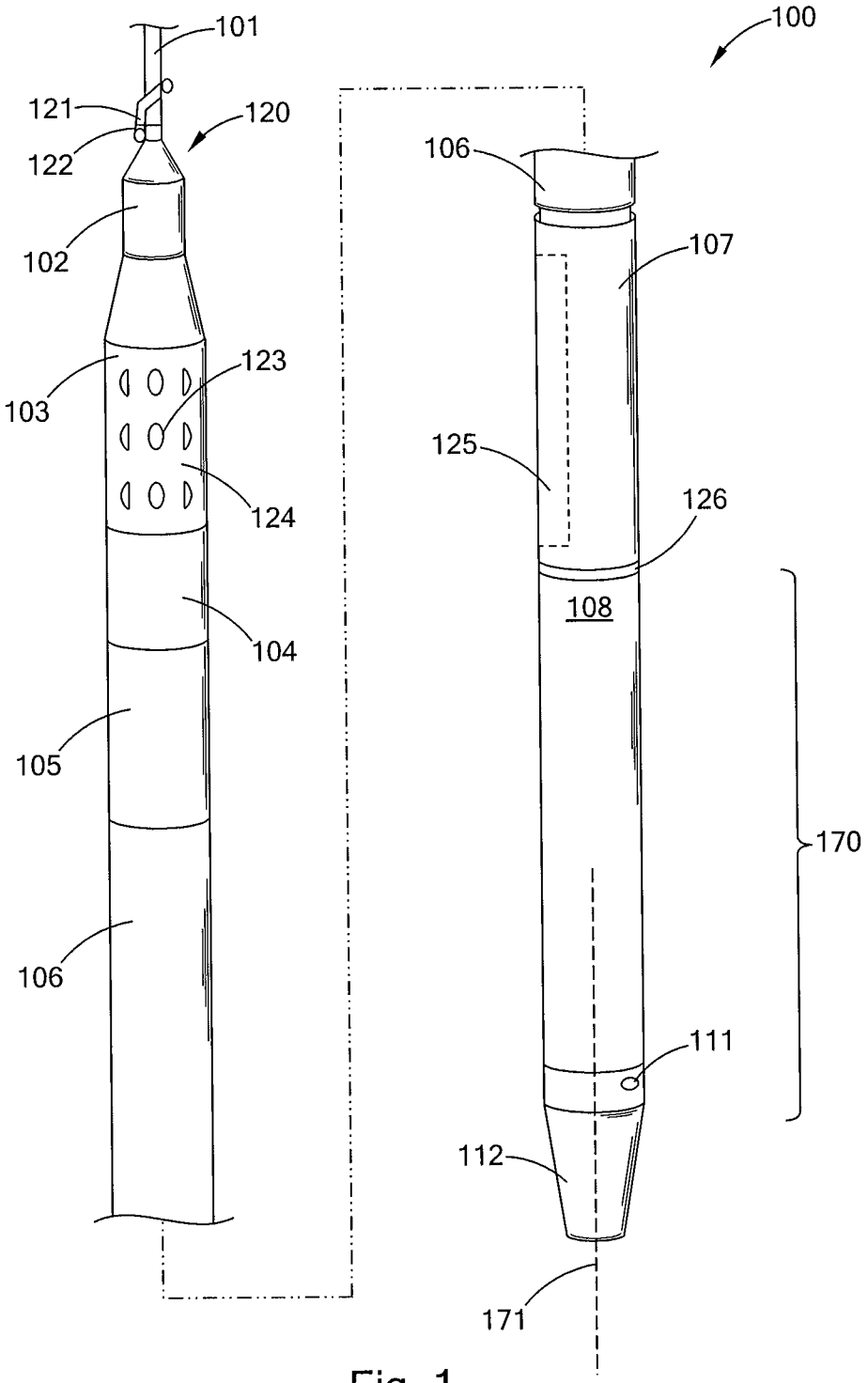
FIG. 1 is a perspective view of an embodiment of a laser perforating tool in accordance with the present inventions.

Turning to FIG. 1 there is provided a perspective view of an embodiment of a laser perforating tool with a conveyance structure attached. The laser perforating tool 100 contains several connectable and cooperatively operable subassemblies forming an elongated housing that may be joined together by threaded unions, or other connecting means know to the art, into an operable piece of equipment for use. At the top 120 of tool 100 is a conveyance structure 101, which is mounted with the tool 100 at a cable head 102. A guide assembly 121 is mounted around conveyance structure 101 immediately above cable head 102. Housing guide assembly 121 is freely rotatedly mounted around the conveyance structure 101 and provided with a roller or wheel and a sliding shoe or guide portion 122 which enables the tool to be pulled into a reduced diameter aperture such as when the tool is pulled from a lower portion of well casing through a bulkhead or the like into a shorter tubing string. Guide assembly 121 prevents the upper end portion of cable head 102 from becoming stuck or wedged against the obstruction created by a reduced diameter aperture within a well casing. Adjacent cable head 102 is upper roller assembly 103. Upper roller assembly 103 contains a number of individual rollers, e.g., 123 mounted in a space relation around and longitudinally along this section. Rollers 123 protrude from the outer surface 124 of the upper roller assembly housing in order to support the housing on the interior tubular surface presented by well casing and tubing. Rollers 123 in this roller assembly can be constructed with low friction bearings and/or materials so that rotation of the rollers requires very little force, other devices for reducing the force required for movement through the borehole, know to those of skill in the art may also be used. This construction assists in longitudinal movement of the housing through the tubing and casing of a well by significantly reducing the force required to accomplish such movement. Below upper roller assembly 103 is a connecting segment 104 which joins a casing collar locator 105. Casing collar locator 105 is used to locate the collars within a casing of a well. In perforating operations it is typical to locate several collars within a well in order to determine the exact position of the zone of interest that is to be perforated, other instruments and assemblies may also be used to make this determination.

With explosive perforation it was necessary or suggested to locate collars within the casing in order to position the explosive perforating tool such that it would not attempt to perforate the casing through a collar. The laser perforating tools have over come this problem and restriction. The laser beam and laser cutting heads can readily cut a perforation hole through a casing collar or joint of any size.

Immediately below casing collar locator 105 is a swivel sub 106. Swivel sub 106 is constructed with overlapping internal and external members that provide for a rigid longitudinal connection between upper and lower portions of the housing while at the same time providing for free rotational movement between adjoining upper and lower portions of the housing.

Immediately below swivel sub 106 in the housing is an eccentrically weighted sub 107, which provides for passive vertical orientation, positioning, of the laser sub assembly 170. Eccentric weight sub 107 contains a substantially dense weight, e.g., depleted uranium, that is positioned in an eccentric relation to the longitudinal axis of the housing. This eccentric weight 125 is illustrated in dashed lines in its eccentric position relative to the longitudinal axis of this sub. The position of eccentric weight 125 is on what will be referred to as the bottom portion of the housing and the laser sub 170. Due to the mass of weight 125 being selected as substantially larger than the mass of the adjacent portion of the apparatus housing this weight will cause the housing to rotate to an orientation placing weight 125 in a downwardly oriented direction. This is facilitated by the presence of swivel sub 106. Immediately below eccentric weight sub 107 is an alignment joint sub indicated at 126. Alignment joint 126 is used to correctly connect eccentric weight sub 107 with the laser sub 170 so that the bottom portion of the housing will be in alignment with the laser beam aiming and directing systems in the laser sub 170.

Laser sub assembly 170 contains several components within its housing 108. These components or assemblies would include controllers, circuitry, motors and sensors for operating and monitoring the delivery of the laser beam, an optics assembly for shaping and focusing the laser beam, a beam aiming and directing assembly for precisely directing the laser beam to a predetermined location within the borehole and in a predetermined orientation with respect to the axis 171 of the laser sub 170, the beam aiming and directing system may also contain a beam path verification system to make certain that the laser beam has a free path to the casing wall or structure to be perforated and does not inadvertently cut through a second string or other structure located within the casing, a laser cutting head which is operably associated with, or includes, in whole or in part, the optics assembly and the beam aiming and directing assembly components, a laser beam launch opening 111, and an end cone 112. The laser sub 170 may also contain a roller section or other section to assist in the movement of the tool through the borehole.

Subassemblies and systems for orienting a tool in a well may include for example, gravity based systems such as those disclosed and taught in U.S. Pat. Nos. 4,410,051, 4,637,478, 5,101,964, and 5,211,714, the entire disclosures of each of which are incorporated herein by reference, laser gyroscopes, gyroscopes, fiber gyros, fiber gravimeter, and other devices and system known to the art for deterring true vertical in a borehole.

Figure 1A:
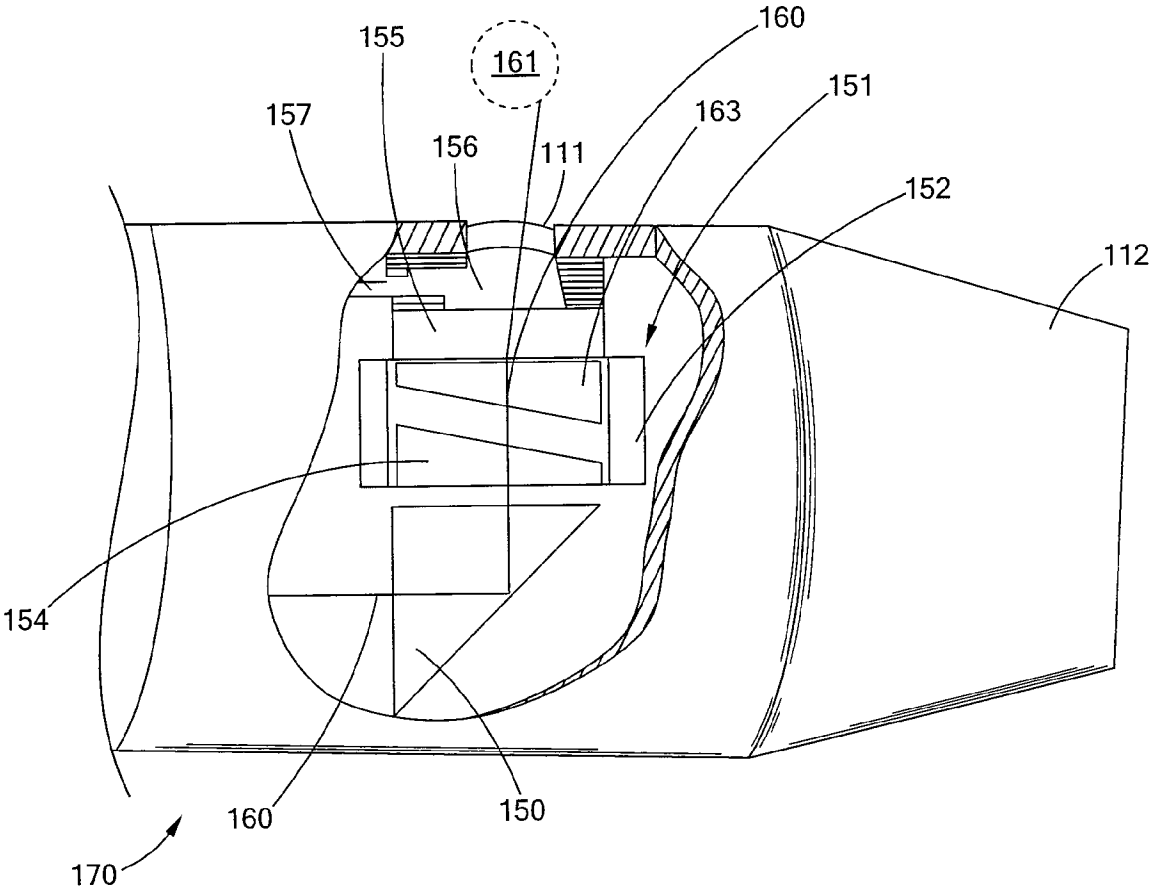
FIG. 1A is a cutaway perspective view of an embodiment of a laser perforating head in accordance with the present inventions.

Turning to FIG. 1A there is shown a cut away perspective view of the laser perforating sub assembly 170. The laser beam traveling along beam path 160, from optics assembly (not shown in the Figure) enters TIR prism 150 (Total internal reflection (TIR) prisms, and their use in high power laser tools is taught and disclosed in U.S. patent application Ser. No. 13/868,149, the entire disclosure of which is incorporated herein by reference.) It is noted that other forms of mirrors and reflective surfaces may be used, however these are not preferred. From TIR prism 150 the laser beam traveling along beam path 160 enters a pair of optical wedges 153, 154, which are commonly called Risley Prisms, and which are held and controlled by Risley Prism mechanism 152. As the prisms are rotted about the axis of the laser beam path 160 they will have the effect of steering the laser beam, such that depending upon the relative positions of the prisms 153, 154 the laser beam can be directed to any point in area 161 and can be moved in any pattern within that area. There is further provided a window 157 that is adjacent a nozzle assembly 156 that has a source of a fluid 157.

The conveyance structure transmits high power laser energy from the laser to a location where high power laser energy is to be utilized or a high power laser activity is to be performed by, for example, a high power laser tool. The conveyance structure may, and preferably in some applications does, also serve as a conveyance device for the high power laser tool. The conveyance structure's design or configuration may range from a single optical fiber, to a simple to complex arrangement of fibers, support cables, shielding on other structures, depending upon such factors as the environmental conditions of use, performance requirements for the laser process, safety requirements, tool requirements both laser and non-laser support materials, tool function(s), power requirements, information and data gathering and transmitting requirements, control requirements, and combinations and variations of these.

Preferably, the conveyance structure may be coiled tubing, a tube within the coiled tubing, jointed drill pipe, jointed drill pipe having a pipe within a pipe, or may be any other type of line structure, that has a high power optical fiber associated with it. As used herein the term line structure should be given its broadest meaning, unless specifically stated otherwise, and would include without limitation: wireline; coiled tubing; slick line; logging cable; cable structures used for completion, workover, drilling, seismic, sensing, and logging; cable structures used for subsea completion and other subsea activities; umbilicals; cables structures used for scale removal, wax removal, pipe cleaning, casing cleaning, cleaning of other tubulars; cables used for ROV control power and data transmission; lines structures made from steel, wire and composite materials, such as carbon fiber, wire and mesh; line structures used for monitoring and evaluating pipeline and boreholes; and would include without limitation such structures as Power & Data Composite Coiled Tubing (PDT-COIL) and structures such as Smart Pipe® and FLATpak®.

Conveyance structures would include without limitation all of the high power laser transmission structures and configurations disclosed and taught in the following US Patent Applications Publication Nos.: 2010/0044106; 2010/0215326; 2010/0044103; 2012/0020631; 2012/0068006; and 2012/0266803, the entire disclosures of each of which are incorporated herein by reference.

Generally, the location and position of the beam waist of the laser beam can be varied with respect to the borehole surface, e.g., casing or formation, in which the perforation hole is to be cut. By varying the position of the beam waist different laser material processes may take place and different shape perforations may be obtained. Thus, and for example, for forming deep penetrations into the formation, the proximal end of the beam waist could be located at the borehole. Many other relative positions of the focal point, the laser beam optimum cutting portion, the beam waste, and the point where the laser beam path initially intersects the borehole surface may be used. Thus, for example, the focal point may be about 1 inch, about 2 inches, about 10 inches, about 15 inches, about 20 inches, or more into (e.g., away from the casing or borehole surface) or within the formation.

Figure 2:
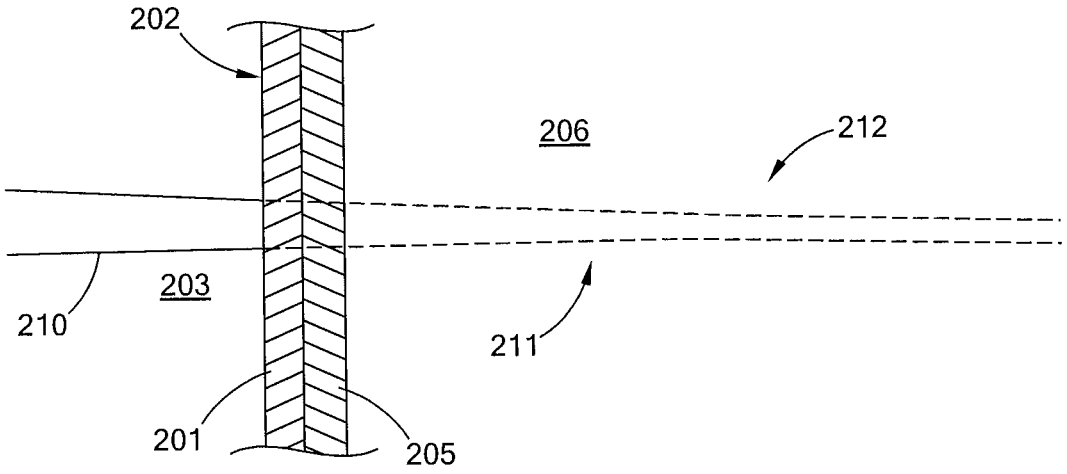
FIG. 2 is a schematic of an embodiment of a laser beam profile in accordance with the present invention.

The beam waist in many applications is preferably in the area of the maximum depth of the cut. In this manner the hole opens up toward the face (front surface) of the borehole, which further helps the molten material to flow from the perforation hole. Thus turning to FIG. 2 there is shown a casing 201 in a borehole 203 having a front or inner face 202. Between the casing 201 and the formation 206 is cement 205. A laser beam 210 that is launched from a laser perforation tool (not shown in this figure) travels along laser beam path 211 in a predetermined beam profile, which is provided by the laser optical assembly in the tool. The predetermined beam profile provides for a beam waist 212, which is positioned deep within the formation 206 behind the casing 201 and cement 205. Thus, the perforation hole may be about 5 inches, about 10 inches, about 15 inches, about 20 inches or more, or deeper into the formation. Additionally, damaged areas, that are typically present when explosives are used, such as loose rock and perforation debris along the bottom of the hole and a damaged zone extending annularly around the hole, preferably are not present in the laser perforation. Further this preferred positioning of the beam waist, deep within the formation, may also provide higher rates of penetration.

Figure 3A:
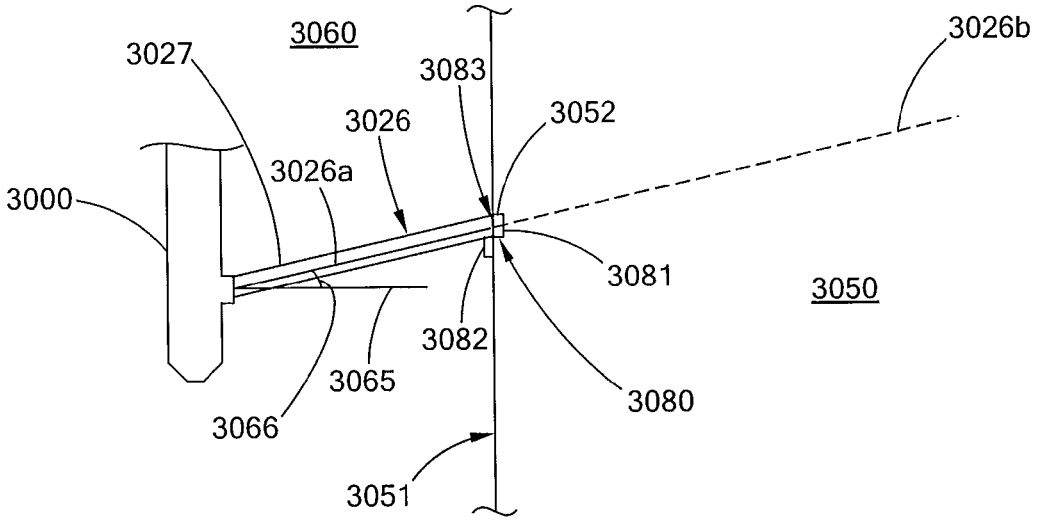
FIGS. 3A to 3C are schematic snap shots of an embodiment of a process in accordance with the present inventions.
Figure 3B:
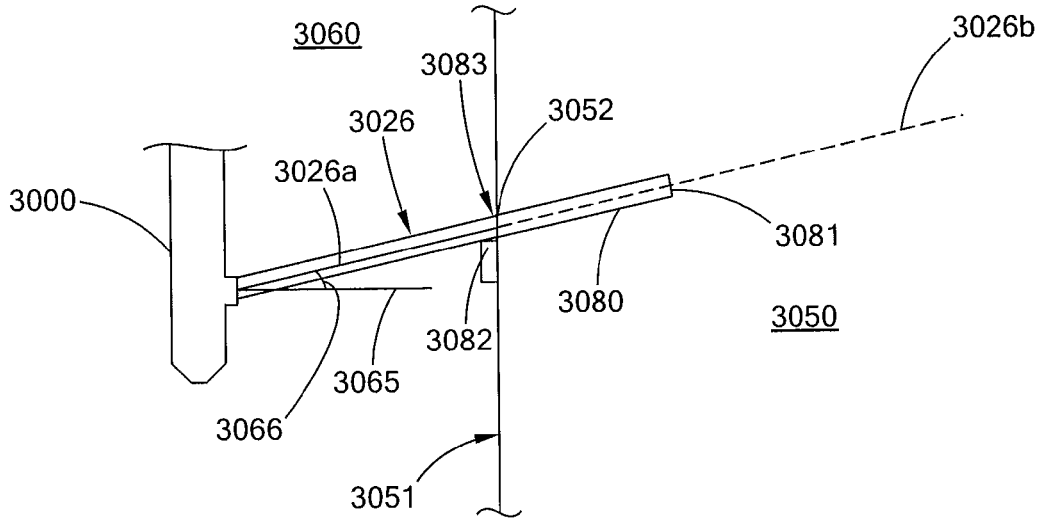
Figure 3C:
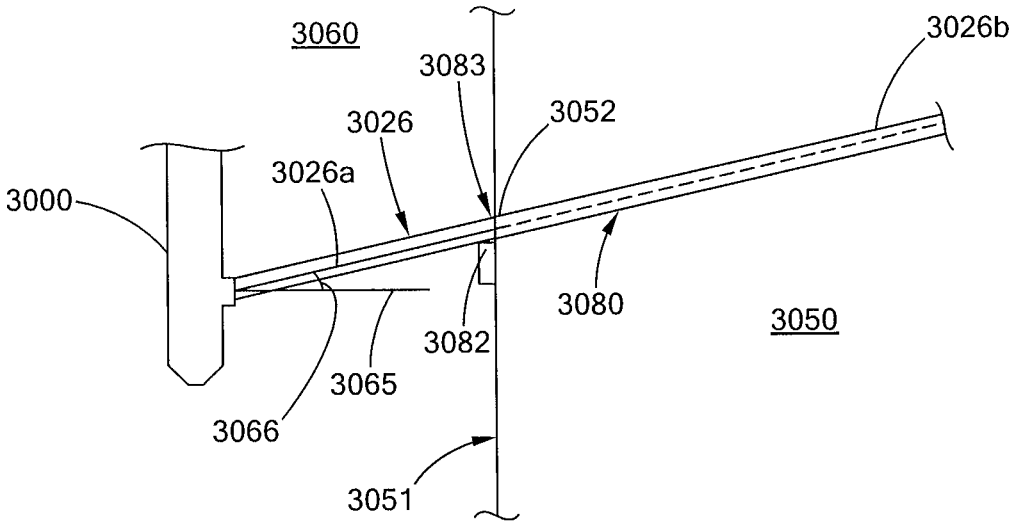

Turning to FIG. 3A through 3C there are provided side cross-sectional schematic snap shot views of an embodiment of a laser operation forming a hole, or perforation, into a formation. Thus, turning to FIG. 3A, in the beginning of the operation the laser tool 3000 is firing a laser beam 3027 along laser beam path 3026, and specifically along section 3026*a* of the beam path. Beam path section 3026*a* is in the wellbore free space 3060, this distance may be essential zero, but is shown a greater for the purpose of illustrating the process. Note, that wellbore free space refers to the fact that the laser has been launched from its last optical element and is no longer traveling in an optical fiber, a lens, a window or other optical element. This environment may be anything but free from fluids; and, if wellbore fluids are present as discussed and taught below other laser cutting techniques can be used if need. The laser beam path 3026 has a 16° beam path angle 3066 formed with horizontal line 3065. The laser beam path 3026 and the laser beam 3027 traveling along that beam path intersect the bore hole face 3051 of the formation 3050 at spot 3052. In this embodiment the proximal end of the laser beam waist section is located at spot 3052. The hole or perforation 3080 is beginning to form, as it can be seen that the bottom, or distal, surface 3081 of the hole 3080 is below surface 3051, along beam path 3026*b*, and within the target material 3050. As can be seen from this figure the hole 3080 is forming with a downward slope from the bottom of the hole 3081 to the hole opening 3083. The molten target material 3082 that has flowed from the hole 3080 cools and accumulates below the hole opening 3083.

Turning to FIG. 3B the hole 3081 has become longer, advancing deeper into the formation 3050. In general, the hole advances along beam path 3026*a*. Thus, the bottom 3081 of the hole is on the beam path 3026*b* and deeper within the formation, e.g., further from the opening 3083, than it was in FIG. 3A.

Turning now to FIG. 3C the hole 3081 has been substantially advanced to the extent that the bottom of the hole is no longer visible in the figure. The amount of molten material 3082 that has flowed from the hole 3081 has continued to grow. In this embodiment the length of hole 3082 is substantially longer than the length of the beam waist. The diameter, or cross sectional size of the hole, however does not increase as might be expected in the area distal to the beam waist. Instead, the diameter remains constant, or may even slightly decrease. It is theorized, although not being bound by this theory, that this effect occurs because the optical properties of the hole, and in particular the molten and semi-molten inner surfaces of the hole, are such that they prevent the laser beam from expanding after it is past, i.e., distal to, the beam waist. Further, and again not being bound by this theory, the inner surfaces may absorb the expanding portions of the laser beam after passing through the waist, the inner surfaces may reflect the expanding portions of the laser beam, in effect creating a light pipe within the hole, or the overall conditions within the hole may create a waive guide, and combinations and variations of these. Thus, the depth or length of the hole can be substantially, and potentially may orders of magnitude greater than the length of the beam waist.

Figure 16:
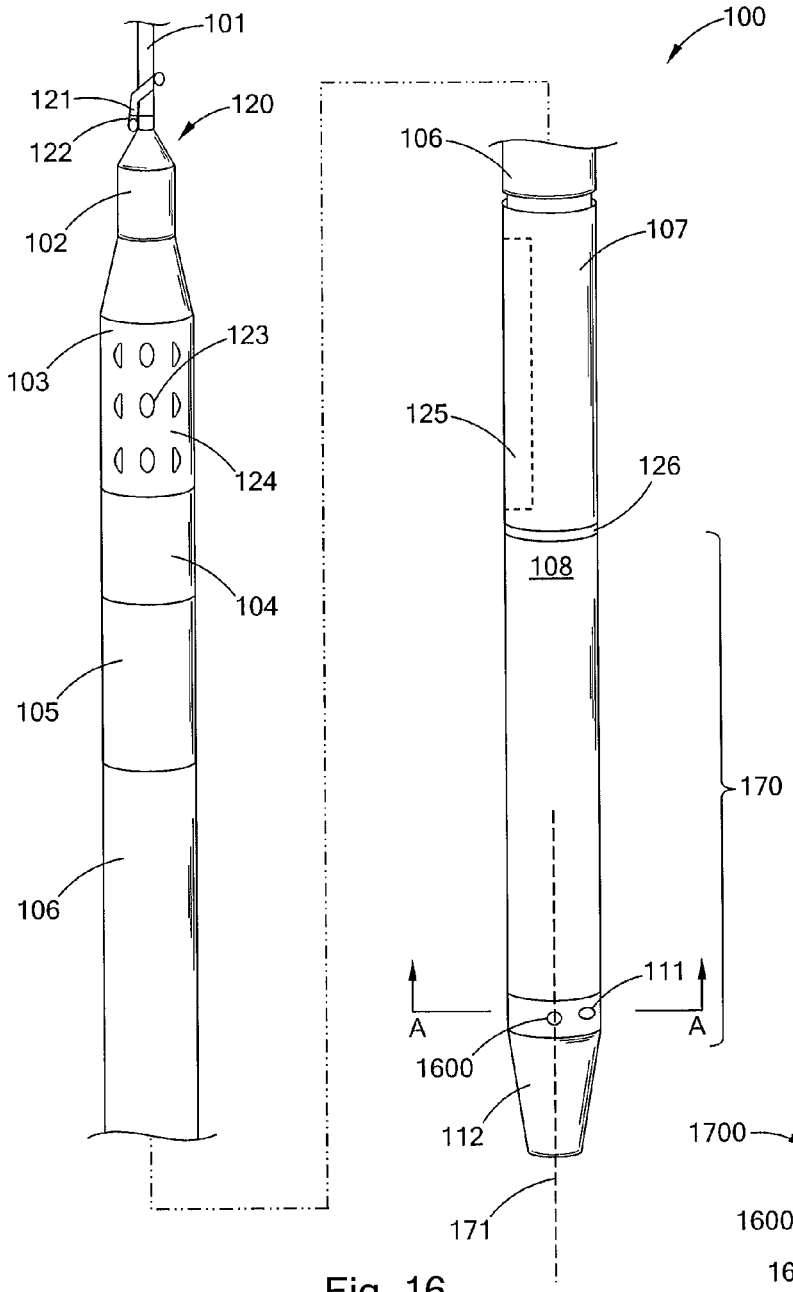
FIG. 16 is perspective view of an embodiment of a laser perforating tool in accordance with the present inventions.
Figure 16A:
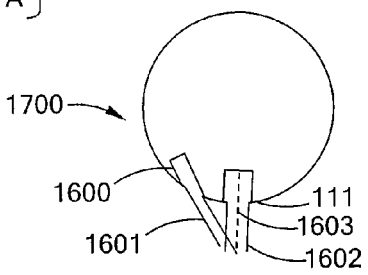
FIG. 16A is cross sectional view of the embodiment of FIG. 16 as taken along line A-A of FIG. 16.

While an upward beam angle is used in the illustrative process of FIGS. 3A to 3C, perforations that are essentially horizontal or that have beam angles that are below horizontal, i.e., sloping downward from the hole opening or vertically downward from the hole opening, may also be made. In upward beam angle operations the need for a fluid assist to clear the perforation hole as it is advanced is greatly reduced, if not entirely eliminated. The perforation hole will advance without the need for any fluid assist, e.g., air or water to remove the molten or laser effected material from the hole. In the horizontal hole, if the slope of the holes sides are great enough this hole may also be advanced without fluid assist. In other horizontal holes, and in holes having a beam angle below horizontal a fluid assist may be required, depending upon laser power, shape of the perforation, formation material and other factors. For example, turning to FIGS. 16 and 16A there is provided the laser perforating tool 100 of the embodiment of FIG. 1 (as such like numbers refer to like structures and components). However, the laser head in the laser sub 170 has an angled fluid jet nozzle 1600. In FIG. 16A, which is a cross section along line A-A of FIG. 16, it is shown how the angled fluid jet nozzle 1600 directs the fluid jet 1601 toward the laser jet 1602 (which jets are not shown in FIG. 16). The laser beam path within jet 1602 is shown by dashed line 1603. Thus, the angled jet 1601, and in whole or in part the laser jet 1601, assists in clearing the perforation hole of debris as the perforation hole is advanced deeper into the formation.

A laser beam profile in which the laser beam energy is diverging, e.g., more energy is to the outside of the beam than in the center, may be used to make perforations that are below horizontal, including down. The laser beam having this profile creates a surface on the perforation side wall that redirects, e.g., has a channeling or focusing effect, some of the laser beams energy to the center of the beam pattern or spot on the bottom, e.g., far end, of the perforation hole.

The laser beam profile and energy delivery pattern may be used to create a modified surface, and/or structure at the point, or in the general area, where the perforation joins to the borehole, to strength the borehole in that area, which may provide additional benefits, for example, when performing hydraulic fracturing.

Figure 4:
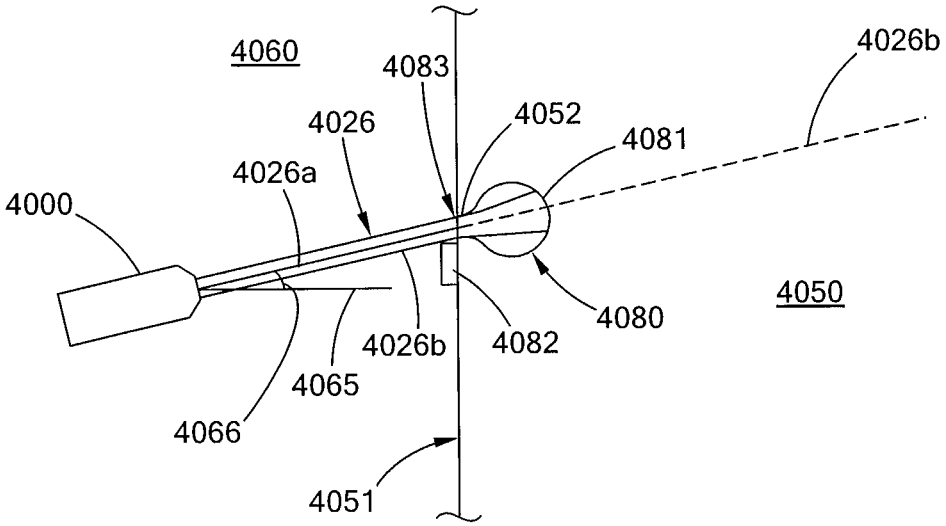
FIG. 4 is a schematic representation of an embodiment of a process in accordance with the present inventions.

Turning to FIG. 4 these is provided a schematic showing an embodiment of a laser operation in which the distal end of the beam waist is positioned away from the work surface, e.g., borehole surface, of the target material, e.g., formation. The laser tool 4000 is firing a laser beam 4027 along laser beam path 4026, which may be considered as having two section 4026*a* and 4026*b*. Beam path section 4026*a* is in wellbore free space 4060, this distance may be essential zero, but is shown a greater for the purpose of illustrating the process, and beam path 4026*b* is within the target material 4050. Note, that wellbore free space refers to the fact that the laser has been launched from its last optical element and is no longer traveling in a lens or window. This environment may be anything but free from fluids; and, if wellbore fluids are present as discussed and taught below other cutting techniques may be utilized. The laser beam path 4026 has a 22° beam path angle 4066 formed with horizontal line 4065. The laser beam path 4026 and the laser beam 4027 traveling along that beam path intersect the surface 4051 of target material 4050 at location 4052. In this embodiment the distal end 4064*b* of the laser beam waist section is not on location 4052 and is located away from surface 4051. In this embodiment the hole or perforation 4080 forms but then reaches a point where the bottom of the hole 4081 will not advance any further along the beam path 4026*b*, e.g., the hole stops forming and will not advance any deeper into the target material 4050. Further, unlike the operation of the embodiment in FIGS. 3A to 3C, the hole 4080 does not have a constant or narrowing diameter as one looks from the opening 4083 to the bottom 4081 of the hole 4080. The molten target material 4082 that has flowed from the hole 4080 cools and accumulates below the hole opening 4083. Based upon the laser beam power and other properties, this embodiment provides the ability to have precise and predetermined depth and shaped holes, in the target material and to do so without the need for measuring or monitoring devices. Once the predetermined depth is achieved, and the advancement process has stopped, regardless of how much longer the laser is fired the hole will not advance and the depth will not increase. Thus, the predetermined depth is essentially a time independent depth. This essentially automatic and predetermined stopping of the hole's advancement provides the ability to have cuts of automatic and predetermined depths, and well as, to section or otherwise remove the face of a rock formation at a predetermined depth in an essentially automatic manner.

Figure 5A:
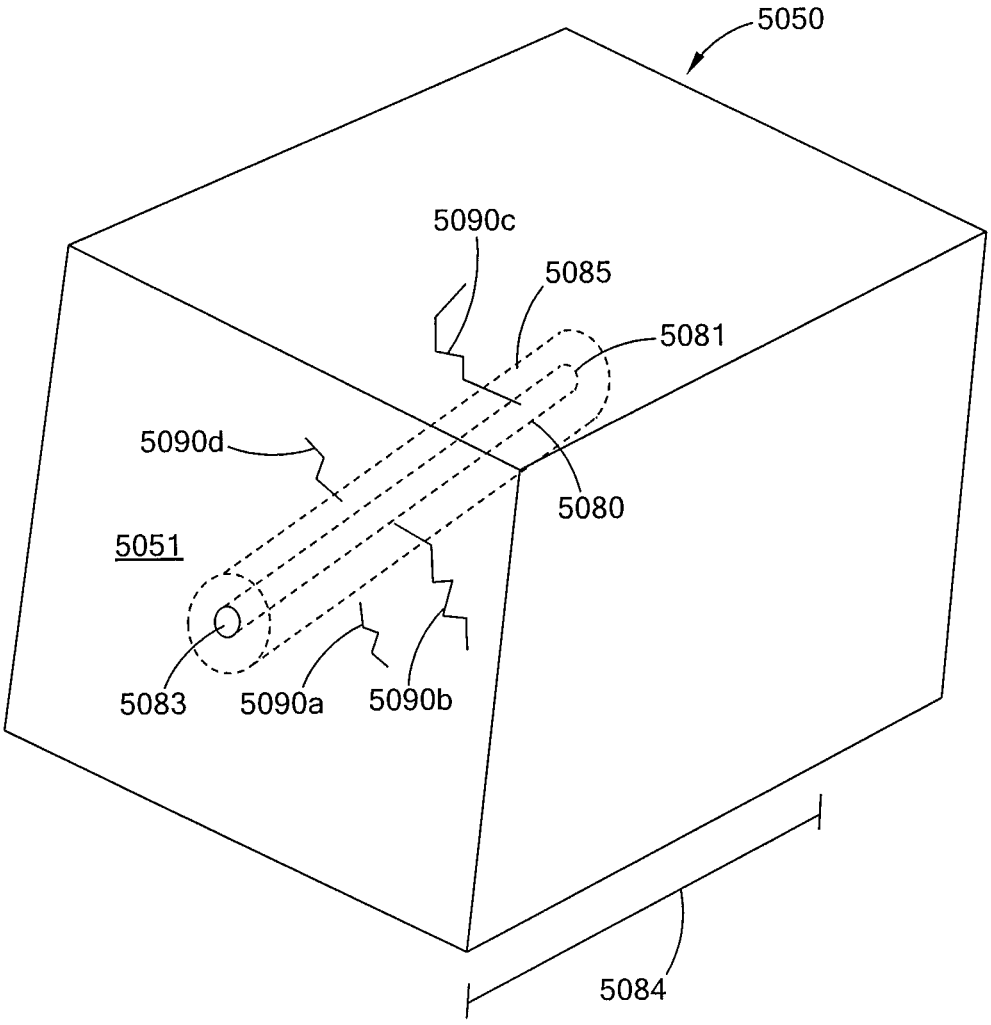
FIG. 5A is a perspective view of an embodiment of a laser energy delivery pattern in accordance with the present inventions.
Figure 5B:
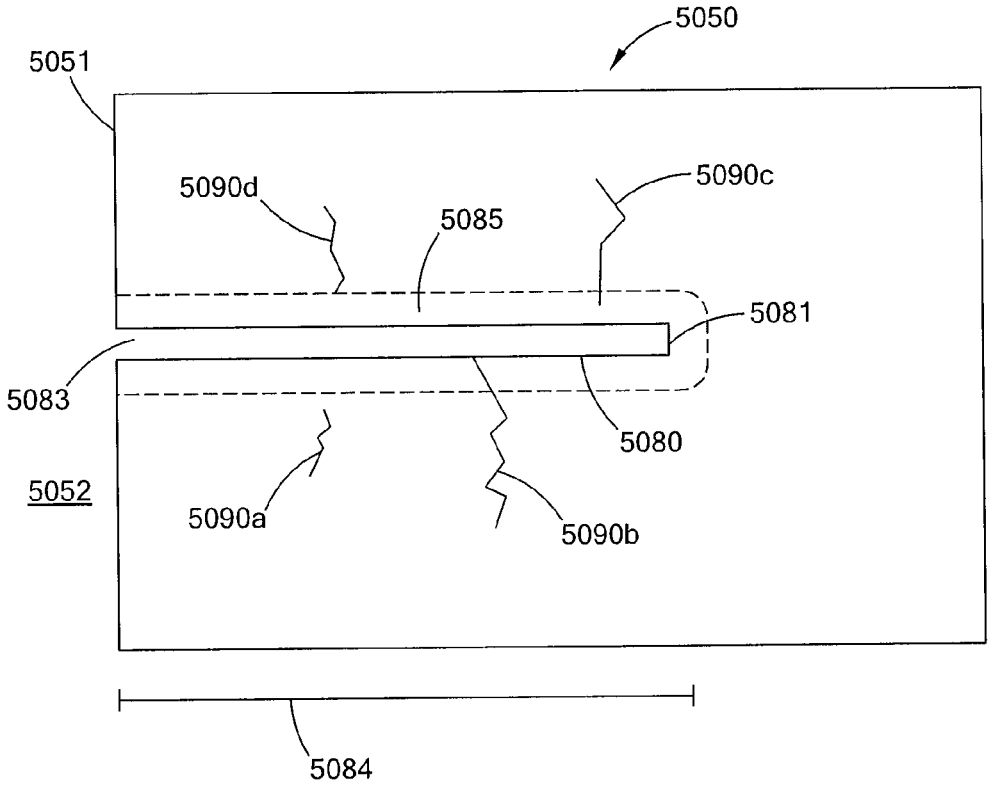
FIG. 5B is a perspective view of an embodiment of a laser energy delivery pattern in accordance with the present inventions.

Turning to FIGS. 5A and 5B there are shown in FIG. 5A a prospective view a section of a formation 5050, and in FIG. 5B a cross sectional view of the formation 5050. The formation 5050 is shown as being freestanding, e.g., a block of material, for the purpose of clarity in the figure. It being understood that the formation may be deep within the earth, nearer to the surface such as in some shale gas fields, and preferably in a hydrocarbon rich or pay zone of the formation, and that the face 5051 forms a part of, or is adjacent to, a borehole 5052 (as seen in FIG. 5B). Further although some boreholes are represented as being vertical, this is merely for illustration purposes and it should be recognized that the boreholes may have any orientation.

A laser cut hole 5080 extends into the formation 5050 from the hole opening 5083 to the back of the hole 5081. Around the hole 5080 is an area 5085 of laser affected formation. In this area 5085 the formation is weakened, substantially weakened, fractured or essentially structurally destroyed. Additionally, the laser cutting process forms cracks or fractures, i.e., laser induced fracturing, in the formation. By way of example, fracture 5090*a* is an independent fracture and does not extend to, or into, the laser affected area 5085, the hole 5080 or another fracture. Fracture 5090*b* extends into and through the laser affected area 5085 into the hole 5081. Additionally, fracture 5090*b* is made up of two associated cracks that are not fully connected. Fracture 5090*c* extends to, and into, the laser affected area 5085 but does not extend to the hole 5080. Fracture 5090*d* extend to, but not into the laser affected area 5085.

The fractures 5090*a*, 5090*b*, 5090*c* and 5090*d* are merely schematic representation of the laser induced fractures that can occur in the formation, such as rock, earth, rock layer formations and hard rocks, including for example granite, basalt, sandstone, dolomite, sand, salt, limestone and shale rock. In the formation, and especially in formations that have a tendency, and a high tendency for thermal-mechanical fracturing, in a 10 foot section of laser cut hole there may be about 10, about 20, about 50 or more such fractures, and these fractures may be tortious, substantially linear, e.g., such as a crack along a fracture line, interconnected to greater and lessor extents, and combinations and variations of these. These laser fractures may also be of varying size, e.g., length, diameter, or distance of separation. Thus, they may vary from micro fractures, to hairline fractures, to total and extended separation of sections having considerable lengths.

The depth or length of the hole can be controlled by determining the rate, e.g., inches/min, at which the hole is advanced for a particular laser beam, configuration with respect to the work surface of the formation, and type of formation. Thus, based upon the advancement rate, the depth of the hole can be predetermined by firing the laser for a preset time.

The rate and extent of the laser fracturing, e.g., laser induced crack propagation, may be monitored by sensing and monitoring devices, such as acoustical devices, acoustical geological sensing devices, and other types of geological, sensing and surveying type devices. In this manner the rate and extent of the laser fracturing may be controlled real time, by adjusting the laser beam properties based upon the sensing data.

Cuts in, sectioning of, and the volumetric removal of the formation down hole can be accomplished by delivering the laser beam energy to the formation in preselected and predetermined energy distribution patterns. These patterns can be done with a single laser beam, or with multiple laser beams. For example, these patterns can be: a linear cut; a pie shaped cut; a cut appearing like the shape of an automobile cam shaft; a circular cut; an elepitcal cut; a square cut; a spiral cut; a pattern of connected cuts; a pattern of connected linear cuts, a pattern of radially extending cuts, e.g., spokes on a wheel; a circle and radial cut pattern, e.g., cutting pieces of a pie; a pattern of spaced apart holes, such as in a line, in a circle, in a spiral, or other pattern, as well as other patterns and arrangements. The patterns, whether lines, staggered holes, others, or combinations thereof, can be traced along, e.g., specifically targeted in a predetermined manner, a feature of the formation, such as, a geologic joints, bedding layers, or other naturally occurring features of a formation that may enhance, exploited or built upon to increase the fluid connectivity between the borehole and the hydrocarbons in the formation.

Thus, for example, in determining a laser beam delivery pattern to provide a predetermined and preselected laser beam energy distribution pattern, the spacing of cut lines, or staggered holes, in the formation, preferably may be such that the laser affect zones are slightly removed from one another, adjacent to one another but do not overlap, or overlap only slightly. In this manner, the maximum volume of the formation will be laser affect, i.e., weakened, fractured or perforated with the minimum amount of total energy.

Laser perforating tools and operations may find considerable uses in shales and shale formations and other unconventional or difficult to produce from formations. For example, in shales for unconventional extraction of gas and oil there is no permeability. The current operations to access this rock and make it productive are to drill a 6 to 12 inch diameter borehole, thousands of feet long with a mechanical rig and bit, and then perforate on the order of inches using explosives. Once the perforations are formed thousands of gallons of high pressure fluid and proppant are used to open the pores to increase permeability.

The high power laser perforating tools can greatly improve on the conventional operation by creating a custom geometry (e.g. shape, length, entrance area, thickness) with a laser. This custom geometry can stem off a main borehole in any orientation and direction, which in turn will initiate a fracture that is more productive than existing conventional methods, by exposing more rock and positioning the fractures in optimum stress planes.

Generally, fracturing in rocks at depth is suppressed by the confining pressure, from the weight of the rocks and earth above. The force of the overlying rocks is particularly suppressive of fracturing in the situation of tensile fractures, e.g., Mode 1 fractures. These fractures require the walls of the fracture to move apart, working against this confining pressure.

Hydraulic fracturing or fracing is used to increase the fluid communication between the borehole and the formation. Thus, it can restore, maintain, and increase the rate at which fluids, such as petroleum, water, and natural gas are produced from reservoirs in formations.

Thus, it has long been desirable to create conductive fractures in the rock, which can be pivotal to extract gas from shale reservoirs because of the extremely low natural permeability of shale, which is measured in the microdarcy to nanodarcy range. These fractures provide a conductive path connecting a larger volume of the reservoir to the borehole.

The custom geometry that can be created with laser perforating can provide enhanced, more predictable, and more controllable predetermined condutive paths that result from hydrofacturing. Thus, the laser perforation custom geometry can increase the efficiency of hydraulic fracturing and hydrocarbon production from a well.

Laser perforated custom geometris for hydrofracing has many advantages in all well types, and particularly has and advantages in horizontal drilling, which involves wellbores where the borehole is completed as a "lateral" that extends parallel to the hydrocarbon containing rock layer. For example, lateral boreholes can extend 1,500 to 5,000 feet (460 to 1,500 m) in the Barnett Shale basin in Texas, and up to 10,000 feet (3,000 m) in the Bakken formation in North Dakota. In contrast, a vertical well only accesses the thickness of the rock layer, typically 50-300 feet (15-91 m). Mechanical drilling, however, typically causes damage to the pore space, e.g., formation structure, at the wellbore wall, reducing the permeability at and near the wellbore. This reduces flow into the borehole from the surrounding rock formation, and partially seals off the borehole from the surrounding rock. Custom geometries, from the laser perforation, enable hydraulic fracturing in these wells to restore and potentially increase permeability and the productivity of the well.

Thus, the laser perforating tools, and laser energy distribution patterns, which can provide custom geometries for hydrofacting operations, have the potential to greatly increase hydrocarbon production, especially form unconventional sources.

Turning to FIG. 6A to 6D there is shown an embodiment of an adjustable optics package that may be used in a laser cutting tool. FIG. 6 is a perspective view of the adjustable optics package 6024 with a laser beam 6027 being propagated, e.g., fired, shot, delivered, from the front (distal) end 6025 of the optics package 6024. The optics package 6025 has an adjustment body 6028 that has a fixed ring 6029. The adjustment body 6028 is adjustably, e.g., movably, associated with the main body 6031 of the optics package 6024, by threaded members. There is also a locking ring 6032 on the adjustment body 6028. The locking ring 6029 is engageable against the main body to lock the adjustment body 6028 into position.

Figure 6A:
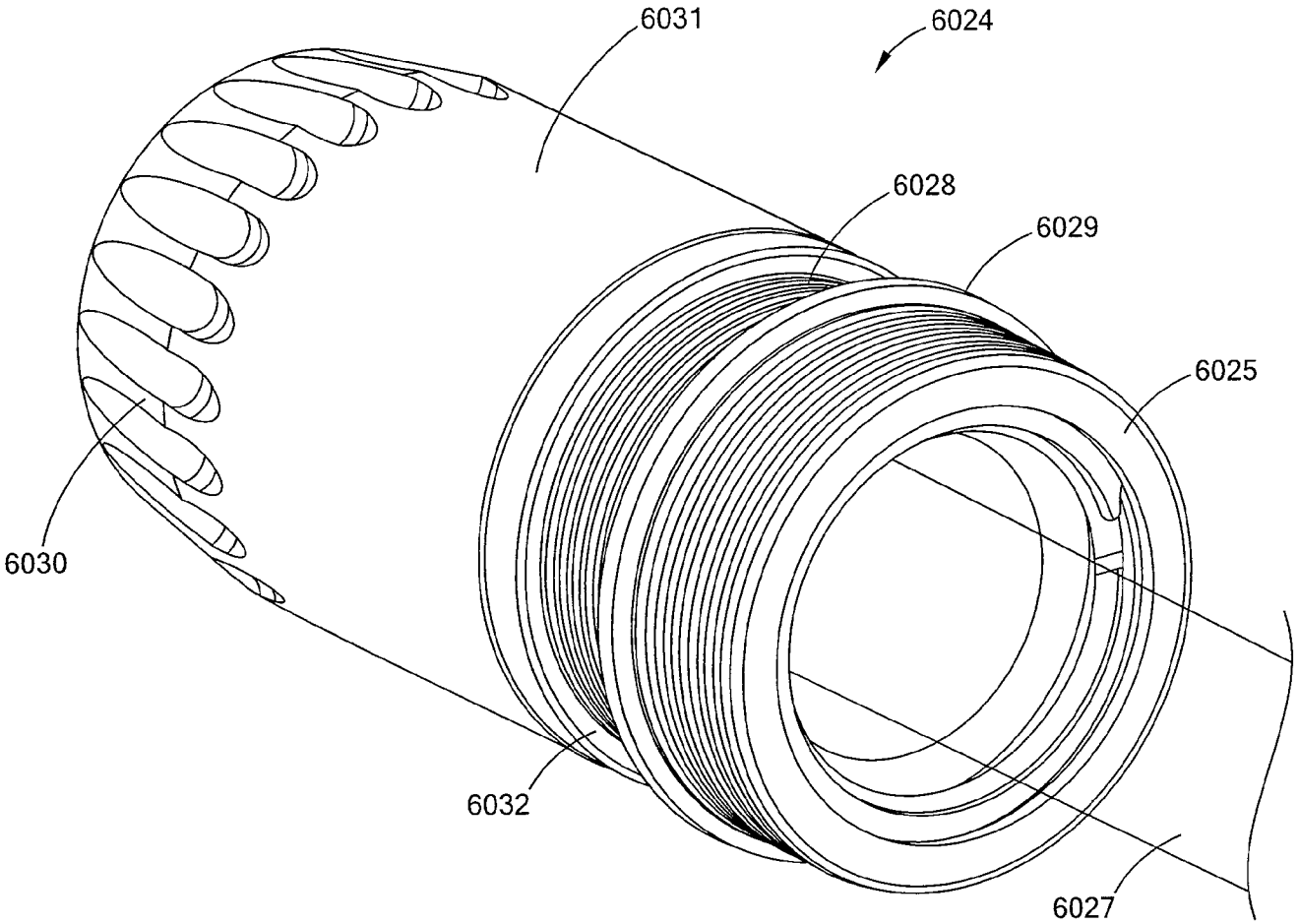
FIG. 6A is a perspective view of an embodiment of an optics assembly in accordance with the present inventions.
Figure 6B:
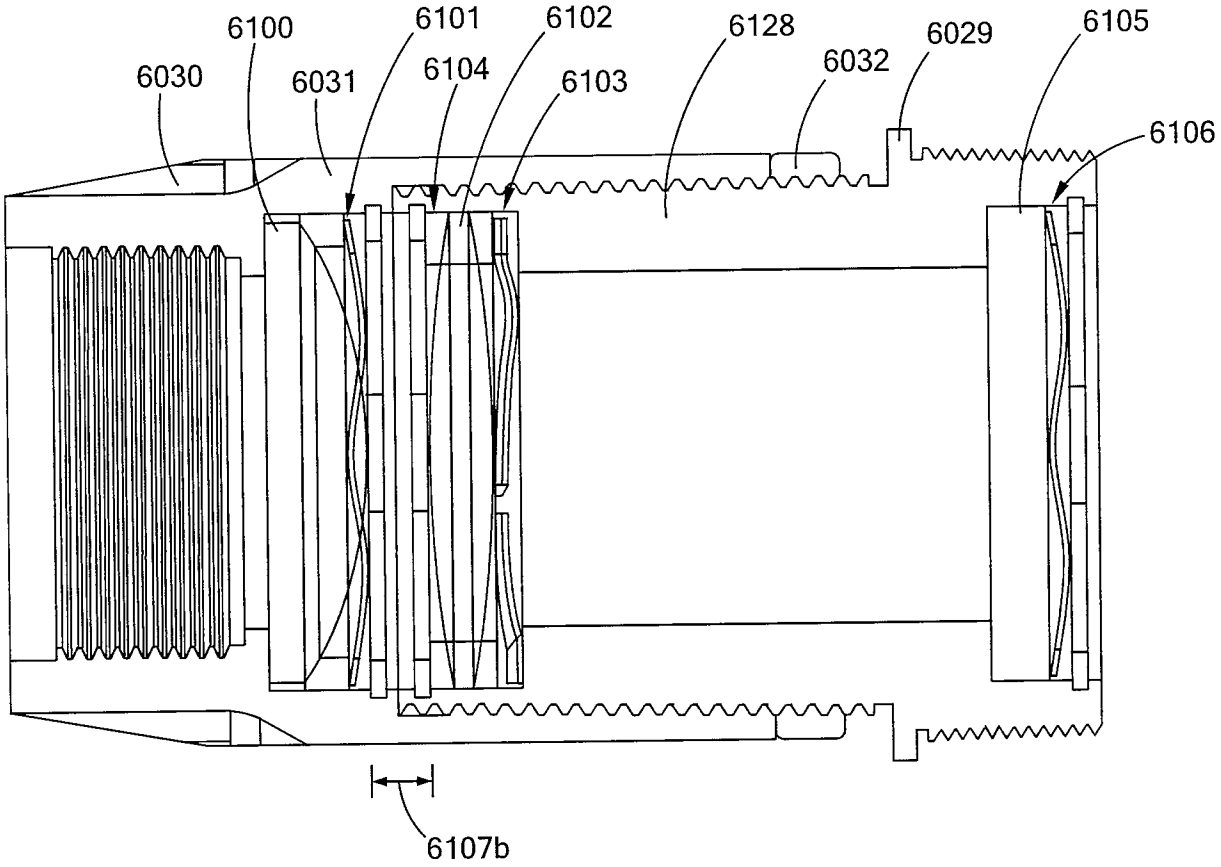
FIG. 6B is a cross sectional view of the embodiment of FIG. 6A.
Figure 6C:
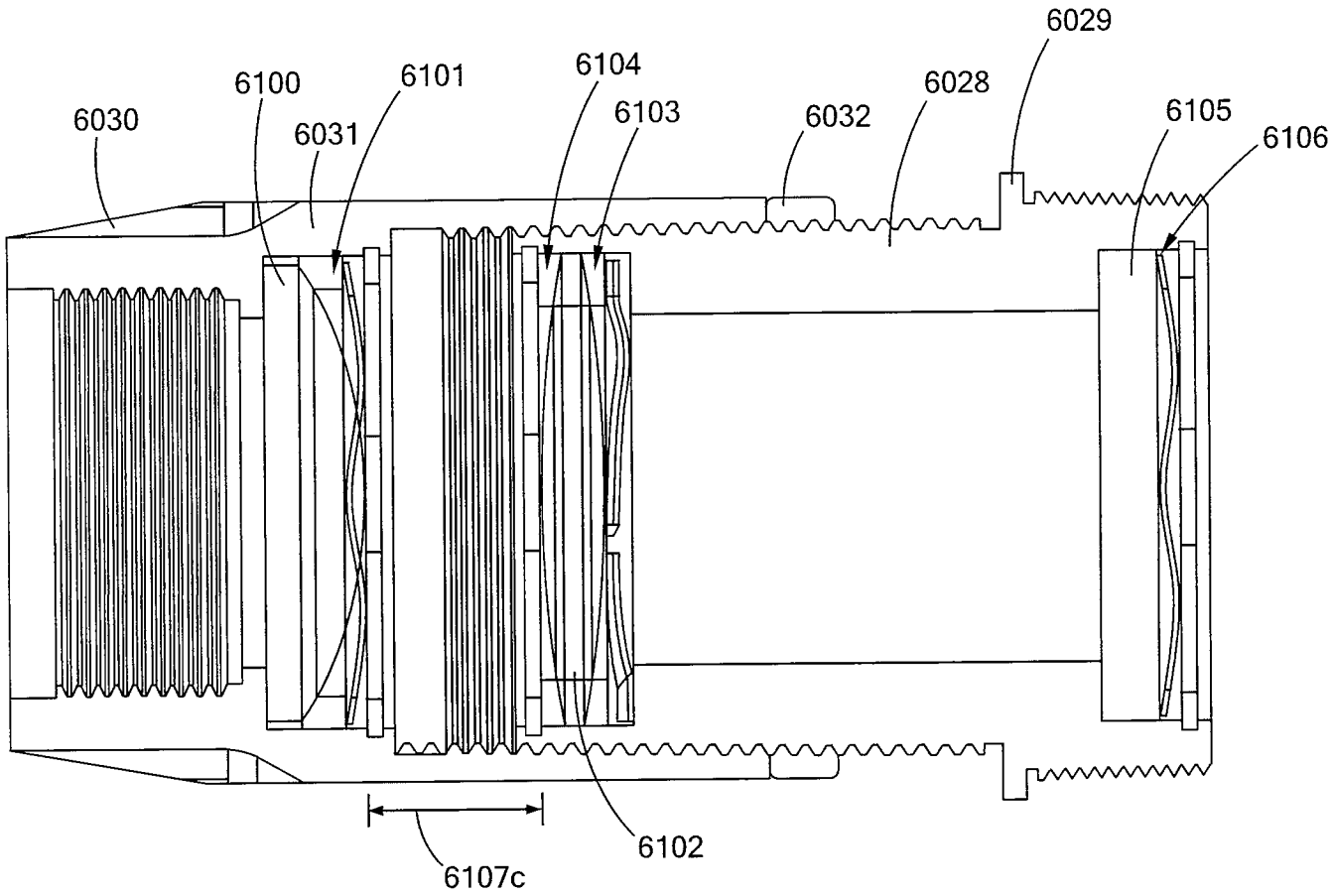
FIG. 6C is a cross sectional view of the embodiment of FIG. 6A.
Figure 6D:
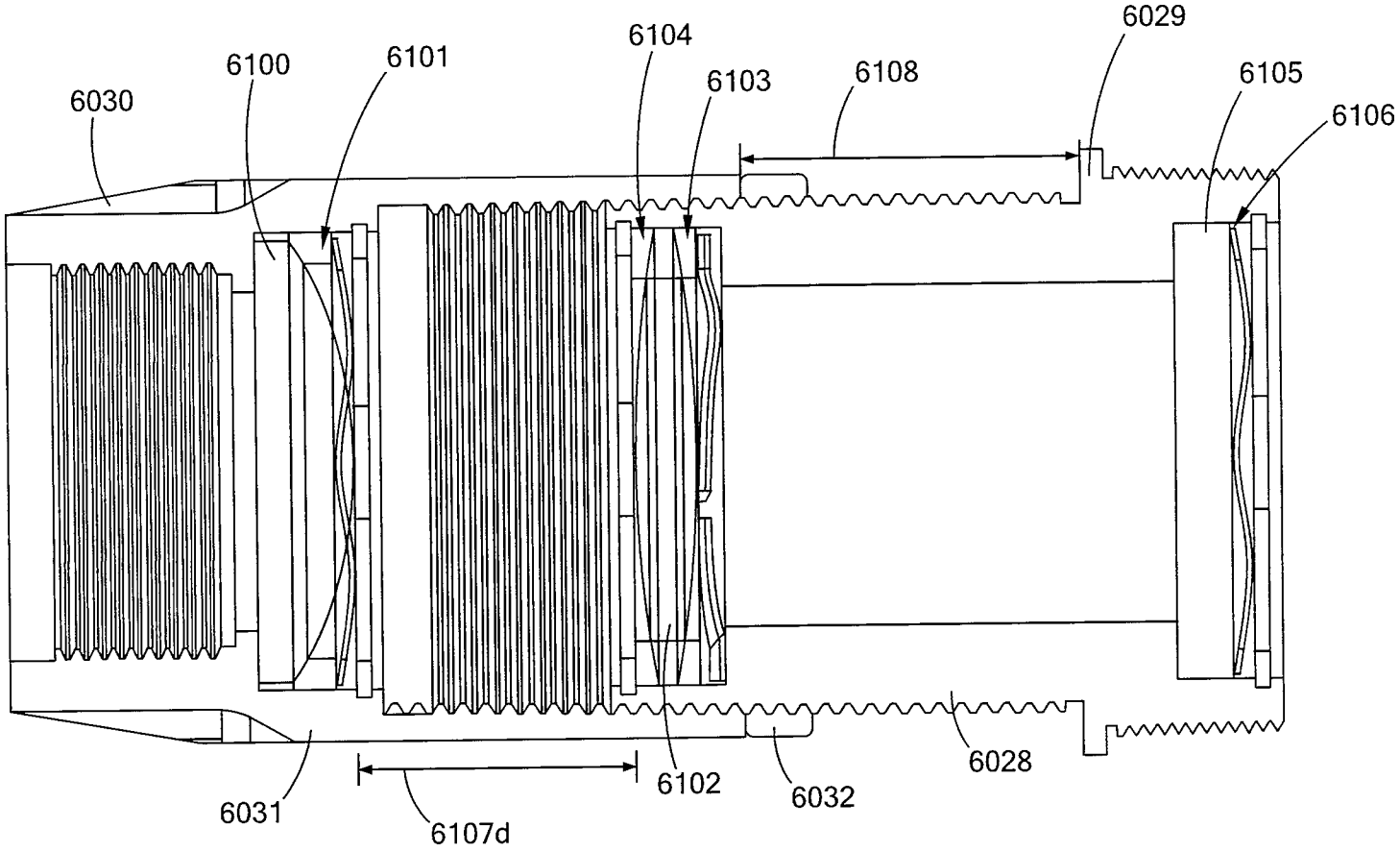
FIG. 6D is a cross sectional view of the embodiment of FIG. 6A.

Turning to FIGS. 6B to 6D, there are shown cross sectional views of the embodiment of FIG. 6A in different adjustment positions. Thus, there is provided a first focusing lens 6100, which is held in place in the main body 6031 by lens holding assembly 6101. Thus, lens 6100 is fixed, and does not change position relative to main body 6031. A second focusing lens 6102 is held in place in the adjustment body 6028 buy holding assemblies 6103, 6104. Thus, lens 6102 is fixed, and does not change position relative to the adjustment body 6028. Window 6105 is held in place in the front end 6025 of the adjustment body 6028 by holding assembly 6106. In this manner as the adjustment body 6028 is moved in and out of the main body 6031 the distance, e.g., 6107*b*, 6107*c*, 6107*d*, between the two lens 6100, 6102 changes resulting in the changing of the focal length of the optical system of the optics package 6024. Thus, the optical system of optics package 6024 can be viewed as a compound optical system.

In FIG. 6B the two lenses 6100, 6102 are at their closest position, i.e., the distance 6107*b* is at its minimum. In FIG. 6C the two lenses 6101, 6102 are at a middle distance, i.e., the distance 6107*c* is at about the mid point between the minimum distance and the maximum distance. In FIG. 6D the two lenses 6101, 6102 are at their furthest operational distance, i.e., the distance 6107*d* is the maximum distance that can operationally be active in the optics assembly. (It should be noted that although the adjustment body 6028 could be moved out a little further, e.g., there are a few threads remaining, to do so could compromise the alignment of the lenses, and thus, could be disadvantages to the performance of the optics package 6024.)

Figure 7:
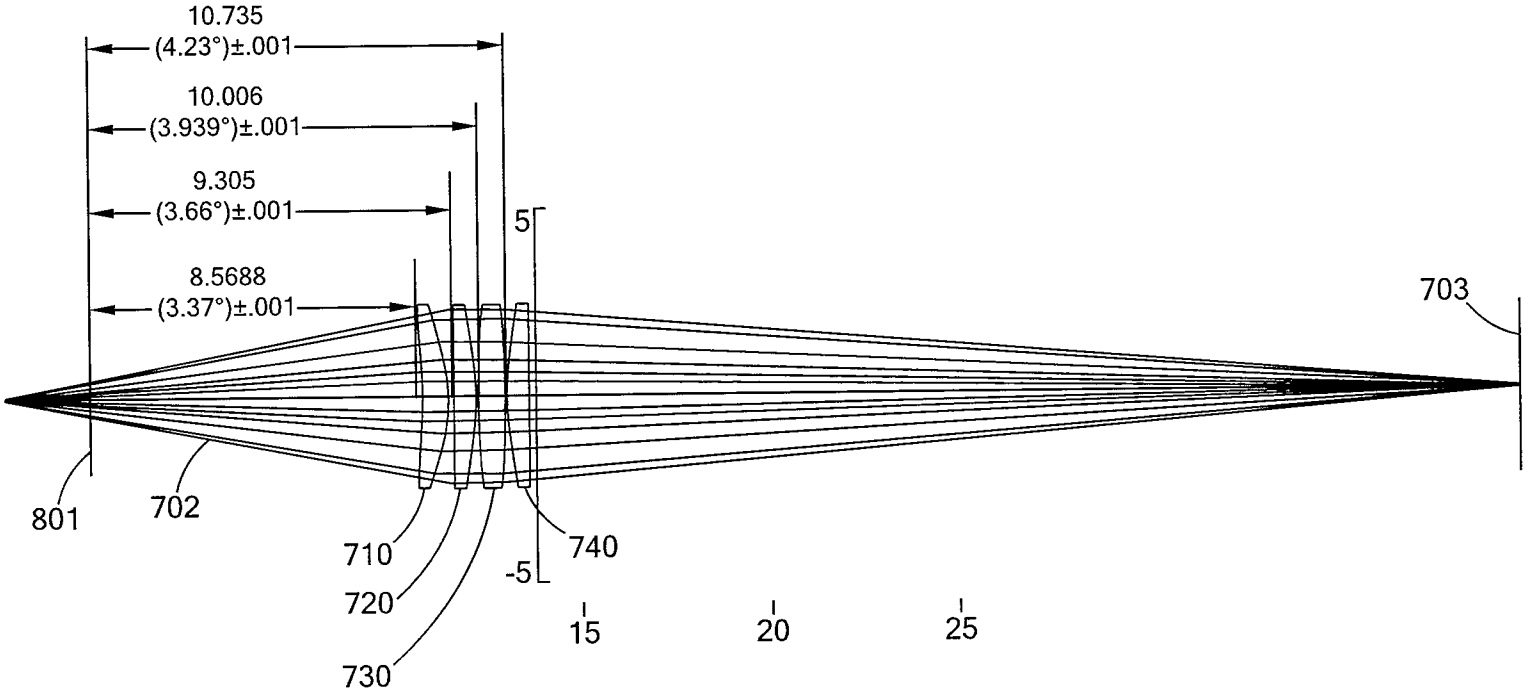
FIG. 7 is a schematic of an embodiment of an optical configuration in accordance with the present inventions.

Turning to FIG. 7, there is shown a schematic of an embodiment of an optical assembly for use in an optics package, having a launch face 701 from a connector, ray trace lines 702 show the laser beam exiting the face of the connector and traveling through four lens, lens 710, lens 720, lens 730, lens 740. In this embodiment lens 710 minimizes the aberrations for the lens 710-720 combination, which combination collimates the beam. Lens 730 and 740 are the focusing lenses, which focus the laser beam to a focal point on focal plane 703. Lens 740 minimizes the spherical aberrations of the 730-740 lens pair.

Differing types of lens may be used, for example in an embodiment Lens 730 has a focal length of 500 mm and lens 740 has a focal length of 500 mm, which provide for a focal length for the optics assembly of 250 mm. The NA of the connector face is 0.22. Lens 710 is a meniscus (f=200 mm). Lens 720 is a plano-convex (f=200 mm). Lens 730 is a plano-convex (f=500 mm). Lens 740 is a menisus (f=500 mm). In another embodiment only one focusing lens is used, lens 740. Lens 730 has been removed from the optical path. As such, the focal length for the beam provided by this embodiment is 500 mm. In a further embodiment, lens 730 has a 1,000 mm focus and a diameter of 50.8 mm and lens 740 is not present in the configuration, all other lens and positions remain unchanged, providing for an optical assembly that has a focal length of 1,000 mm.

Figure 8A:
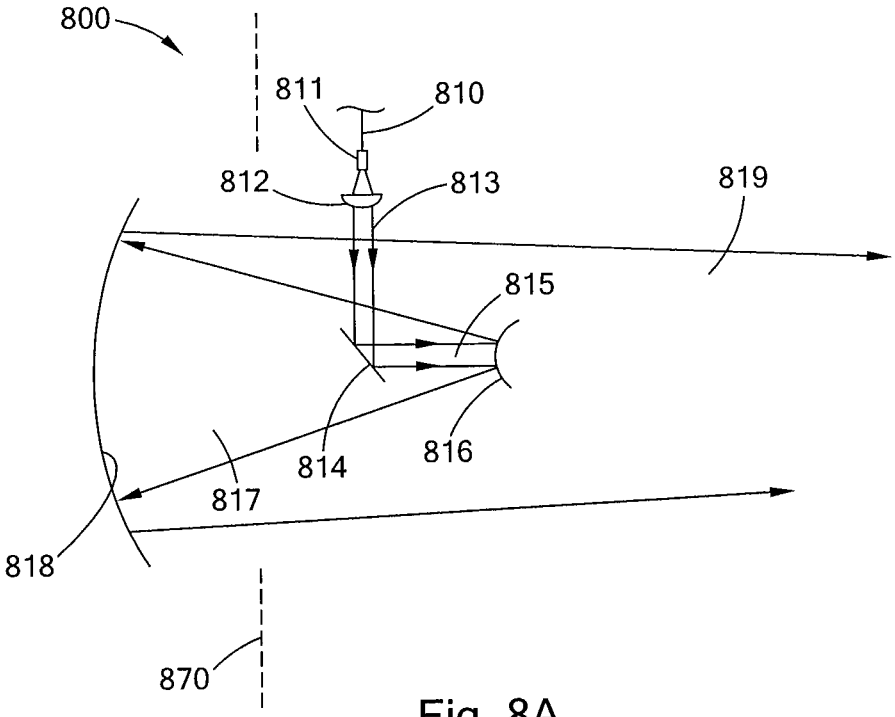
FIG. 8A is a schematic side view of an embodiment of an optical configuration in accordance with the present inventions.
Figure 8B:
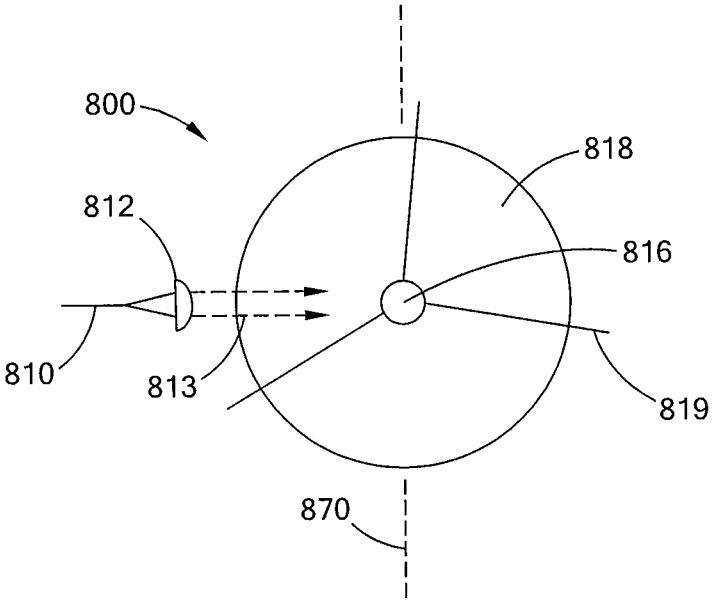
FIG. 8B is a schematic plan view of the embodiment of FIG. 8A.

Turning to FIGS. 8A and 8B there is shown an embodiment of a divergent, convergent lens optics assembly for providing a high power laser beam for creating perforation holes having depths, e.g., distances from the primary borehole, of greater than 10 feet, greater than about 20 feet, greater than about 50 feet, and greater than 100 feet.

FIG. 8A provides a side view of this optics assembly 800, with respect to the longitudinal axis 870 of the tool. FIG. 8B provides a front view of optics assembly 800 looking down the longitudinal axis 870 of the tool. As best seen in FIG. 8A, where there is shown a side schematic view of an optics assembly having a fiber 810 with a connector 811 launch a beam into a collimating lens 812. The collimating optic 812 directs the collimated laser beam along beam path 813 toward reflective element 814, which is a 45° mirror assembly. Reflective mirror 814 directs the collimated laser beam along beam path 815 to diverging mirror 816. Diverging mirror 816 directs the laser beam along diverging beam path 817 where it strikes primary and long distance focusing mirror 818. Primary mirror focuses and directs the laser beam a long perforating laser path 829 toward the casing, cement and/or formation (not shown) to be perforated. Thus, the two mirrors 816, 818, have their reflective surfaces facing each other. The diverging (or secondary) mirror 816 supports 819 are seen in FIG. 8B.

In an example of an embodiment of this optical assembly, the fiber may have a core of about 200 μm, and the NA of the connector 811 distal face is 0.22. The beam launch assembly (fiber 810/connector 811) launches a high power laser beam, having 20 kW of power in a pattern shown by the ray trace lines, to a secondary mirror 816. The diverging mirror 816 is located 11 cm (as measured along the total length of the beam path) from the launch or distal face of the beam launch assembly. The secondary mirror has a diameter of 2" and a radius of curvature 143 cm. For distances of about 100 feet the primary mirror 818 has a diameter of 18" and a radius of curvature of 135 cm. In this embodiment the primary mirror is shaped, based upon the incoming beam profile, to provide for a focal point 100 feet from the face the primary mirror. This configuration can provided a very tight spot in the focal plain, the spot having a diameter of 1.15 cm. Moving in either direction from the focal plane, along the beam waist, for about 4 feet in either direction (e.g., an 8 foot optimal cutting length of the laser beam) the laser beam spot size is about 2 cm. For cutting rock, it is preferable to have a spot size of about ¾" or less (1.91 cm or less) in diameter (for laser beam having from about 10 to 40 kW). In an example of an embodiment during use, the diverging mirror could have 2 kW/cm$^2$ and the primary mirror could have 32 W/cm$^2$ of laser power on their surfaces when performing a laser perforation operation.

Figure 9:
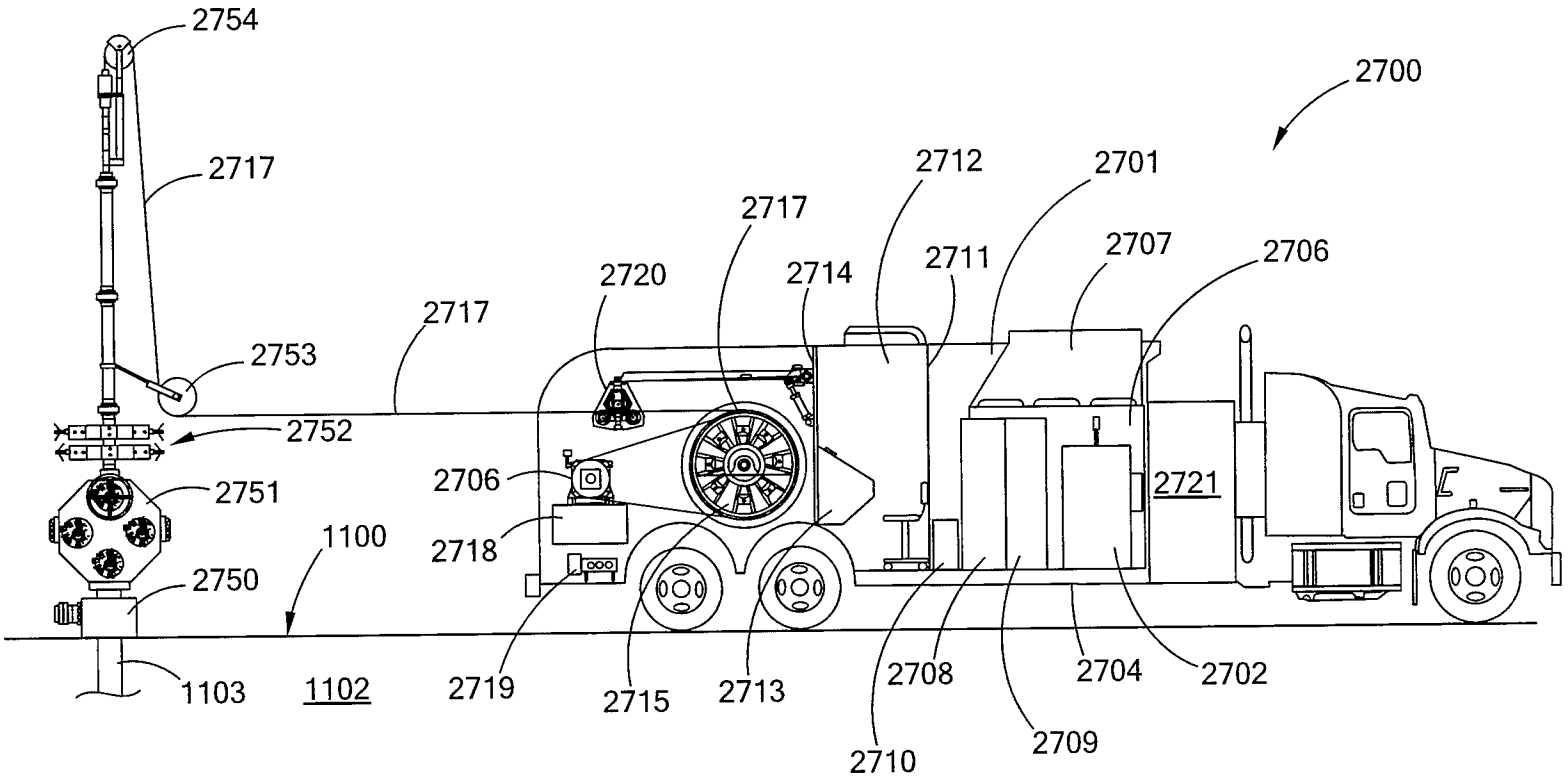
FIG. 9 is a schematic view of an embodiment of a mobile laser system in accordance with the present inventions.
Figure 10:
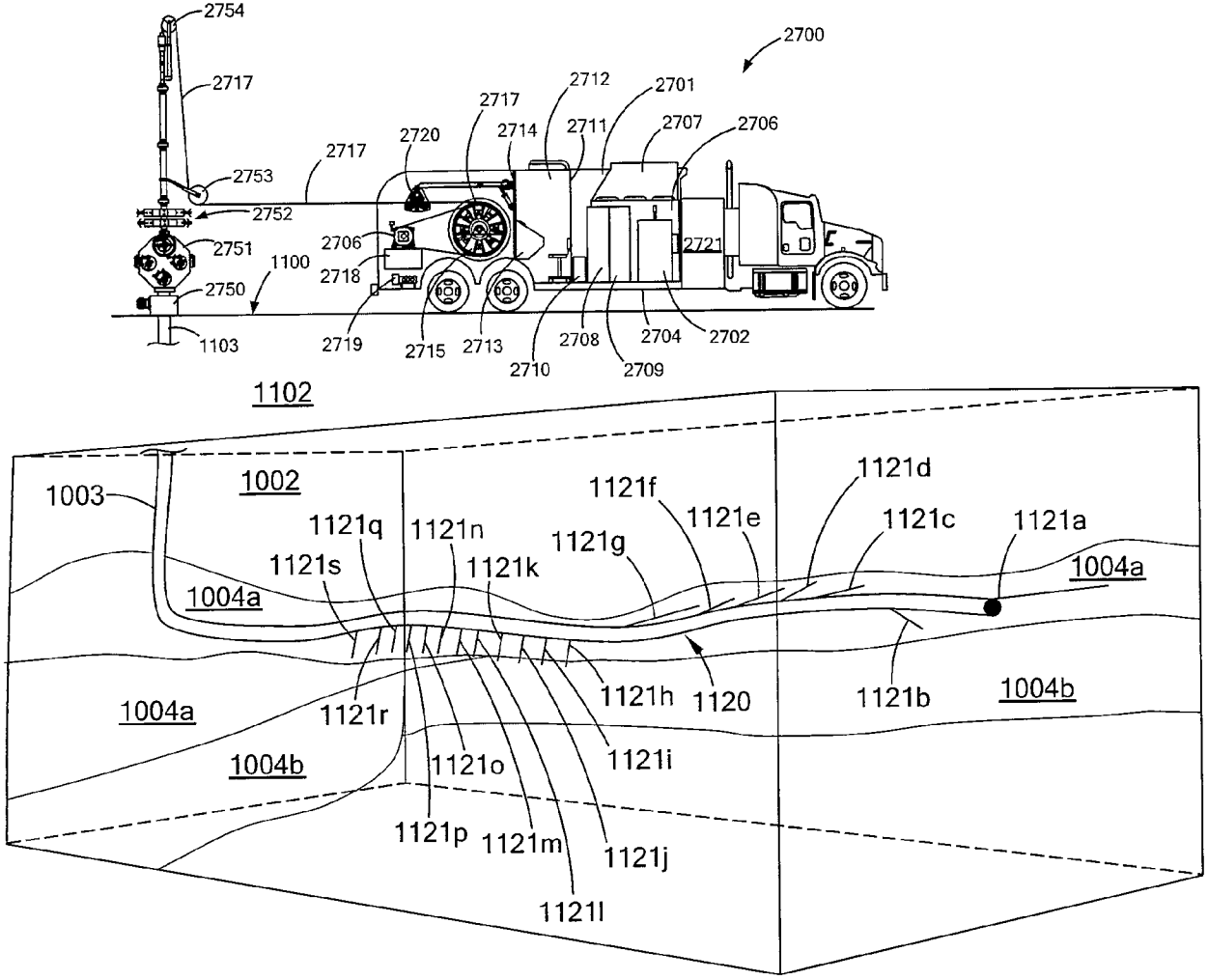
FIG. 10 is a perspective view of an embodiment of laser system providing an embodiment of a laser energy delivery pattern in accordance with the present inventions.

An embodiment of a high power laser system and its deployment and use in the field, to provide a custom laser perforation and fracturing pattern to a formation, is shown in FIGS. 9 and 10. Thus, there is provided a mobile laser conveyance truck (MLCT) 2700. The MLCT 2700 has a laser cabin 2701 and a handling apparatus cabin 2703, which is adjacent the laser cabin. The laser cabin 2701 and the handling cabin 2703 are located on a truck chassis 2704.

The laser cabin 2701 houses a high power fiber laser 2702, (20 kW; wavelength of 1070-1080 nm); a chiller assembly 2706, which has an air management system 2707 to vent air to the outside of the laser cabin and to bring fresh air in (not shown in the drawing) to the chiller 2706. The laser cabin also has two holding tanks 2708, 2709. These tanks are used to hold fluids needed for the operation of the laser and the chiller during down time and transit. The tanks have heating units to control the temperature of the tank and in particular to prevent the contents from freezing, if power or the heating and cooling system for the laser cabin was not operating. A control system 2710 for the laser and related components is provided in the laser cabin 2703. A partition 2711 separates the interior of the laser cabin from the operator booth 2712.

The operator booth contains a control panel and control system 2713 for operating the laser, the handling apparatus, and other components of the system. The operator booth 2712 is separated from the handling apparatus cabin 2703 by partition 2714.

The handling apparatus cabin 2703 contains a spool 2715 (about 6 ft OD, barrel or axle OD of about 3 feet, and a width of about 6 feet) holding about 10,000 feet of the conveyance structure 2717. The spool 2715 has a motor drive assembly 2716 that rotates the spool. The spool has a holding tank 2718 for fluids that may be used with a laser tool or otherwise pumped through the conveyance structure and has a valve assembly for receiving high pressure gas or liquids for flowing through the conveyance structure.

The laser 2702 is optically associated with the conveyance structure 2717 on the spool 2715 by way of an optical fiber and optical slip ring (not shown in the figures). The fluid tank 2718 and the valve assembly 2719 are in fluid communication with the conveyance structure 2717 on the spool 2715 by way of a rotary slip ring (not shown).

The laser cabin 2710 and handling apparatus cabin 2703 have access doors or panels (not shown in the figures) for access to the components and equipment, to for example permit repair, replacement and servicing. At the back of the handling apparatus cabin 2703 there are door(s) (not shown in the figure) that open during deployment for the conveyance structure to be taken off the spool. The MLCT 2700 has an electrical generator 2721 to provide electrical power to the system.

The MLCT 2700 is on the surface 100 of the earth 102, positioned near a wellhead 2750 of a borehole 103, and having a Christmas tree 2751, a BOP 2752 and a lubricator 2705. The conveyance structure 2717 travels through winder 2729 (.e.g., line guide, level wind) to a first sheave 2753, to a second sheave 2754, which has a weight sensor 2755 associated with it. Sheaves 2753, 2754 make up an optical block. The weight sensor 2755 may be associated with sheave 2753 or the composite structure 2717. The conveyance structure 2717 enters into the top of the lubricator and is advanced through the BOP 2752, tree 2751 and wellhead 2750 into the borehole (not shown) below the surface of the earth 2756. The sheaves 2753, 2754 have a diameter of about 3 feet. In this deployment path for the conveyance structure the conveyance structure passes through several radii of curvature, e.g., the spool and the first and second sheaves. These radii are all equal to or large than the minimum bend radius of the high power optical fiber in the conveyance structure. Thus, the conveyance structure deployment path would not exceed (i.e., have a bend that is tighter than the minimum radius of curvature) the minimum bend radius of the fiber.

Turning to FIG. 10 there is shown the MLCT 2700 over a prospective view a section of a formation 1104 in the earth 1102. The formation 1104 is shown as being freestanding, e.g., a block of material, for the purpose of clarity in the figure. It being understood that the formation may be deep within the earth, nearer to the surface such as in some shale gas fields and that the orientation of borehole 1103 may be from vertical, to the essentially horizontal shown in FIG. 10, to up turned, as well as branched.

The formation 1104 has various geological formations and properties, e.g., 1104*a*, 1104*b*, 1104*c*. The geological properties and characteristic of the formation and hydrocarbon deposit have been previously determined by seismic, well logging and other means known to the arts. Based upon this information a custom laser energy delivery perforating pattern 1120 was designed to extend from borehole 1103 and is delivered to the formation 1104. The laser perforating pattern 1120 has a series of laser perforations 1121*a*-1121*s*.

The position, spacing and orientation of these laser perforations 1121*a*-1121*s* is based in whole, or in part, upon the characteristics and features of the formation in which the laser pattern is delivered. As can be seen from FIG. 10, and for illustration purposes the perforation may have different lengths, may have different orientations to vertical, may have different angles with respect to the longitudinal axis of the borehole, and combinations and variations of these and other properties. Further, the perforation pattern and laser delivery pattern, because of its fracturing and weakening effect on the formation, may also be predetermined to enhance, augment, or replace hydraulic fracturing.

Figure 11:
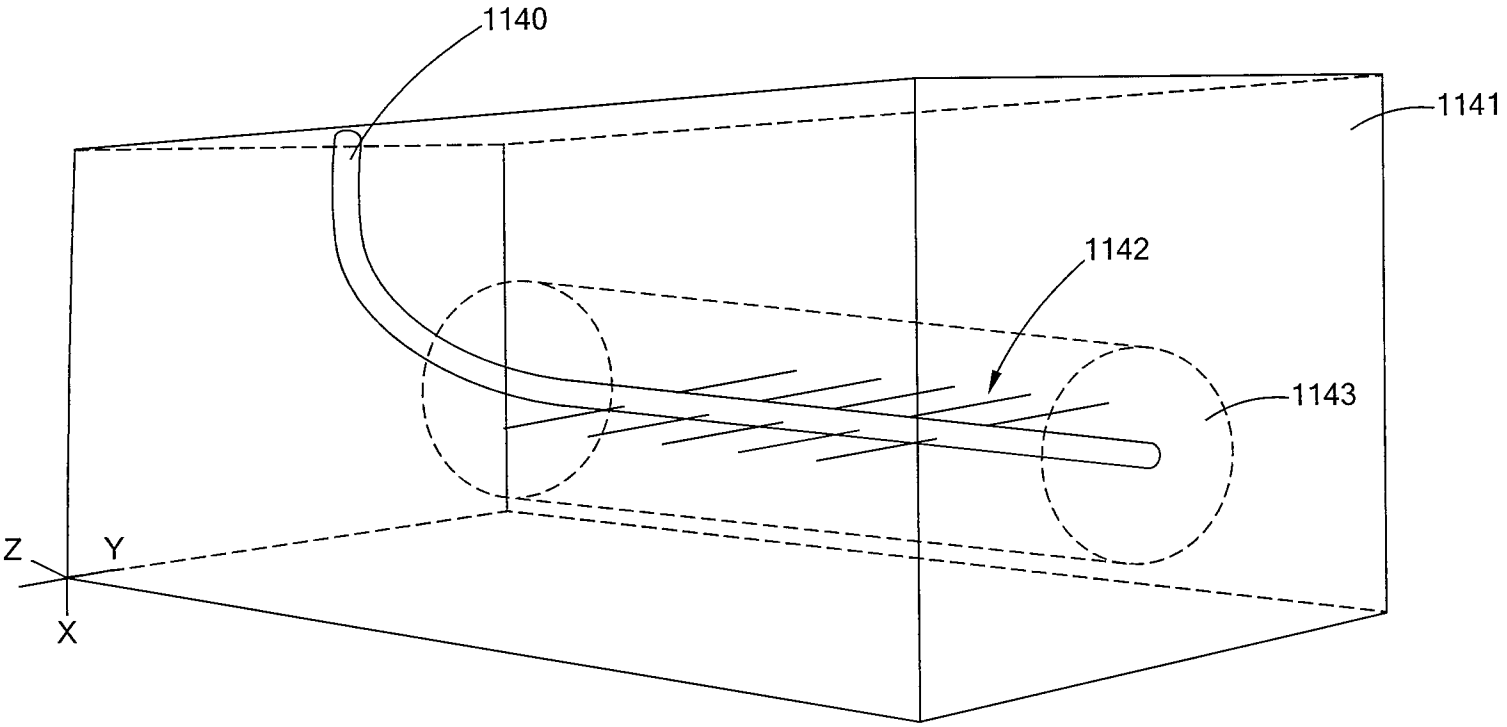
FIG. 11 is a perspective view of an embodiment of a laser energy delivery pattern in accordance with the present inventions.

Turning to FIG. 11 there is shown a bore hole 1140 in a section of a formation 1141. An essentially horizontal laser perforation pattern 1142 has been made from the borehole, resulting in a predetermined laser effected zone 1143, e.g., custom geometry (shown in dashed lines), which zone has laser induced fracturing. Hydraulicfracturing operations can then be applied to this custom geometry, if needed, to further enhance fluid communication between the borehole and the formation.

Figure 12:
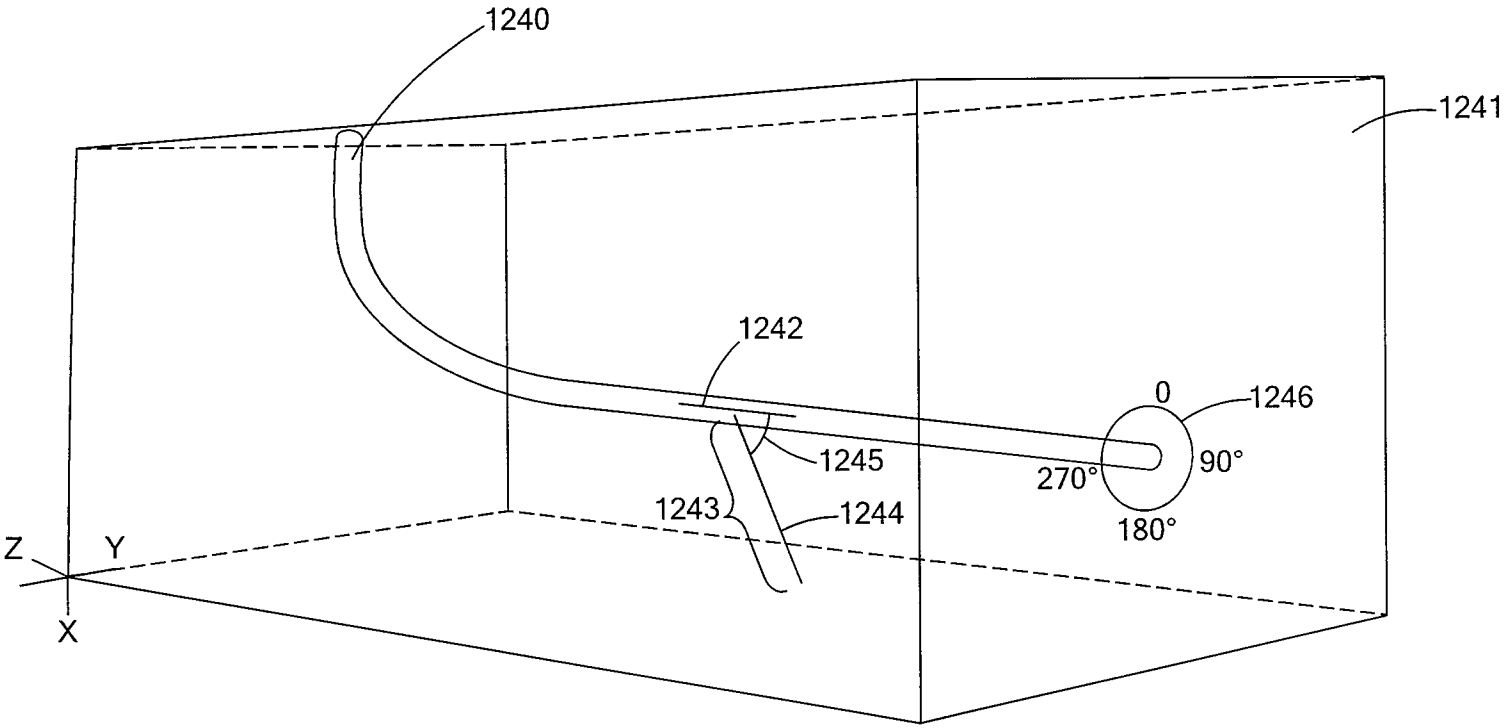
FIG. 12 is a perspective view of an embodiment of a laser energy delivery pattern in accordance with the present inventions.

FIG. 12 shows a borehole 1240 in a section of a formation 1241. The borehole has a single laser perforation 1244. A single perforation is used in this figure to illustrate the different variables that are controllable through laser perforation and which can, in whole or in part, be used to provide a predetermined laser perforation delivery pattern. The laser perforation can be varied in length 1243. The angle 1245 that the perforation forms with the longitudinal axis of the borehole (also typically the laser perforation tool) can be varied. The orientation around the borehole, e.g., degrees 1246 around the borehole can be varied, e.g., for 0° to 90° to 180° to 270° to 0°, and thus, any point point around 360°. Additional, since it is preferred to have a multiple perforations, there spacing can be varied, and the other variables can be changed from one adjacent perforation to the next.

In additional to providing an entire laser perforation pattern based upon formation information, in whole, in part or without such information, it is possible to construct an evolving laser perforation pattern based upon real time pressure testing in the well. Thus, for example straddle packers may be employed with the laser perforation tool. The packers are set and the area is pressured up; changes, as measured with a caliper assembly for example, are then measured. From this information the strength of the formation and its strength in different directions can be measured and used to direct the laser beam to provide the optimum configuration of laser perforations for that specifically tested section of the formation.

Figure 13:
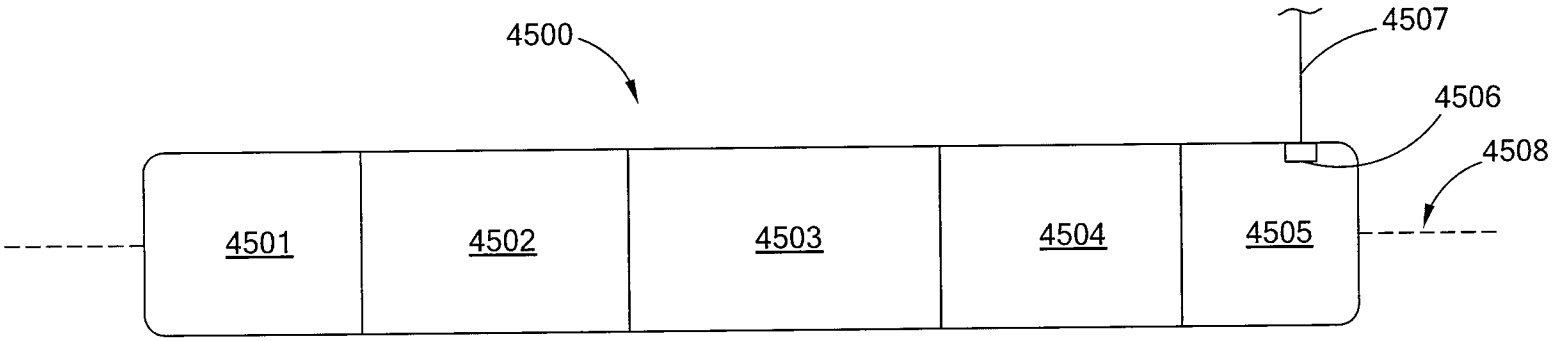
FIG. 13 is schematic view of an embodiment of a laser perforating tool in accordance with the present inventions.

Turning to FIG. 13 there is provided a schematic of an embodiment of a laser tool 4500 having a longitudinal axis shown by dashed line 4508. This tool could be used for, perforating as well as other things, such as pipe cutting, decommissioning, plugging and abandonment, window cutting, and milling. The laser cutting tool 4500 has a conveyance termination section 4501. The conveyance termination section 4501 would receive and hold, for example, a composite high power laser umbilical, a coil tube having for example a high power laser fiber and a channel for transmitting a fluid for the laser cutting head, a wireline having a high power fiber, or a slick line and high power fiber, or other type of conveyance structure. The laser tool 4500 has an anchor and positioning section 4502. The anchor and positioning section (which may be a single device or section, or may be separate devices within the same of different sections) may have a centralizer, a packer, or shoe and piston or other mechanical, electrical, magnetic or hydraulic device that can hold the tool in a fixed and predetermined position longitudinally (e.g., along the length of the borehole), axially (e.g., with respect to the axis of the borehole, or within the cross-section of the borehole) or both. The section may also be used to adjust and set the stand off distance that the laser head is from the surface to be perforated.

The laser tool 4500 has a motor section, which may be an electric motor, a step motor, a motor driven by a fluid, or other device to rotate the laser cutter head, or cause the laser beam path to rotate. The rotation of the laser tool, or laser head, may also be driven by the forces generated by the jet, either the laser fluid jet or a separate jet. For example, if the jet exits the tool at an angle or tangent to the tool it may cause rotation. In this configuration the laser fiber, and fluid path, if a fluid used in the laser head, passes by or through the motor section 4503. Motor, optic assemblies, and beam and fluid paths disclosed and taught in US Patent Application Publication No. 2012/0267168, the entire disclosure of which is incorporated herein by reference, may be utilized. There is provided an optics section 4504, which for example, may shape and direct the beam and have optical components such as a collimating element or lens and a focusing element or lens. Optics assemblies, packages and optical elements disclosed and taught in US Patent Application Publication No. 2012/0275159, the entire disclosure of which is incorporated herein by reference, may be utilized.

There is provided a laser cutting head section 4505, which directs and moves the laser beam along a laser beam path 4507. In this embodiment the laser cutting head 4505 has a laser beam exit 4506. In operation the laser beam path may be rotated through 360 degrees to perform a complete circumferential cut of a tubular. (The laser beam may also be simultaneously moved linearly and rotationally to form a spiral, s-curve, figure eight, or other more complex shaped cut.) The laser beam path 4507 may also be moved along the axis 4508 of the tool 4500. The laser beam path also may not be moved during propagation or delivery of the laser beam. In these manners, circular cuts, windows, perforations and other predetermined shapes may be made to a borehole (cased or open hole), a tubular, a support member, or a conductor. In the embodiment of FIG. 45, as well as some other embodiments, the laser beam path 4507 forms a 90-degree angle with the axis of the tool 4508. This angle could be greater than 90 degrees or less then 90 degrees.

The laser cutting head section 4505 preferably may have any of the laser fluid jet heads provided in this specification, it may have a laser beam delivery head that does not use a fluid jet, and it may have combinations of these and other laser delivery heads that are known to the art.

Figure 14:
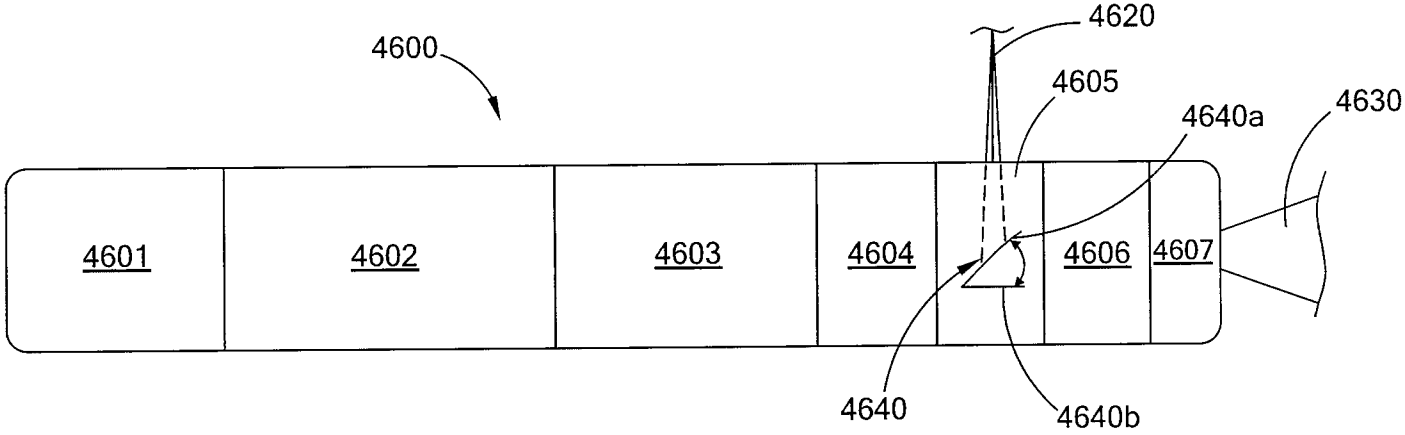
FIG. 14 is schematic view of an embodiment of a laser perforating tool in accordance with the present inventions.

Turning to FIG. 14, there is shown an embodiment of a laser perforating tool 4600. The laser cutting and perferating tool 4600 has a conveyance termination section 4601, an anchoring and positioning section 4602, a motor section 4603, an optics package 4604, an optics and laser cutting head section 4605, a second optics package 4606, and a second laser cutting head section 4607. The conveyance termination section would receive and hold, for example, a composite high power laser umbilical, a coil tube having for example a high power laser fiber and a channel for transmitting a fluid for the laser cutting head, a wireline having a high power fiber, or a slick line and high power fiber.

The anchor and positioning section may have a centralizer, a packer, or shoe and piston or other mechanical, electrical, magnetic or hydraulic device that can hold the tool in a fixed and predetermined position both longitudinally and axially. The section may also be used to adjust and set the stand off distance that the laser head is from the surface to be cut. The motor section may be an electric motor, a step motor, a motor driven by a fluid or other device to rotate one or both of the laser cutting heads or cause one or both of the laser beam paths to rotate.

The optics and laser cutting head section 4605 has a mirror 4640. The mirror 4640 is movable between a first position 4640*a*, in the laser beam path, and a second position 4640*b*, outside of the laser beam path. The mirror 4640 may be a focusing element. Thus, when the mirror is in the first position 4640*a*, it directs and focuses the laser beam along beam path 4620. When the mirror is in the second position 4640*b*, the laser beam passes by the mirror and enters into the second optics section 4606, where it may be preferably shaped into a larger circular spot (having a diameter greater than the tools diameter), or a substantially linear or elongated eliptical pattern, for delivery along beam path 4630. Two fibers and optics assemblies may used, a beam splitter within the tool, or other means to provide the two laser beam paths 4620, 4630 may be used.

The tool of the FIG. 14 embodiment may be used in addition to performing, for example, in the boring, sidetracking, window milling, rat hole formation, radially cutting, and sectioning operations, wherein beam path 4630 would be used for boring and beam path 4620 would be used for the axial cutting, perforating and segmenting of the structure. Thus, the beam path 4620 could be used to cut a window in a cased borehole and the formation behind the casing. A whipstock, or other off setting device, could be used to direct the tool into the window where the beam path 4630 would be used to form a rat hole; or depending upon the configuration of the laser head 4607, e.g., if it where a laser mechanical bit, continue to advance the borehole. Like the embodiment of FIG. 14, the laser beam path 4620 may be rotated and moved axially. The laser beam path 4630 may also be rotated and preferably should be rotated if the beam pattern is other than circular and the tool is being used for boring. The embodiment of FIG. 46 may also be used to clear, pierce, cut, or remove junk or other obstructions from the bore hole to, for example, facilitate the pumping and placement of cement plugs during the plugging of a bore hole.

The laser head section 4607 preferably may have any of the laser fluid jet heads provided in this specification and in US Published Application Publication No. 2012/0074110, the entire disclosure of which is incorporated herein by reference, it may have a laser beam delivery head that does not use a fluid jet, and it may have combinations of these and other laser delivery heads that are known to the art.

Figure 15:
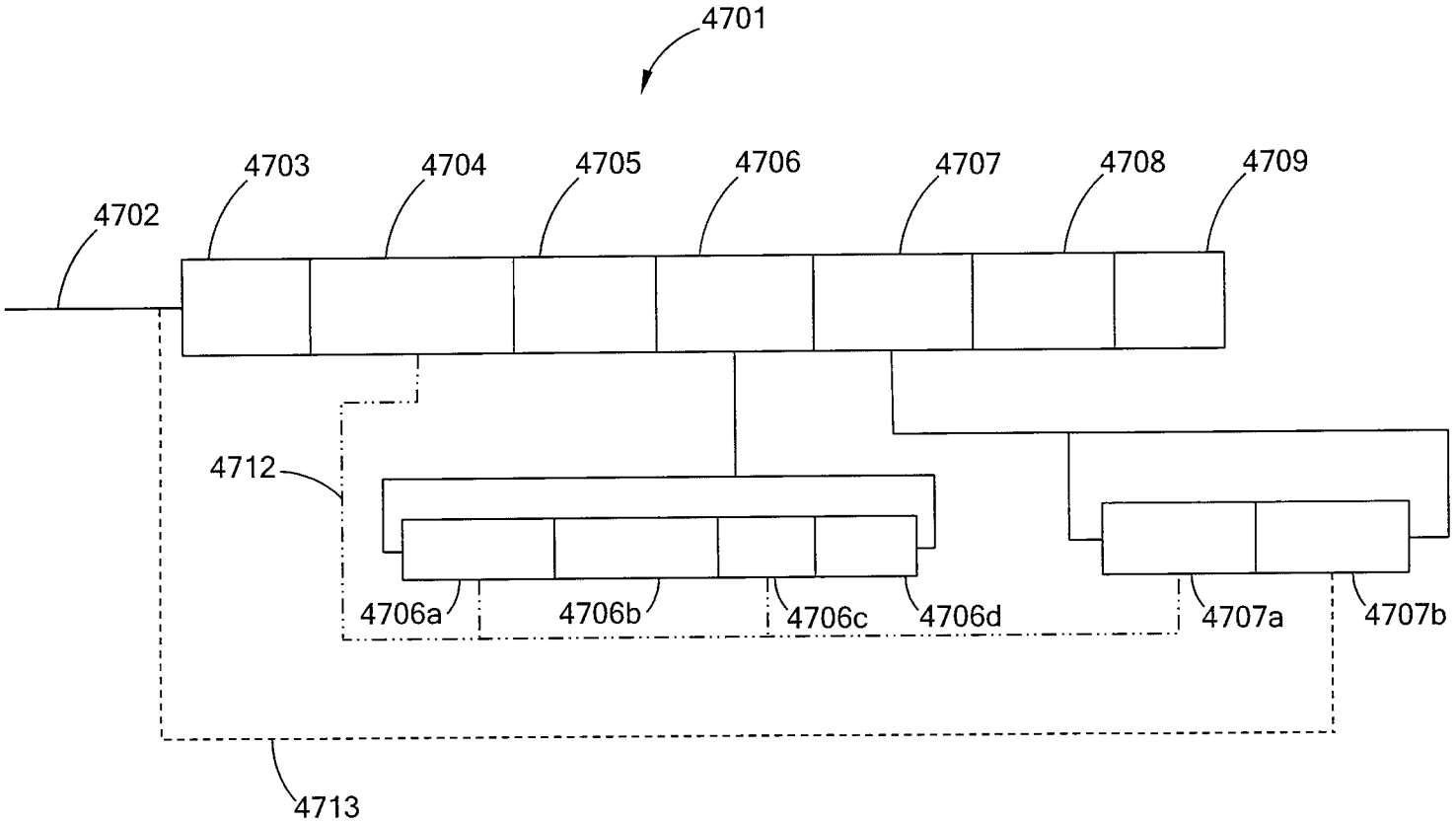
FIG. 15 is schematic view of an embodiment of a laser perforating tool in accordance with the present inventions.

Turning to FIG. 15 there is provided a schematic of an embodiment of a laser tool. The laser tool 4701 has a conveyance structure 4702, which may have an E-line, a high power laser fiber, and an air pathway. The conveyance structure 4702 connects to the cable/tube termination section 4703. The tool 4701 also has an electronics cartridge 4704, an anchor section 4705, an hydraulic section 4706, an optics/cutting section (e.g., optics and laser head) 4707, a second or lower anchor section 4708, and a lower head 4709. The electronics cartridge 4704 may have a communications point with the tool for providing data transmission from sensors in the tool to the surface, for data processing from sensors, from control signals or both, and for receiving control signals or control information from the surface for operating the tool or the tools components. The anchor sections 4705, 4708 may be, for example, a hydraulically activated mechanism that contacts and applies force to the borehole. The lower head section 4709 may include a junk collection device, or a sensor package or other down hole equipment. The hydraulic section 4706 has an electric motor 4706*a*, a hydraulic pump 4606*b*, a hydraulic block 4706*c*, and an anchoring reservoir 4706*d*. The optics/cutting section 4707 has a swivel motor 4707*a* and a laser head section 4707*b*. Further, the motors 4704*a* and 4706*a* may be a single motor that has power transmitted to each section by shafts, which are controlled by a switch or clutch mechanism. The flow path for the gas to form the fluid jet is schematically shown by line 4713. The path for electrical power is schematically shown by line 4712. The laser head section 4707*b* preferably may have any of the laser fluid jet heads provided in this specification, it may have a laser beam delivery head that does not use a fluid jet, and it may have combinations of these and other laser delivery heads that are known to the art.

Figure 17A:
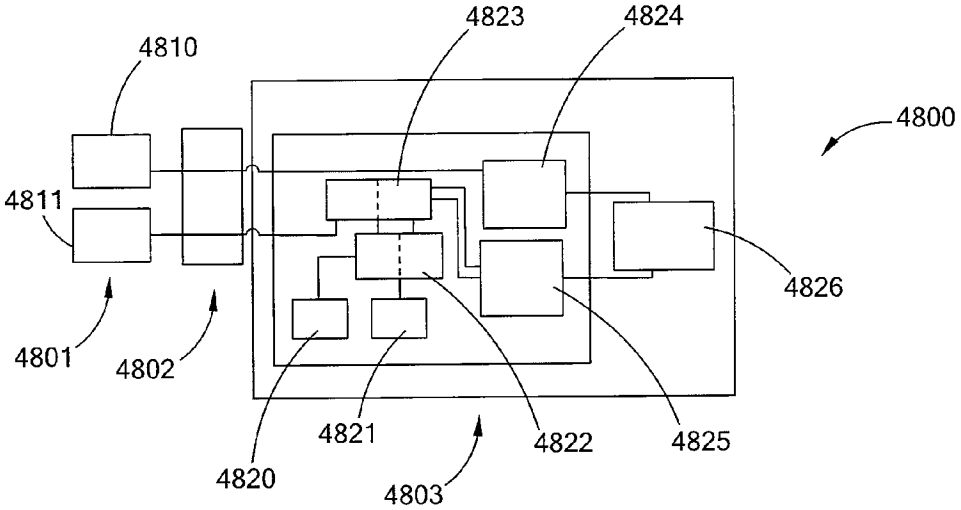
FIG. 17A is schematic view of an embodiment of a laser perforating tool in accordance with the present inventions.
Figure 17B:
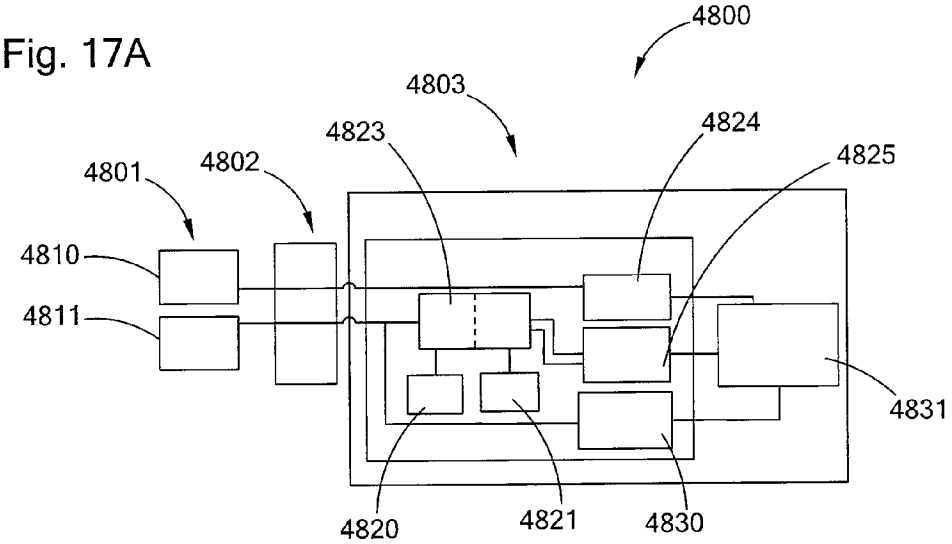
FIG. 17B is schematic view of an embodiment of a laser perforating tool in accordance with the present inventions.
Figure 18A:
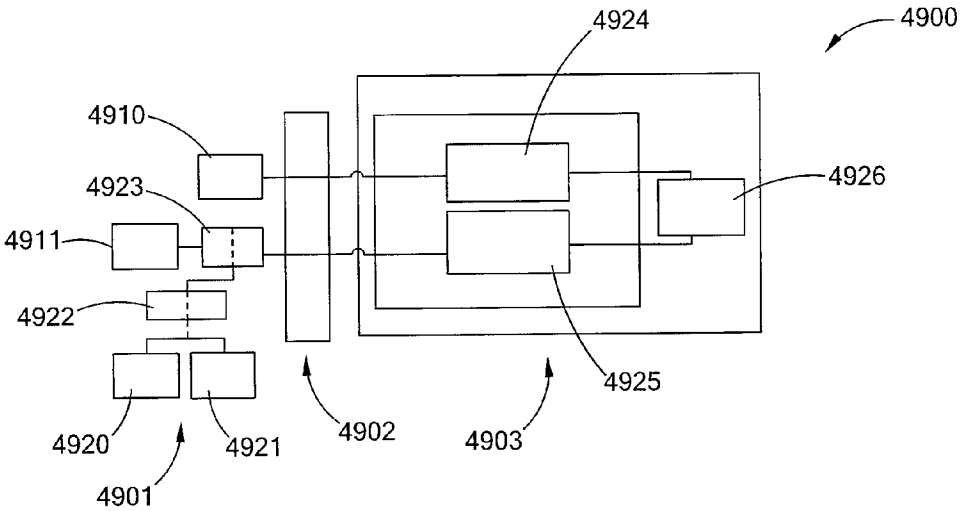
FIG. 18A is schematic view of an embodiment of a laser perforating tool in accordance with the present inventions.
Figure 18B:
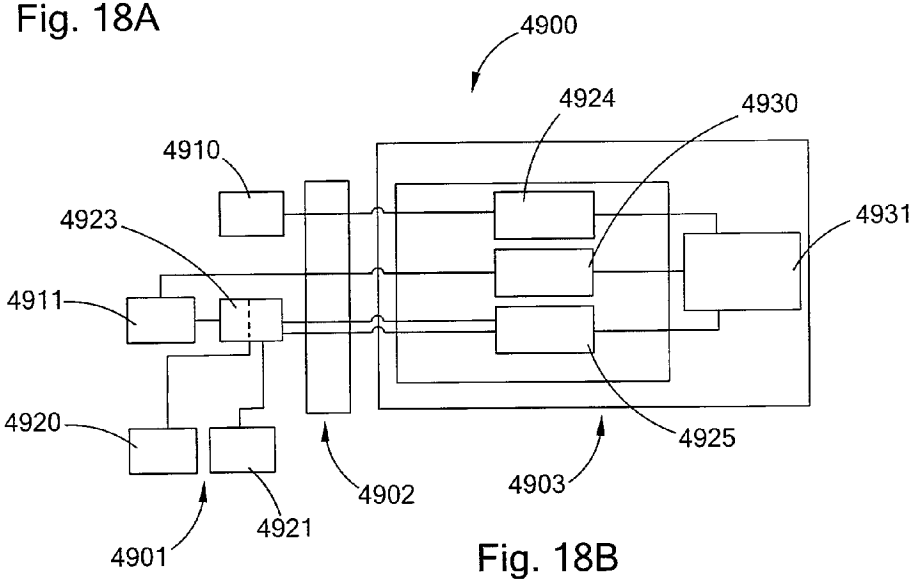
FIG. 18B is schematic view of an embodiment of a laser perforating tool in accordance with the present inventions.

FIGS. 17A and 18B show schematic layouts for perforating and cutting systems using a two fluid dual annular laser jet. Thus, there is an uphole section 4801 of the system 4800 that is located above the surface of the earth, or outside of the borehole. There is a conveyance section 4802, which operably associates the uphole section 4801 with the downhole section 4803. The uphole section has a high power laser unit 4810 and a power supply 4811. In this embodiment the conveyance section 4802 is a tube, a bunched cable, or umbilical having two fluid lines and a high power optical fiber. In the embodiment of FIG. 17A the downhole section has a first fluid source 4820, e.g., water or a mixture of oils having a predetermined index of refraction, and a second fluid source 4821, e.g., an oil having a predetermined and different index of refraction from the first fluid. The fluids are feed into a dual reservoir 4822 (the fluids are not mixed and are kept separate as indicated by the dashed line), which may be pressurized and which feeds dual pumps 4823 (the fluids are not mixed and are kept separate as indicated by the dashed line). In operation the two fluids 4820, 4821 are pumped to the dual fluid jet nozzle 4826. The high power laser beam, along a beam path enters the optics 4824, is shaped to a predetermined profile, and delivered into the nozzle 4826. In the embodiment of FIG. 17B a control head motor 4830 has been added and controlled motion laser jet 4831 has been employed in place of the laser jet 4826. Additionally, the reservoir 4822 may not used, as shown in the embodiment of FIG. 48B.

Turning to FIGS. 18A and 18B there is shown schematic layouts for cutting and perforating systems using a two fluid dual annular laser jet. Thus, there is an uphole section 4901 of the system 4900 that is located above the surface of the earth, or outside of the borehole. There is a conveyance section 4902, which operably associates the uphole section 4901 with the downhole section 4903. The uphole section has a high power laser unit 4910 and a power supply 4911 and has a first fluid source 4920, e.g., a gas or liquid, and a second fluid source 4921, e.g., a liquid having a predetermined index of refraction. The fluids are fed into a dual reservoir 4922 (the fluids are not mixed and are kept separate as indicated by the dashed line), which may be pressurized and which feeds dual pumps 4923 (the fluids are not mixed and are kept separate as indicated by the dashed line). In operation the two fluids 4920, 4921 are pumped through the conveyance section 4902 to the downhole section 4903 and into the dual fluid jet nozzle 4926. In this embodiment the conveyance section 4902 is a tube, a bunched cable, or umbilical. For FIG. 18A the conveyance section 4902 would have two fluid lines and a high power optical fiber In the embodiment of FIG. 49B the conveyance section 4902 would have two fluid lines, an electric line and a high power optical fiber. In the embodiment of FIG. 18A the downhole section has an optics assembly 4924 and a nozzle 4925. The high power laser beam, along a beam path enters the optics 4924, where it may be shaped to a predetermined profile, and delivered into the nozzle 4926. In the embodiment of FIG. 18B a control head motor 4930 has been added and controlled motion laser jet 4931 has been employed in place of the laser jet 4926. Additionally, the reservoir 4922 may not used as shown in the embodiment of FIG. 18B.

Downhole tractors and other types of driving or motive devices may be used with the laser tools. These devices can be used to advance the laser tool to a specific location where a laser process, e.g., a laser cut is needed, or they can be used to move the tool, and thus the laser head and beam path to deliver a particular pattern to make a particular cut. It being understood that the arrangement and spacing of these components in the tool may be changed, and that additional and different components may be used or substituted in, for example, such as a MWD/LWD section.

The high power laser fluid jets, laser heads and laser delivery assemblies disclosed and taught in US Patent Application Publ. No. 2012/0074110, the entire disclosure of which is incorporated herein by reference, may be used with, in, for, and as a part of the laser perforating tools and methods of the present inventions.

Laser fluid jets, and their laser tools and systems may provide for the creation of perforations in the borehole that can further be part of, or used in conjunction with, recovery activities such as geothermal wells, EGS (enhanced geothermal system, or engineered geothermal system), hydraulic fracturing, micro-fracturing, recovery of hydrocarbons from shale formations, oriented perforation, oriented fracturing and predetermined perforation patterns. Moreover, the present inventions provide the ability to have precise, varied and predetermined shapes for perforations, and to do so volumetrically, in all dimensions, i.e. length, width, depth and angle with respect to the borehole.

Thus, the present inventions provide for greater flexibility in determining the shape and location of perforations, than the conical perforation shapes that are typically formed by explosives. For example, perforations in the geometric shape of slots, squares, rectangles, ellipse, and polygons that do not diminish in area as the perforation extend into the formation, that expand in area as the perforation extends into the formation, or that decrease in area, e.g., taper, as the perforation extends into the formation are envisioned with the present inventions. Further, the locations of the perforation along the borehole can be adjusted and varied while the laser tool is downhole; and, as logging, formation, flow, pressure and measuring data is received. Thus, the present inventions provide for the ability to precisely position additional perforations without the need to remove the perforation tool from the borehole.

Accordingly, there is provided a procedure where a downhole tool having associated with it a logging and/or measuring tool and a fluid laser jet tool is inserting into a borehole. The laser tool is located in a desired position in the borehole (based upon real-time data, based upon data previously obtained, or a combination of both types of data) and a first predetermined pattern of perforations is created in that location. After the creation of this first set of perforations additional data from the borehole is obtained, without the removal of the laser tool, and based upon such additional data, a second pattern for additional perforations is determined (different shapes or particular shapes may also be determined) and those perforations are made, again without removal of the laser tool from the well. This process can be repeated until the desired flow, or other characteristics of the borehole are achieved.

Thus, by way of example and generally, in an illustrative hydro-fracturing operation water, proppants, e.g., sand, and additives are pumped at very high pressures down the borehole. These liquids flow through perforated sections of the borehole, and into the surrounding formation, fracturing the rock and injecting the proppants into the cracks, to keep the crack from collapsing and thus, the proppants, as their name implies, hold the cracks open. During this process operators monitor and gauge pressures, fluids and proppants, studying how they react with and within the borehole and surrounding formations. Based upon this data the typically the density of sand to water is increased as the frac progresses. This process may be repeated multiple times, in cycles or stages, to reach maximum areas of the wellbore. When this is done, the wellbore is temporarily plugged between each cycle to maintain the highest water pressure possible and get maximum fracturing results in the rock. These so called frac-plugs are drilled or removed from the wellbore and the well is tested for results. When the desired results have been obtained the water pressure is reduced and fluids are returned up the wellbore for disposal or treatment and re-use, leaving the sand in place to prop open the cracks and allow the hydrocarbons to flow. Further, such hydraulic fracturing can be used to increase, or provide the required, flow of hot fluids for use in geothermal wells, and by way of example, specifically for the creation of enhanced (or engineered) geothermal systems ("EGS").

The present invention provides the ability to greatly improve upon the typical fracing process, described above. Thus, with the present invention, preferably before the pumping of the fracing components begins, a very precise and predetermined perforating pattern can be placed in the borehole. For example, the shape, size, location and direction of each individual perforation can be predetermined and optimized for a particular formation and borehole. The direction of the individual perforation can be predetermined to coincide with, complement, or maximize existing fractures in the formation. Thus, although is it is preferred that the perforations are made prior the introduction of the fracing components, these steps maybe done at the same time, partially overlapping, or in any other sequence that the present inventions make possible. Moreover, this optimization can take place in real-time, without having to remove the laser tool of the present invention form the borehole. Additionally, at any cycle in the fracturing process the laser tool can be used to further maximize the location and shape of any additional perforations that may be desirable. The laser tool may also be utilized to remove the frac-plugs.

Figure 19:
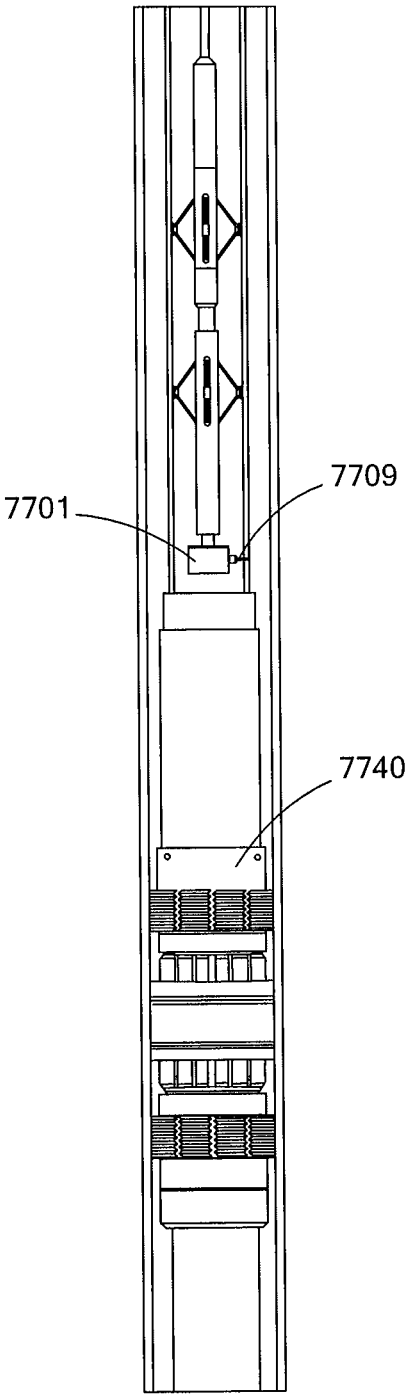
FIG. 19 is schematic view of an embodiment of a laser perforating tool in accordance with the present inventions.
Figure 20:
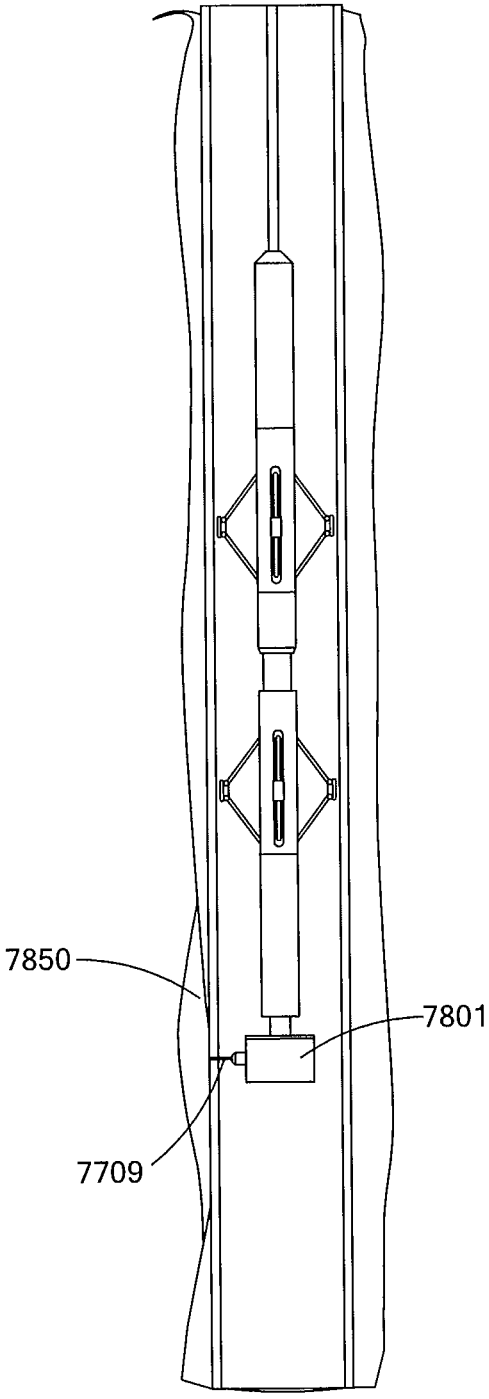
FIG. 20 is schematic view of an embodiment of a laser perforating tool in accordance with the present inventions.
Figure 21:
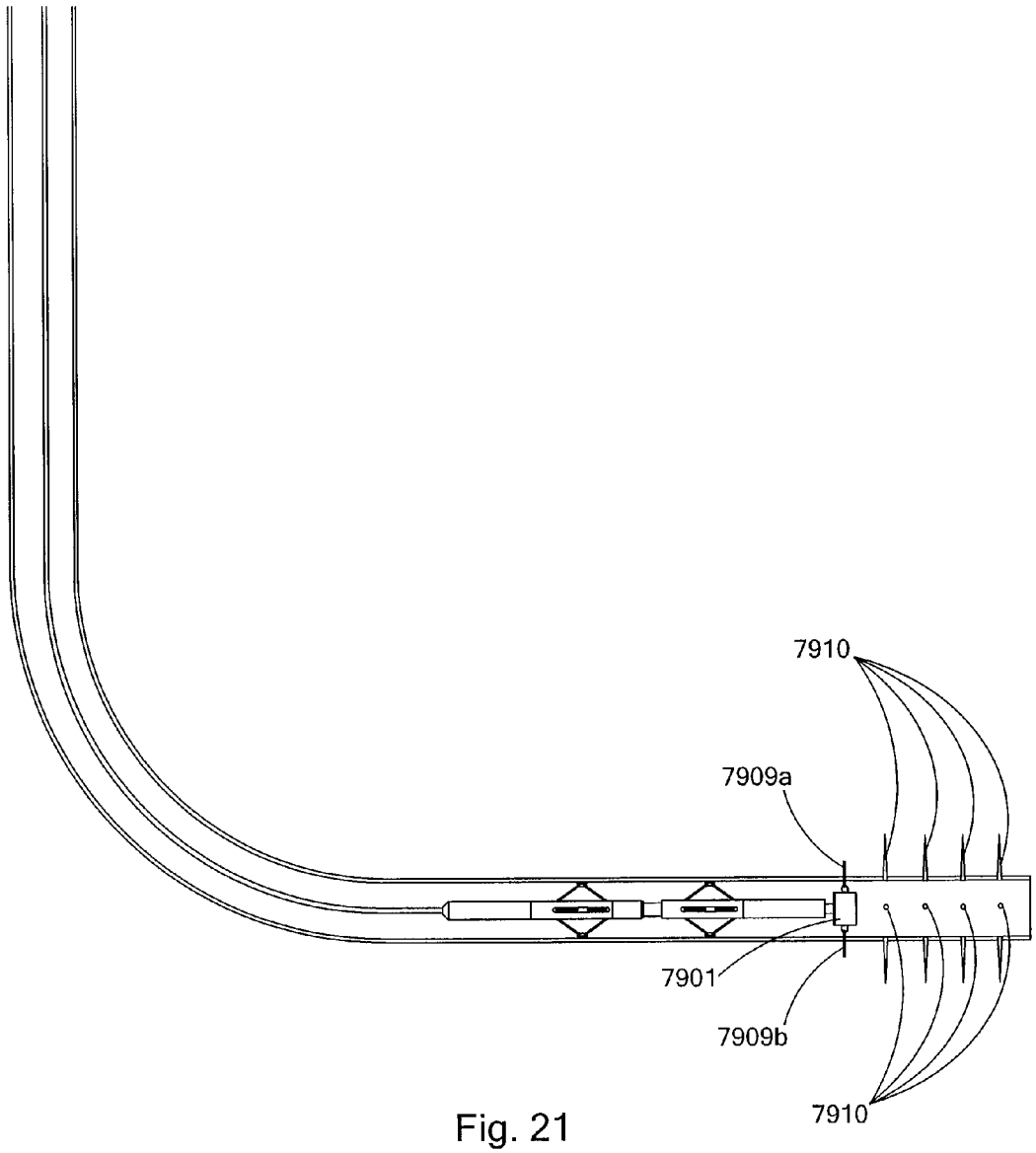
FIG. 21 is schematic view of an embodiment of a laser perforating tool in accordance with the present inventions.

Applications for perforating of tubing and casing with embodiments of laser tools, systems, methods and devices are shown in FIGS. 19, 20 and 21. The perforating of casing and tubing is done as a means of establishing communication between two areas previously isolated. The most common type of perforating done is for well production, the exposure of the producing zone to the drilled wellbore to allow product to enter the wellbore and be transported to surface facilities. Similar perforations are done for injection wells, providing communication to allow fluids and or gases to be injected at surface and placed into formation. Workover operations often require perforating to allow the precise placement of cement behind casing to ensure adequate bond/seal or the establishing of circulation between two areas previously sealed due to mechanical failure within the system.

These perforations are typically done with explosive charges and projectiles, deployed by either electric line/wireline or by tubing, either coiled or jointed. The charges can be set fired by electric signal or by pressure activated mechanical means.

Using the laser system many, if not all, of the disadvantages of the existing non-laser procedures may be reduced, substantially reduced or eliminated. The laser system for perforating includes a laser cutting head 7701, 7801, 7901, which propagates a laser beam(s) 7709, 7809, 7909*a* and 7909*b*, an anchoring or an anchoring/tractor device, 7704, 7804, 7904 an imaging tool and a direction/inclination/orientation measurement tool. The assembly is conveyed with a wireline style unit and a hybrid electric line. The assembly is capable of running in to a well and perforating multiple times through the wellbore in a single trip, with the perforations 7910 specifically placed in distance, size, frequency, depth, and orientation. The tool is also capable of cutting slots in the pipe to maximize exposure while minimizing solids production from a less-than-consolidated formation. In a horizontal wellbore, the tractor 7904 is engaged to move the assembly while perforating. The tool is capable of perforating while underbalanced, even while the well is producing, allowing evaluation of specific zones to be done as the perforating is conducted. The tool is relatively short, allowing deployment method significantly easier than traditional underbalanced perforating systems. In FIG. 19 the tool is positioned above a packer 7740 to establish an area to be perforated that has an established circulation, in FIG. 78 the tool is being used to cut access to an area of poor cement bond 7850.

For single shot applications, there is no need for explosive permitting and the associated safety measures required on a job location, with the system having the ability to run in the well and precisely place a hole of desired dimension, without risk of damage to other components within the wellbore safely and quickly.

An example of another application for the present laser tools, systems, methods and devices is a to provide a new subsurface method of geothermal heat recovery from existing wells situated in permeable sedimentary formations. This laser based method minimizes water consumption and may also eliminate or reduces the need for hydraulic fracturing by deploying the present laser tools to cut long slots extending along the length (top to bottom) of the well and thus providing greatly increased and essentially maximum contact with the heat resource in preferably a single down hole operation.

The existing well infrastructure system in the United States includes millions of abandoned wells in sedimentary formations, many at temperatures high enough to support geothermal production. These existing wells were originally completed to either minimize water flow or bypass water-bearing zones, and would need to be converted (i.e. re-completed) to support geothermal heat recovery. Such wells may be re-completed and thus converted into a geothermal well using the present laser cutting tools. The slots that these laser tools can cut increases geothermal fluid flow by increasing wellbore-to-formation surface area. The present laser tools may rapidly create long vertical slots (hundreds to thousands of feet long) in the casing, cement and formation in existing wells in a single downhole operation (by contrast, perforation requires many trips due to the consumptive use of explosives). These long laser created slots can cover the entire water-bearing zone of the well, and thus, maximize water flow rates and heat recovery. In turn, the need for acidizing and hydraulic fracturing may also be reduced or eliminated, further decreasing costs. The long laser cut slots provide several benefits, including: higher flow rates; increases in the wellbore/formation surface area; reduction in the risk of missing high-permeability sections of the formation due to perforation spacing; and, eliminating or reducing the crushed zone effect that is present with explosive perforations.

Figure 22:
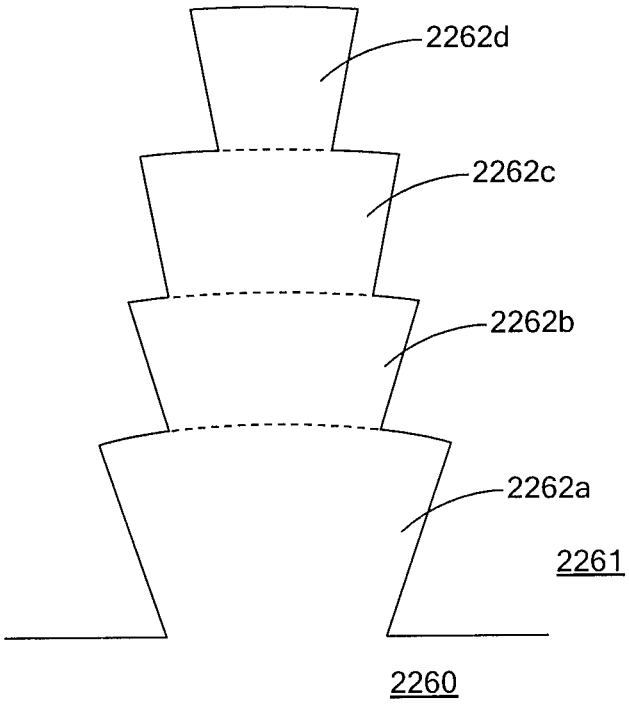
FIG. 22 is schematic view of an embodiment of a laser energy delivery pattern in accordance with the present inventions.

FIG. 22 shows a stepping down fan perforating pattern that can be implemented with the present laser perforation tools. In this pattern a series of progressively smaller fan shapes 2262*a*, 2262*b*, 2262*c*, 2262*d* are cut into formation 2261 moving away from borehole 2260. The dashed lines indicated the end of a first fan pattern that was cut through with the deeper, and later in time, fan pattern.

Figure 23A:
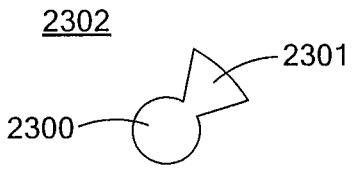
FIGS. 23A and 23B are plan and perspective views respectively of an embodiment of a laser energy delivery pattern in accordance with the present inventions.
Figure 23B:
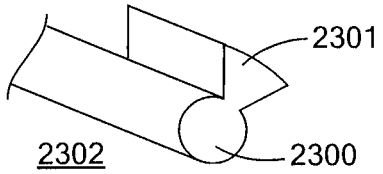

FIG. 23A is a plan view looking down borehole 2300 showing fan, or pie shape perforation 2301 in formation 2302. FIG. 23B is a perspective view along the longitudinal axis of borehole 2300 showing that pie shape perforation 2301 is a volumetric shape extending along the borehole 2300. The length of pie shaped perforation 2301 may be a few inches to a few feet, tens of feet or more. Additionally more than one pie shaped perforation can be space along the length of the borehole.

Figure 24A:
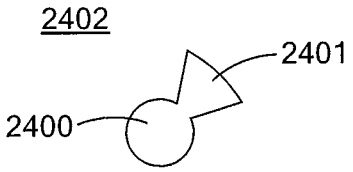
FIGS. 24A and 24B are plan and perspective views respectively of an embodiment of a laser energy delivery pattern in accordance with the present inventions.
Figure 24B:
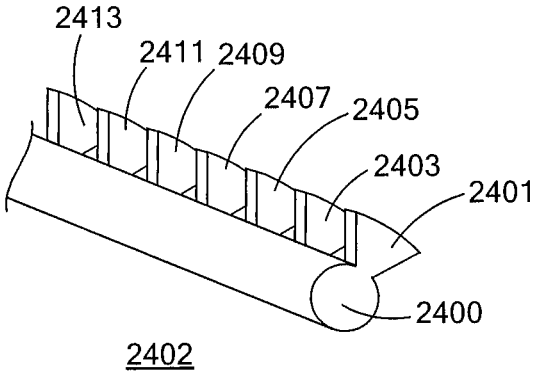

FIG. 24A is a plan view looking down borehole 2400 showing fan, or pie shape perforation 2401 in formation 2402. FIG. 24B is a perspective view along the longitudinal axis of borehole 2400 showing that there are a number of pie shape perforation 2401, 2403, 2405, 2407, 2409, 2411, 2413 spaced along the length of the borehole 2401 and that each is a volumetric shape extending along the length of the borehole 2400. The length of pie shaped perforation 2401, 2403, 2405, 2407, 2409, 2411, 2413, may be a few inches to a few feet, tens of feet or more. Their lengths, and their spacing may be uniform, or it may be staged to, for example, match to formation characteristics to optimize fluid communication between the borehole and the formation.

Figure 25A:
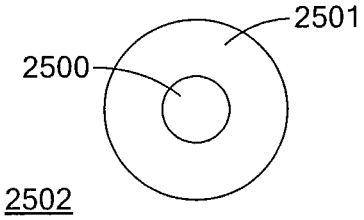
FIGS. 25A and 25B are plan and perspective views respectively of an embodiment of a laser energy delivery pattern in accordance with the present inventions.
Figure 25B:
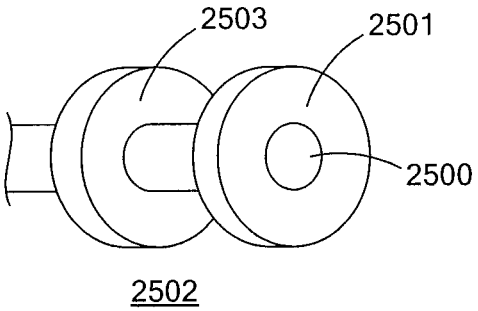

FIG. 25A is a plan view looking down borehole 2500 showing a disk shaped perforation 2501 in formation 2502. FIG. 25B is a perspective view along the longitudinal axis of borehole 2500 showing that there are a number of disk shape perforation 2501, 2503, spaced along the length of the borehole 2501 and that each is a volumetric shape extending along the length of the borehole 2500. The length of disk shaped perforation 2501, 2503 may be an inch, few inches to a few feet, but should not be so long as to adversely effect the stability of the well bore. Their lengths, and their spacing may be uniform, or it may be staged to, for example, match to formation characteristics to optimize fluid communication between the borehole and the formation.

Figure 26B:
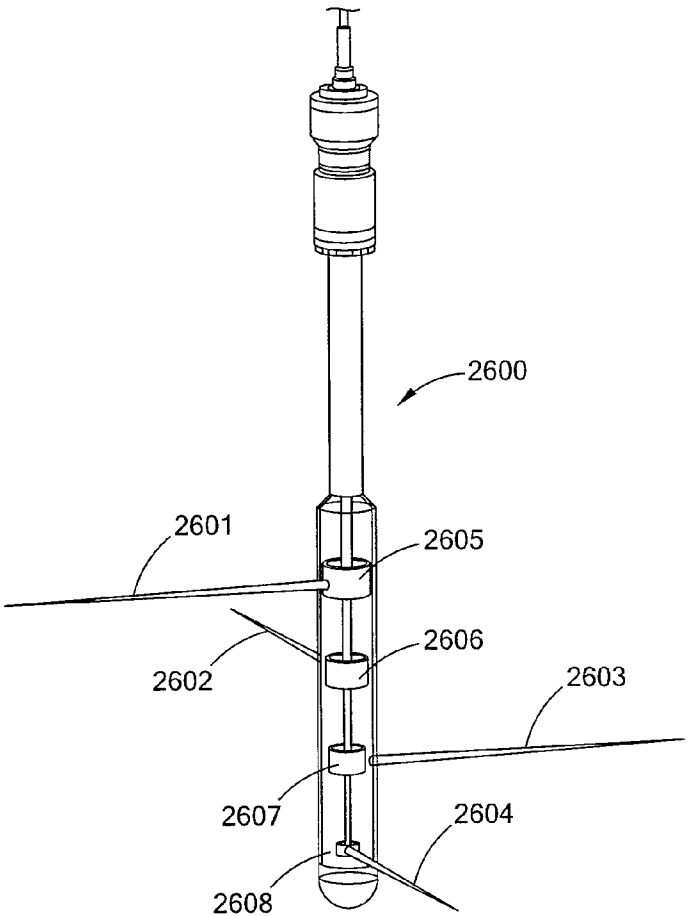
FIG. 26B is a cutaway perspective view of the embodiment of FIG. 26A.
Figure 26A:
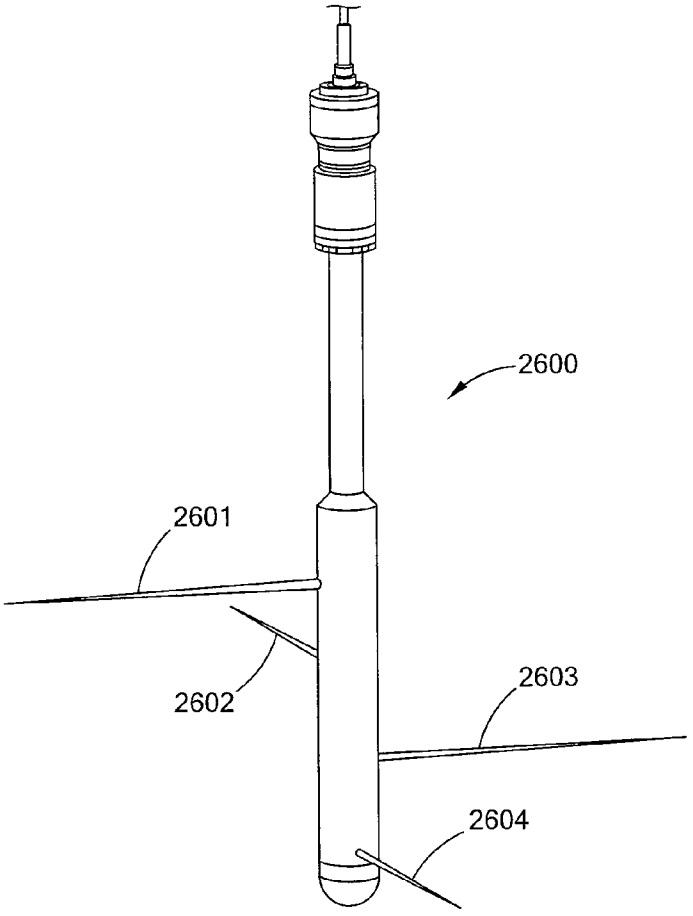
FIG. 26A is a perspective view of an embodiment of a laser perforating tool in accordance with the present inventions.
Figure 26C:
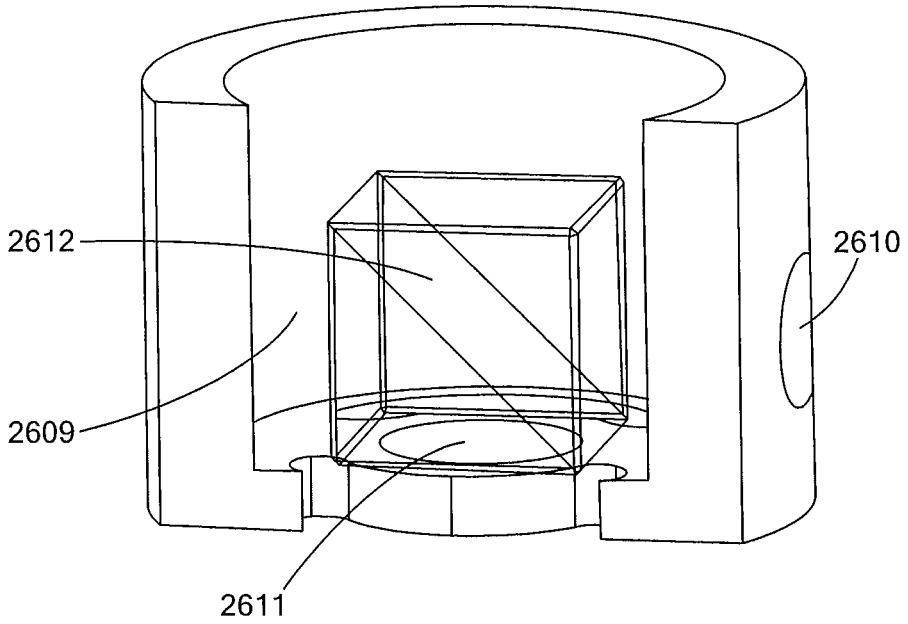
FIG. 26C is a cutaway perspective view of a component of the embodiment of FIG. 26A.

Turning to FIG. 26A there is provided a perspective view of an embodiment of a laser perforating tool 2600 having four laser beam delivery assemblies 2605, 2606, 2607, 2608, which deliver four laser beams 2601, 2602, 2603, 2604 to form perforations in the borehole side wall and formation. Laser beam delivery assemblies, 2605, 2606, 2607 each have a beam splitter, e.g., 2612, in a housing which has air cooling passage 2609, and laser path openings 2610, 2611. The bottom laser delivery assembly has a TIR prism for directing laser beam 2604.

The laser perforating tools may also find applications in activities such as: off-shore activities; subsea activities; decommissioning structures such as, oil rigs, oil platforms, offshore platforms, factories, nuclear facilities, nuclear reactors, pipelines, bridges, etc.; cutting and removal of structures in refineries; civil engineering projects and construction and demolitions; concrete repair and removal; mining; surface mining; deep mining; rock and earth removal; surface mining; tunneling; making small diameter bores; oil field perforating; oil field fracking; well completion; window cutting; well decommissioning; well workover; precise and from a distance in-place milling and machining; heat treating; drilling and advancing boreholes; workover and completion; flow assurance; and, combinations and variations of these and other activities and operations.

A single high power laser may be utilized in or with these system, tools and operations, or there may be two or three high power lasers, or more. High power solid-state lasers, specifically semiconductor lasers and fiber lasers are preferred, because of their short start up time and essentially instant-on capabilities. The high power lasers for example may be fiber lasers, disk lasers or semiconductor lasers having 5 kW, 10 kW, 20 kW, 50 kW, 80 kW or more power and, which emit laser beams with wavelengths in the range from about 455 nm (nanometers) to about 2100 nm, preferably in the range about 400 nm to about 1600 nm, about 400 nm to about 800 nm, 800 nm to about 1600 nm, about 1060 nm to 1080 nm, 1530 nm to 1600 nm, 1800 nm to 2100 nm, and more preferably about 1064 nm, about 1070-1080 nm, about 1360 nm, about 1455 nm, 1490 nm, or about 1550 nm, or about 1900 nm (wavelengths in the range of 1900 nm may be provided by Thulium lasers). An example of this general type of fiber laser is the IPG YLS-20000. The detailed properties of which are disclosed in US patent application Publication Number 2010/0044106. Thus, by way of example, there is contemplated the use of four, five, or six, 20 kW lasers to provide a laser beam having a power greater than about 60 kW, greater than about 70 kW, greater than about 80 kW, greater than about 90 kW and greater than about 100 kW. One laser may also be envisioned to provide these higher laser powers.

The various embodiments of high power laser perforating tools set forth in this specification may be used with various high power laser systems and conveyance structures and systems, in addition to those embodiments of the figures and embodiments in this specification. For example, embodiments of a laser perforating tool may use, or be used in, or with, the systems, lasers, tools and methods disclosed and taught in the following US patent applications and patent application publications: Publication No. 2010/0044106; Publication No. 2010/0215326; Publication No. 2012/0275159; Publication No. 2010/0044103; Publication No. 2012/0267168; Publication No. 2012/0020631; Publication No. 2013/0011102; Publication No. 2012/0217018; Publication No. 2012/0217015; Publication No. 2012/0255933; Publication No. 2012/0074110; Publication No. 2012/0068086; Publication No. 2012/0273470; Publication No. 2012/0067643; Publication No. 2012/0266803; Ser. No. 13/868,149; Ser. No. 61/745,661; and Ser. No. 61/727,096, the entire disclosure of each of which are incorporated herein by reference.

The inventions may be embodied in other forms than those specifically disclosed herein without departing from its spirit or essential characteristics. The described embodiments are to be considered in all respects only as illustrative and not restrictive.

What is claimed:

1. A method of enhancing fluid communication between a borehole and a hydrocarbon reservoir in a formation, the method comprising:

a. obtaining data about the geological properties of a formation containing a hydrocarbon reservoir;

b. inserting a high power laser tool into a borehole, and advancing the laser tool to a predetermined location within the borehole;

c. placing the laser tool in optical and control communication with a high power laser delivery system;

d. based, at least in part, on the formation data, determining a laser energy delivery pattern; wherein, the laser energy delivery pattern comprises a plurality of laser perforations for predetermined locations in the formation;

e. the laser delivery system and laser tool providing the laser energy delivery pattern to the predetermined location within the borehole;

f. whereby, the laser energy creates a custom geometry in the formation enhancing fluid communication between the borehole and the hydrocarbon reservoir;

g. obtaining a hydraulic fracturing plan for the formation; and, h. hydraulic fracturing the formation based, at least in part, upon the hydraulic fracturing plan.

2. The method of claim 1, wherein the laser tool comprises a total internal reflection prism.

3. The method of claim 1, wherein at least one laser perforation extends at least about 3 inches from the borehole side wall.

4. The method of claim 1, wherein at least one laser perforation extends at least about 10 inches from the borehole side wall.

5. The method of claim 1, wherein at least one laser perforation extends at least about 20 inches from the borehole side wall.

6. The method of claim 1, wherein the laser tool comprises a Risley prism.

7. The method of claim 1, wherein the laser tool comprise a passive vertical position determining sub.

8. The method of claim 1, wherein the plurality of laser perforations comprises at least about 50 perforations.

9. The method of claim 1, wherein a laser perforation comprises a pie shape.

10. A method of providing a laser enhanced hydraulic fracturing operation to enhance fluid communication between a borehole and a hydrocarbon reservoir in a formation, the method comprising:

a. obtaining data about the geological properties of a formation containing a hydrocarbon reservoir;

b. obtaining a hydraulic fracturing plan for the formation;

c. inserting a high power laser tool into a borehole, and advancing the laser tool to a predetermined location within the borehole;

d. placing the laser tool in optical and control communication with a high power laser delivery system;

e. based, at least in part, on the formation data and the hydraulic fracturing plan, determining a laser energy delivery pattern; wherein, the laser energy delivery pattern comprises a plurality of laser perforations for predetermined locations in the formation;

f. the laser delivery system and laser tool delivering the laser energy delivery pattern to the predetermined location within the borehole; and, g. hydraulic fracturing the formation based, at least in part, upon the hydraulic fracturing plan;

h. whereby, the laser energy creates a custom geometry in the formation enhancing the hydraulic fracturing of the formation and thereby, enhancing the fluid communication between the borehole and the hydrocarbon reservoir in the formation.

11. The method of claim 10, wherein the hydraulic fracturing plan is based at least in part upon the custom geometry.

12. A method of enhancing fluid communication between a borehole and a hydrocarbon reservoir in a formation, the method comprising:

a. obtaining data about the geological properties of a formation containing a hydrocarbon reservoir;

b. inserting a high power laser tool into a borehole, and advancing the laser tool to a predetermined location within the borehole;

c. placing the laser tool in optical and control communication with a high power laser delivery system;

d. based, at least in part, on the formation data, determining a laser energy delivery pattern; wherein, the laser energy delivery pattern comprises a plurality of laser perforations for predetermined locations in the formation; and, e. the laser delivery system and laser tool providing the laser energy delivery pattern to the predetermined location within the borehole;

f. whereby, the laser energy creates a custom geometry in the formation enhancing fluid communication between the borehole and the hydrocarbon reservoir; and, wherein the laser tool comprises an angled fluid jet intersecting a laser beam path.

* * * * *